US010933301B2

(12) United States Patent
Sampson et al.

(10) Patent No.: US 10,933,301 B2
(45) **Date of Patent: *Mar. 2, 2021**

(54) METHOD FOR SHUFFLING AND DEALING CARDS

(71) Applicant: SG Gaming, Inc., Las Vegas, NV (US)

(72) Inventors: David E. Sampson, Woodinville, WA (US); Steven L. Forte, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/799,138

(22) Filed: Feb. 24, 2020

(65) Prior Publication Data

US 2020/0188767 A1 Jun. 18, 2020

Related U.S. Application Data

(60) Division of application No. 15/360,598, filed on Nov. 23, 2016, now Pat. No. 10,668,362, which is a continuation of application No. 14/500,286, filed on Sep. 29, 2014, now Pat. No. 9,713,761, which is a continuation of application No. 13/942,551, filed on Jul. 15, 2013, now Pat. No. 8,844,930, which is a division of application No. 13/560,826, filed on Jul. 27, 2012, now Pat. No. 8,485,527, which is a continuation-in-part of application No. 13/194,652, filed on Jul. 29, 2011, now Pat. No. 8,342,526.

(51) Int. Cl.

| | |
|---|---|
| ***A63F 1/12*** | (2006.01) |
| ***A63F 1/14*** | (2006.01) |
| ***A63F 9/24*** | (2006.01) |

(52) U.S. Cl.
CPC ..... *A63F 1/12* (2013.01); *A63F 1/14* (2013.01); *A63F 2009/2482* (2013.01)

(58) Field of Classification Search
CPC ..... A63F 1/12; A63F 1/14
USPC ..... 273/149 R
See application file for complete search history.

(56) References Cited

U.S. PATENT DOCUMENTS

| | | | |
|---|---|---|---|
| 130,281 | A | 8/1872 | Coughlin |
| 205,030 | A | 6/1878 | Ash |
| 609,730 | A | 8/1898 | Booth |
| 673,154 | A | 4/1901 | Bellows |
| 793,489 | A | 6/1905 | Williams |
| 892,389 | A | 7/1908 | Bellows |
| 1,014,219 | A | 1/1912 | Hall |

(Continued)

FOREIGN PATENT DOCUMENTS

| | | | |
|---|---|---|---|
| AU | 2383667 | A | 1/1969 |
| AU | 50254/79 | A | 3/1980 |

(Continued)

OTHER PUBLICATIONS

International Search Report for International Application No. PCT/US2003/015393, dated Oct. 6, 2003.

(Continued)

*Primary Examiner* — John E Simms, Jr.
*Assistant Examiner* — Dolores R Collins
(74) *Attorney, Agent, or Firm* — TraskBritt

(57) ABSTRACT

A card shuffler that moves cards one at a time to randomly designated single-card receptacle in a receiving or dealing rack, and a method for shuffling and for dealing cards.

24 Claims, 33 Drawing Sheets

(56) References Cited

U.S. PATENT DOCUMENTS 1,043,109 A 11/1912 Hurm
1,157,898 A 10/1915 Perret
1,256,509 A 2/1918 Belknap
1,380,898 A * 6/1921 Hall ..... A63F 1/12
273/149 R
1,556,856 A 10/1925 Lipps
1,757,553 A 5/1930 Tauschek
1,850,114 A 3/1932 McCaddin
1,885,276 A 11/1932 McKay
1,889,729 A 11/1932 Hammond
1,955,926 A 4/1934 Matthaey
1,992,085 A 2/1935 McKay
1,998,690 A 4/1935 William et al.
2,001,220 A 5/1935 Smith
2,001,918 A 5/1935 Nevius
2,016,030 A * 10/1935 Woodruff ..... A63F 1/14
273/149 R
2,043,343 A 6/1936 Warner
2,060,096 A 11/1936 McCoy
2,065,824 A 12/1936 Plass
2,159,958 A 5/1939 Sachs
2,185,474 A 1/1940 Nott
2,254,484 A 9/1941 Hutchins
D132,360 S 5/1942 Gardner
2,328,153 A 8/1943 Laing
2,328,879 A 9/1943 Issacson
D139,530 S 11/1944 Schindler
2,364,413 A 12/1944 Wittel
2,525,305 A 10/1950 Lombard
2,543,522 A 2/1951 Cohen
2,588,582 A 3/1952 Sivertson
2,615,719 A 10/1952 Fonken
2,659,607 A 11/1953 Skillman et al.
2,661,215 A 12/1953 Stevens
2,676,020 A 4/1954 Ogden
2,692,777 A 10/1954 Miller
2,701,720 A 2/1955 Ogden
2,705,638 A 4/1955 Newcomb
2,711,319 A 6/1955 Earl et al.
2,714,510 A 8/1955 Oppenlander et al.
2,717,782 A 9/1955 Droll
2,727,747 A 12/1955 Semisch, Jr.
2,731,271 A * 1/1956 Brown ..... A63F 1/10
273/149 R
2,747,877 A 5/1956 Howard
2,755,090 A 7/1956 Aldrich
2,757,005 A 7/1956 Nothaft
2,760,779 A 8/1956 Ogden et al.
2,770,459 A 11/1956 Wilson et al.
2,778,643 A 1/1957 Williams
2,778,644 A 1/1957 Stephenson
2,782,040 A 2/1957 Matter
2,790,641 A 4/1957 Adams
2,793,863 A 5/1957 Liebelt
2,815,214 A 12/1957 Hall
2,821,399 A 1/1958 Heinoo
2,914,215 A 11/1959 Neidig
2,937,739 A 5/1960 Levy
2,950,005 A 8/1960 MacDonald
RE24,986 E 5/1961 Stephenson
3,067,885 A 12/1962 Kohler
3,107,096 A 10/1963 Osborn
3,124,674 A 3/1964 Edwards et al.
3,131,935 A 5/1964 Gronneberg
3,147,978 A 9/1964 Sjostrand
D200,652 S 3/1965 Fisk
3,185,482 A 5/1965 Russell
3,222,071 A 12/1965 Lang
3,235,741 A 2/1966 Plaisance
3,288,308 A 11/1966 Gingher
3,305,237 A * 2/1967 Granius ..... A63F 1/12
273/149 R
3,312,473 A 4/1967 Friedman et al.
3,452,509 A 7/1969 Werner
3,530,968 A 9/1970 Palmer
3,588,116 A 6/1971 Kosaburo
3,589,730 A 6/1971 Slay
3,595,388 A 7/1971 Castaldi
3,597,076 A 8/1971 Hubbard et al.
3,598,396 A 8/1971 Andrews et al.
3,618,933 A 11/1971 Roggenstein et al.
3,627,331 A 12/1971 Erickson
3,666,270 A 5/1972 Mazur
3,680,853 A 8/1972 Houghton et al.
3,690,670 A 9/1972 Cassady et al.
3,704,938 A 12/1972 Fanselow
3,716,238 A 2/1973 Porter
3,751,041 A 8/1973 Seifert
3,761,079 A 9/1973 Azure
3,810,627 A 5/1974 Levy
D232,953 S 9/1974 Oguchi
3,861,261 A 1/1975 Maxey
3,897,954 A 8/1975 Erickson et al.
3,899,178 A 8/1975 Watanabe
3,909,002 A 9/1975 Levy
3,929,339 A 12/1975 Mattioli
3,944,077 A 3/1976 Green
3,944,230 A 3/1976 Fineman
3,949,219 A 4/1976 Crouse
3,968,364 A 7/1976 Miller
4,023,705 A 5/1977 Reiner et al.
4,033,590 A 7/1977 Pic
4,072,930 A 2/1978 Lucero et al.
4,088,265 A 5/1978 Garczynski
4,151,410 A 4/1979 McMillan et al.
4,159,581 A 7/1979 Lichtenberg
4,162,649 A 7/1979 Thornton
4,166,615 A 9/1979 Kurokawa et al.
4,232,861 A 11/1980 Maul
4,280,690 A 7/1981 Hill
4,283,709 A 8/1981 Lucero et al.
4,310,160 A 1/1982 Willette et al.
4,339,134 A 7/1982 Macheel
4,339,798 A 7/1982 Hedges et al.
4,361,393 A 11/1982 Noto
4,368,972 A 1/1983 Naramore
4,369,972 A 1/1983 Parker
4,374,309 A 2/1983 Walton
4,377,285 A 3/1983 Kadlic
4,385,827 A 5/1983 Naramore
4,388,994 A 6/1983 Suda et al.
4,397,469 A 8/1983 Carter, III
4,421,312 A 12/1983 Delgado et al.
4,421,501 A 12/1983 Scheffer
D273,962 S 5/1984 Fromm
D274,069 S 5/1984 Fromm
4,457,512 A 7/1984 Stevenson
4,467,424 A 8/1984 Hedges et al.
4,494,197 A 1/1985 Troy et al.
4,497,488 A 2/1985 Plevyak et al.
4,512,580 A 4/1985 Matviak
4,513,969 A 4/1985 Samsel, Jr.
4,515,367 A 5/1985 Howard
4,531,187 A 7/1985 Uhland
4,534,562 A 8/1985 Cuff et al.
4,549,738 A 10/1985 Greitzer
4,566,782 A 1/1986 Britt et al.
4,575,367 A 3/1986 Karmel
4,586,712 A 5/1986 Lorber et al.
4,659,082 A 4/1987 Greenberg
4,662,637 A 5/1987 Pfeiffer
4,662,816 A 5/1987 Fabrig
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,412 A 9/1988 Wolfe
4,770,421 A * 9/1988 Hoffman ..... A63F 1/12
273/149 R
4,807,884 A * 2/1989 Breeding ..... A63F 1/12
273/149 R
4,822,050 A 4/1989 Normand et al.
4,832,342 A 5/1989 Plevyak et al.

(56) References Cited

U.S. PATENT DOCUMENTS 4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Hover et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 Levasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 Demar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 Lestrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 Van et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson et al.
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky et al.
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.
6,123,010 A 9/2000 Blackstone
D432,588 S 10/2000 Tedham
6,126,166 A 10/2000 Lorson et al.
6,131,817 A 10/2000 Miller
6,139,014 A 10/2000 Breeding et al.
6,149,154 A * 11/2000 Grauzer ..... A63F 1/12
273/149 P
6,154,131 A 11/2000 Jones et al.
6,165,069 A 12/2000 Sines et al.

(56) References Cited

U.S. PATENT DOCUMENTS 6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block et al.
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,543,770 B1 4/2003 Kaji et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hartl
6,585,856 B2 7/2003 Zwick et al.
6,588,750 B1 7/2003 Grauzer et al.
6,588,751 B1 * 7/2003 Grauzer ..... A63F 1/12 273/149 R
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff et al.
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue et al.
6,848,994 B1 2/2005 Knust et al.
6,857,961 B2 2/2005 Soltys et al.
6,874,784 B1 4/2005 Promutico et al.
6,874,786 B2 4/2005 Bruno et al.
6,877,657 B2 4/2005 Ranard et al.
6,877,748 B1 4/2005 Patroni et al.
6,886,829 B2 5/2005 Hessing et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow
6,938,900 B2 9/2005 Snow
6,941,180 B1 9/2005 Fischer et al.
6,950,948 B2 9/2005 Neff
6,955,599 B2 10/2005 Bourbour et al.
6,957,746 B2 10/2005 Martin et al.
6,959,925 B1 11/2005 Baker et al.

(56) References Cited

U.S. PATENT DOCUMENTS 6,960,134 B2 11/2005 Hartl et al.
6,964,612 B2 11/2005 Soltys et al.
6,986,514 B2 1/2006 Snow
6,988,516 B2 1/2006 Debaes et al.
7,011,309 B2 3/2006 Soltys et al.
7,020,307 B2 3/2006 Hinton et al.
7,028,598 B2 4/2006 Teshima
7,029,009 B2 4/2006 Grauzer et al.
7,036,818 B2 5/2006 Grauzer et al.
7,046,458 B2 5/2006 Nakayama
7,046,764 B1 5/2006 Kump
7,048,629 B2 5/2006 Sines et al.
7,059,602 B2 6/2006 Grauzer et al.
7,066,464 B2 6/2006 Blad et al.
7,068,822 B2 6/2006 Scott
7,073,791 B2 7/2006 Grauzer et al.
7,079,010 B2 7/2006 Champlin
7,084,769 B2 8/2006 Bauer et al.
7,089,420 B1 8/2006 Durst et al.
D527,900 S 9/2006 Dewa et al.
7,106,201 B2 9/2006 Tuttle
7,113,094 B2 9/2006 Garber et al.
7,114,718 B2 10/2006 Grauzer et al.
7,124,947 B2 10/2006 Storch
7,128,652 B1 10/2006 Lavoie et al.
7,137,627 B2 11/2006 Grauzer et al.
7,139,108 B2 11/2006 Andersen et al.
7,140,614 B2 11/2006 Snow
7,162,035 B1 1/2007 Durst et al.
7,165,769 B2 1/2007 Crenshaw et al.
7,165,770 B2 1/2007 Snow
7,175,522 B2 2/2007 Hartl
7,186,181 B2 3/2007 Rowe
7,201,656 B2 4/2007 Darder
7,202,888 B2 4/2007 Tecu et al.
7,203,841 B2 4/2007 Jackson et al.
7,213,812 B2 5/2007 Schubert et al.
7,222,852 B2 5/2007 Soltys et al.
7,222,855 B2 5/2007 Sorge
7,231,812 B1 6/2007 Lagare
7,234,698 B2 6/2007 Grauzer et al.
7,237,969 B2 7/2007 Bartman
7,243,148 B2 7/2007 Keir et al.
7,243,698 B2 7/2007 Siegel
7,246,799 B2 7/2007 Snow
7,255,344 B2 8/2007 Grauzer et al.
7,255,351 B2 8/2007 Yoseloff et al.
7,255,642 B2 8/2007 Sines et al.
7,257,630 B2 8/2007 Cole et al.
7,261,294 B2 8/2007 Grauzer et al.
7,264,241 B2 9/2007 Schubert et al.
7,264,243 B2 9/2007 Yoseloff et al.
7,277,570 B2 10/2007 Armstrong
7,278,923 B2 10/2007 Grauzer et al.
7,294,056 B2 11/2007 Lowell et al.
7,297,062 B2 11/2007 Gatto et al.
7,300,056 B2 11/2007 Gioia et al.
7,303,473 B2 12/2007 Rowe
7,303,475 B2 12/2007 Britt et al.
7,309,065 B2 12/2007 Yoseloff et al.
7,316,609 B2 1/2008 Dunn et al.
7,316,615 B2 1/2008 Soltys et al.
7,322,576 B2 1/2008 Grauzer et al.
7,331,579 B2 2/2008 Snow
7,334,794 B2 2/2008 Snow
7,338,044 B2 3/2008 Grauzer et al.
7,338,362 B1 3/2008 Gallagher
7,341,510 B2 3/2008 Bourbour et al.
D566,784 S 4/2008 Palmer
7,357,321 B2 4/2008 Yoshida et al.
7,360,094 B2 4/2008 Neff
7,367,561 B2 5/2008 Blaha et al.
7,367,563 B2 5/2008 Yoseloff et al.
7,367,565 B2 5/2008 Chiu
7,367,884 B2 5/2008 Breeding et al.
7,374,170 B2 5/2008 Grauzer et al.
7,384,044 B2 6/2008 Grauzer et al.
7,387,300 B2 6/2008 Snow
7,389,990 B2 6/2008 Mourad
7,390,256 B2 6/2008 Soltys et al.
7,399,226 B2 7/2008 Mishra
7,407,438 B2 8/2008 Schubert et al.
7,413,191 B2 8/2008 Grauzer et al.
7,434,805 B2 10/2008 Grauzer et al.
7,436,957 B1 10/2008 Fischer et al.
7,448,626 B2 11/2008 Fleckenstein
7,458,582 B2 12/2008 Snow et al.
7,461,843 B1 12/2008 Baker et al.
7,464,932 B2 12/2008 Darling
7,464,934 B2 12/2008 Schwartz
7,472,906 B2 1/2009 Shai
7,478,813 B1 1/2009 Hofferber et al.
7,500,672 B2 3/2009 Ho
7,506,874 B2 3/2009 Hall
7,510,186 B2 3/2009 Fleckenstein
7,510,190 B2 3/2009 Snow et al.
7,510,194 B2 3/2009 Soltys et al.
7,510,478 B2 3/2009 Benbrahim et al.
7,513,437 B2 4/2009 Douglas
7,515,718 B2 4/2009 Nguyen et al.
7,523,935 B2 4/2009 Grauzer et al.
7,523,936 B2 4/2009 Grauzer et al.
7,523,937 B2 4/2009 Fleckenstein
7,525,510 B2 4/2009 Beland et al.
7,537,216 B2 5/2009 Soltys et al.
7,540,497 B2 6/2009 Tseng
7,540,498 B2 6/2009 Crenshaw et al.
7,549,643 B2 6/2009 Quach
7,554,753 B2 6/2009 Wakamiya
7,556,197 B2 7/2009 Yoshida et al.
7,556,266 B2 7/2009 Blaha et al.
7,575,237 B2 8/2009 Snow
7,578,506 B2 8/2009 Lambert
7,584,962 B2 9/2009 Breeding et al.
7,584,963 B2 9/2009 Krenn et al.
7,584,966 B2 9/2009 Snow
7,591,728 B2 9/2009 Gioia et al.
7,593,544 B2 9/2009 Downs et al.
7,594,660 B2 9/2009 Baker et al.
7,597,623 B2 10/2009 Grauzer et al.
7,644,923 B1 1/2010 Dickinson et al.
7,661,676 B2 2/2010 Smith et al.
7,666,090 B2 2/2010 Hettinger
7,669,852 B2 3/2010 Baker et al.
7,669,853 B2 3/2010 Jones
7,677,565 B2 3/2010 Grauzer et al.
7,677,566 B2 3/2010 Krenn et al.
7,686,681 B2 3/2010 Soltys et al.
7,699,694 B2 4/2010 Hill
7,735,657 B2 6/2010 Johnson
7,740,244 B2 6/2010 Ho
7,744,452 B2 6/2010 Cimring et al.
7,753,373 B2 * 7/2010 Grauzer ..... A63F 1/12
273/148 R
7,753,374 B2 7/2010 Ho
7,753,798 B2 7/2010 Soltys et al.
7,758,425 B2 7/2010 Poh et al.
7,762,554 B2 7/2010 Ho
7,764,836 B2 7/2010 Downs et al.
7,766,332 B2 8/2010 Grauzer et al.
7,766,333 B1 8/2010 Stardust et al.
7,769,232 B2 8/2010 Downs, III
7,769,853 B2 8/2010 Nezamzadeh
7,773,749 B1 8/2010 Durst et al.
7,780,529 B2 8/2010 Rowe et al.
7,784,790 B2 8/2010 Grauzer et al.
7,804,982 B2 9/2010 Howard et al.
7,824,255 B2 11/2010 Lutnick et al.
7,846,020 B2 12/2010 Walker et al.
7,867,080 B2 1/2011 Nicely et al.
7,890,365 B2 2/2011 Hettinger
7,900,923 B2 3/2011 Toyama et al.
7,901,285 B2 3/2011 Tran et al.
7,908,169 B2 3/2011 Hettinger

(56) References Cited

U.S. PATENT DOCUMENTS 7,909,689 B2 3/2011 Lardie
7,931,533 B2 4/2011 Lemay et al.
7,933,448 B2 4/2011 Downs, III
7,946,586 B2 5/2011 Krenn et al.
7,959,153 B2 6/2011 Franks, Jr.
7,967,294 B2 6/2011 Blaha et al.
7,976,023 B1 7/2011 Hessing et al.
7,988,152 B2 8/2011 Sines
7,988,554 B2 8/2011 Lemay et al.
7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 * 1/2013 Sampson ..... A63F 1/12 273/149 R
8,342,529 B2 1/2013 Snow
8,353,513 B2 1/2013 Swanson
8,381,918 B2 2/2013 Johnson
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 * 7/2013 Sampson ..... A63F 1/12 273/149 R
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,550,464 B2 10/2013 Soltys et al.
8,556,263 B2 10/2013 Grauzer et al.
8,579,289 B2 11/2013 Rynda et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,844,930 B2 * 9/2014 Sampson ..... A63F 1/12 273/149 R
8,899,587 B2 * 12/2014 Grauzer ..... A63F 1/12 273/148 A
8,919,775 B2 12/2014 Wadds et al.
9,101,821 B2 8/2015 Snow
9,251,661 B2 2/2016 Tammesoo
9,266,012 B2 2/2016 Grauzer et al.
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,713,761 B2 * 7/2017 Sampson ..... A63F 1/12
9,731,190 B2 * 8/2017 Sampson ..... A63F 1/12
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0030425 A1 3/2002 Tiramani et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer et al.
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 * 4/2003 Blaha ..... A63F 1/12 273/149 R
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff et al.
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.

(56) References Cited

U.S. PATENT DOCUMENTS

2005/0110210 A1 5/2005 Soltys et al.
2005/0113166 A1 5/2005 Grauzer et al.
2005/0113171 A1 5/2005 Hodgson
2005/0119048 A1 6/2005 Soltys et al.
2005/0121852 A1 6/2005 Soltys et al.
2005/0137005 A1 6/2005 Soltys et al.
2005/0140090 A1 6/2005 Breeding et al.
2005/0146093 A1 7/2005 Grauzer et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs, III
2005/0272501 A1 12/2005 Tran et al.
2005/0277463 A1 12/2005 Knust et al.
2005/0288083 A1 12/2005 Downs, III
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0063577 A1 3/2006 Downs et al.
2006/0066048 A1 3/2006 Krenn et al.
2006/0084502 A1 4/2006 Downs et al.
2006/0151946 A1 7/2006 Ngai
2006/0181022 A1 8/2006 Grauzer et al.
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2006/0281534 A1 12/2006 Grauzer et al.
2007/0001395 A1 1/2007 Gioia et al.
2007/0006708 A1 1/2007 Laakso
2007/0015583 A1 1/2007 Tran
2007/0018389 A1 1/2007 Downs, III
2007/0045959 A1 3/2007 Soltys
2007/0049368 A1 3/2007 Kuhn et al.
2007/0057454 A1 3/2007 Fleckenstein
2007/0057469 A1 3/2007 Grauzer et al.
2007/0066387 A1 3/2007 Matsuno et al.
2007/0069462 A1 3/2007 Downs et al.
2007/0072677 A1 3/2007 Lavoie et al.
2007/0102879 A1* 5/2007 Stasson ..... A63F 1/12 273/149 R
2007/0111773 A1 5/2007 Gururajan et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1 9/2007 Blaha et al.
2007/0225055 A1 9/2007 Weisman
2007/0233567 A1 10/2007 Daly
2007/0238506 A1 10/2007 Ruckle
2007/0241498 A1 10/2007 Soltys
2007/0259709 A1 11/2007 Kelly et al.
2007/0267812 A1 11/2007 Grauzer et al.
2007/0272600 A1 11/2007 Johnson
2007/0278739 A1 12/2007 Swanson
2007/0287534 A1 12/2007 Fleckenstein
2007/0290438 A1 12/2007 Grauzer et al.
2007/0298865 A1 12/2007 Soltys
2008/0004107 A1 1/2008 Nguyen et al.
2008/0006997 A1 1/2008 Scheper et al.
2008/0006998 A1 1/2008 Grauzer et al.
2008/0022415 A1 1/2008 Kuo
2008/0032763 A1 2/2008 Giobbi
2008/0039192 A1 2/2008 Laut
2008/0039208 A1 2/2008 Abrink et al.
2008/0096656 A1 4/2008 Lemay et al.
2008/0111300 A1 5/2008 Czyzewski et al.
2008/0113700 A1 5/2008 Czyzewski et al.
2008/0113783 A1 5/2008 Czyzewski et al.
2008/0136108 A1 6/2008 Polay
2008/0143048 A1 6/2008 Shigeta
2008/0176627 A1 7/2008 Lardie
2008/0217218 A1 9/2008 Johnson
2008/0234046 A1 9/2008 Kinsley
2008/0234047 A1 9/2008 Nguyen
2008/0248875 A1 10/2008 Beatty
2008/0284096 A1 11/2008 Toyama et al.
2008/0303210 A1 12/2008 Grauzer et al.
2008/0315517 A1 12/2008 Toyama
2009/0026700 A2 1/2009 Shigeta
2009/0048026 A1 2/2009 French
2009/0054161 A1 2/2009 Schubert et al.
2009/0072477 A1* 3/2009 Tseng ..... A63F 1/12 273/149 R
2009/0091078 A1 4/2009 Grauzer et al.
2009/0100409 A1 4/2009 Toneguzzo
2009/0104963 A1 4/2009 Burman et al.
2009/0121429 A1 5/2009 Walsh
2009/0134575 A1 5/2009 Dickinson et al.
2009/0140492 A1 6/2009 Yoseloff et al.
2009/0166970 A1 7/2009 Rosh
2009/0176547 A1 7/2009 Katz
2009/0179378 A1 7/2009 Amaitis et al.
2009/0186676 A1 7/2009 Amaitis et al.
2009/0189346 A1 7/2009 Krenn et al.
2009/0191933 A1 7/2009 French
2009/0194988 A1 8/2009 Wright et al.
2009/0197662 A1 8/2009 Wright et al.
2009/0224476 A1 9/2009 Grauzer et al.
2009/0227318 A1 9/2009 Wright et al.
2009/0227360 A1 9/2009 Gioia et al.
2009/0250873 A1 10/2009 Jones
2009/0253478 A1 10/2009 Walker et al.
2009/0253503 A1 10/2009 Krise et al.
2009/0267296 A1 10/2009 Ho
2009/0267297 A1 10/2009 Blaha et al.
2009/0283969 A1 11/2009 Tseng
2009/0298577 A1 12/2009 Gagner et al.
2009/0302535 A1 12/2009 Ho
2009/0302537 A1 12/2009 Ho
2009/0312093 A1 12/2009 Walker et al.
2009/0314188 A1 12/2009 Toyama et al.
2010/0013152 A1 1/2010 Grauzer et al.
2010/0038849 A1 2/2010 Scheper et al.
2010/0048304 A1 2/2010 Boesen
2010/0069155 A1 3/2010 Schwartz et al.
2010/0178987 A1 7/2010 Pacey
2010/0197410 A1 8/2010 Leen et al.
2010/0234110 A1 9/2010 Clarkson
2010/0240440 A1 9/2010 Szrek et al.
2010/0244376 A1 9/2010 Johnson
2010/0244382 A1 9/2010 Snow
2010/0252992 A1 10/2010 Sines
2010/0255899 A1 10/2010 Paulsen
2010/0276880 A1 11/2010 Grauzer et al.
2010/0311493 A1 12/2010 Miller et al.
2010/0311494 A1 12/2010 Miller et al.
2010/0314830 A1 12/2010 Grauzer et al.
2010/0320685 A1 12/2010 Grauzer et al.
2011/0006480 A1 1/2011 Grauzer et al.
2011/0012303 A1 1/2011 Kourgiantakis et al.
2011/0024981 A1 2/2011 Tseng
2011/0052049 A1 3/2011 Rajaraman et al.
2011/0062662 A1 3/2011 Ohta et al.
2011/0078096 A1 3/2011 Bounds
2011/0079959 A1 4/2011 Hartley
2011/0105208 A1 5/2011 Bickley
2011/0109042 A1 5/2011 Rynda et al.
2011/0130185 A1 6/2011 Walker
2011/0130190 A1 6/2011 Hamman et al.
2011/0159952 A1 6/2011 Kerr
2011/0159953 A1 6/2011 Kerr
2011/0165936 A1 7/2011 Kerr
2011/0172008 A1 7/2011 Alderucci
2011/0183748 A1 7/2011 Wilson et al.

(56) References Cited

U.S. PATENT DOCUMENTS

| | | | | |
|---|---|---|---|---|
| 2011/0230148 | A1 | 9/2011 | Demuynck et al. | |
| 2011/0230268 | A1 | 9/2011 | Williams | |
| 2011/0269529 | A1 | 11/2011 | Baerlocher | |
| 2011/0272881 | A1 | 11/2011 | Sines | |
| 2011/0285081 | A1 | 11/2011 | Stasson | |
| 2011/0287829 | A1 | 11/2011 | Clarkson et al. | |
| 2012/0015724 | A1 | 1/2012 | Ocko et al. | |
| 2012/0015725 | A1 | 1/2012 | Ocko et al. | |
| 2012/0015743 | A1 | 1/2012 | Lam et al. | |
| 2012/0015747 | A1 | 1/2012 | Ocko et al. | |
| 2012/0021835 | A1 | 1/2012 | Keller et al. | |
| 2012/0034977 | A1 | 2/2012 | Kammler | |
| 2012/0062745 | A1 | 3/2012 | Han et al. | |
| 2012/0074646 | A1 | 3/2012 | Grauzer et al. | |
| 2012/0091656 | A1 | 4/2012 | Blaha et al. | |
| 2012/0095982 | A1 | 4/2012 | Lennington et al. | |
| 2012/0161393 | A1 | 6/2012 | Krenn et al. | |
| 2012/0175841 | A1 | 7/2012 | Grauzer et al. | |
| 2012/0181747 | A1 | 7/2012 | Grauzer et al. | |
| 2012/0187625 | A1 | 7/2012 | Downs et al. | |
| 2012/0242782 | A1 | 9/2012 | Huang | |
| 2012/0286471 | A1 | 11/2012 | Grauzer et al. | |
| 2012/0306152 | A1 | 12/2012 | Krishnamurty et al. | |
| 2013/0020761 | A1 | 1/2013 | Sines et al. | |
| 2013/0023318 | A1 | 1/2013 | Abrahamson | |
| 2013/0085638 | A1 | 4/2013 | Weinmann et al. | |
| 2013/0099448 | A1 | 4/2013 | Scheper et al. | |
| 2013/0109455 | A1 | 5/2013 | Grauzer et al. | |
| 2013/0132306 | A1 | 5/2013 | Kami et al. | |
| 2013/0147116 | A1 | 6/2013 | Stasson | |
| 2013/0161905 | A1 | 6/2013 | Grauzer et al. | |
| 2013/0228972 | A1 | 9/2013 | Grauzer et al. | |
| 2013/0241147 | A1 | 9/2013 | McGrath | |
| 2013/0300059 | A1 | 11/2013 | Sampson et al. | |
| 2013/0337922 | A1 | 12/2013 | Kuhn | |
| 2014/0027979 | A1 | 1/2014 | Stasson et al. | |
| 2014/0094239 | A1 | 4/2014 | Grauzer et al. | |
| 2014/0103606 | A1 | 4/2014 | Grauzer et al. | |
| 2014/0138907 | A1 | 5/2014 | Rynda et al. | |
| 2014/0145399 | A1 | 5/2014 | Krenn et al. | |
| 2014/0171170 | A1 | 6/2014 | Krishnamurty et al. | |
| 2014/0175724 | A1 | 6/2014 | Huhtala et al. | |
| 2014/0183818 | A1 | 7/2014 | Czyzewski et al. | |
| 2015/0021242 | A1 | 1/2015 | Johnson | |
| 2015/0069699 | A1 | 3/2015 | Blazevic | |
| 2015/0196834 | A1 | 7/2015 | Scheper et al. | |
| 2015/0238848 | A1* | 8/2015 | Kuhn | A63F 1/12 273/149 R |
| 2015/0251079 | A1 | 9/2015 | Wright | |
| 2017/0157499 | A1 | 6/2017 | Krenn et al. | |
| 2018/0085658 | A1 | 3/2018 | Nelsen et al. | |
| 2018/0089956 | A1 | 3/2018 | Nagaragatta et al. | |
| 2018/0200610 | A1 | 7/2018 | Riordan et al. | |

FOREIGN PATENT DOCUMENTS

| | | | |
|---|---|---|---|
| AU | 06978/05 | B2 | 10/1998 |
| AU | 07576/36 | B2 | 2/2003 |
| CA | 2266555 | A1 | 4/1998 |
| CA | 2284017 | A1 | 9/1998 |
| CA | 2612138 | A1 | 12/2006 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CZ | 0024952 | U1 | 2/2013 |
| DE | 0291230 | C | 4/1916 |
| DE | 2757341 | A1 | 6/1978 |
| DE | 2816377 | A1 | 10/1979 |
| DE | 3807127 | A1 | 9/1989 |
| EP | 0777514 | B1 | 2/2000 |
| EP | 1194888 | A1 | 4/2002 |
| EP | 1502631 | A1 | 2/2005 |
| EP | 1713026 | A1 | 10/2006 |
| EP | 2228106 | A1 | 9/2010 |
| EP | 1575261 | B1 | 8/2012 |
| FR | 2375918 | A1 | 7/1978 |
| GB | 0289552 | A | 4/1928 |
| GB | 0337147 | A | 10/1930 |
| GB | 0414014 | A | 7/1934 |
| GB | 0672616 | A | 5/2005 |
| JP | 10-063933 | A | 3/1998 |
| JP | 11-045321 | A | 2/1999 |
| JP | 2000-251031 | A | 9/2000 |
| JP | 2001-327647 | A | 11/2001 |
| JP | 2002-165916 | A | 6/2002 |
| JP | 2003-154320 | A | 5/2003 |
| JP | 2003-250950 | A | 9/2003 |
| JP | 2005-198668 | A | 7/2005 |
| JP | 2006-092140 | A | 4/2006 |
| JP | 2008-246061 | A | 10/2008 |
| JP | 4586474 | B2 | 11/2010 |
| TW | M335308 | U | 7/2008 |
| TW | M357307 | U | 5/2009 |
| TW | M359356 | U | 6/2009 |
| TW | I345476 | B | 7/2011 |
| WO | 87/00764 | A1 | 2/1987 |
| WO | 92/21413 | A1 | 12/1992 |
| WO | 95/28210 | A1 | 10/1995 |
| WO | 96/07153 | A1 | 3/1996 |
| WO | 97/10577 | A1 | 3/1997 |
| WO | 98/14249 | A1 | 4/1998 |
| WO | 98/40136 | A1 | 9/1998 |
| WO | 99/43404 | A1 | 9/1999 |
| WO | 99/52610 | A1 | 10/1999 |
| WO | 99/52611 | A1 | 10/1999 |
| WO | 00/51076 | A1 | 8/2000 |
| WO | 01/56670 | A1 | 8/2001 |
| WO | 02/05914 | A1 | 1/2002 |
| WO | 01/78854 | A3 | 2/2002 |
| WO | 2003/004116 | A1 | 1/2003 |
| WO | 2003/026763 | A1 | 4/2003 |
| WO | 2004/067889 | A1 | 8/2004 |
| WO | 2004/112923 | A1 | 12/2004 |
| WO | 2006/031472 | A2 | 3/2006 |
| WO | 2006/039308 | A2 | 4/2006 |
| WO | 2008/005286 | A2 | 1/2008 |
| WO | 2008/006023 | A2 | 1/2008 |
| WO | 2008/091809 | A2 | 7/2008 |
| WO | 2009/067758 | A1 | 6/2009 |
| WO | 2009/137541 | A2 | 11/2009 |
| WO | 2010/001032 | A1 | 1/2010 |
| WO | 2010/052573 | A2 | 5/2010 |
| WO | 2010/055328 | A1 | 5/2010 |
| WO | 2010/117446 | A1 | 10/2010 |
| WO | 2012/053074 | A1 | 4/2012 |

(56) References Cited

FOREIGN PATENT DOCUMENTS

| | | |
|---|---|---|
| WO | 2013/019677 A1 | 2/2013 |
| WO | 2016/058085 A9 | 5/2016 |

OTHER PUBLICATIONS

International Search Report for International Application No. PCT/US2007/022858, dated Apr. 18, 2008, 2 pages.
Lilwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, May 9, 2009, 4 pages.
Olsen, Eddie; Automatic Shuffler ready' for Atlantic City experiment; Blackjack Confidential; Jul./Aug. 1989; pp. 5-7.
PCT International Preliminary Examination Report for International Patent Application No. PCT/US02/31105 dated Jul. 28, 2004, 9 pages.
PCT International Search Report and Written Opinion for International Application No. PCT/US2007/023168, dated Sep. 12, 2008, 8 pages.
PCT International Search Report and Written Opinion for International Patent Application No. PCT/US2006/22911, dated May 9, 2007, 6 pages.
PCT International Search Report and Written Opinion for PCT/US07/15035, dated Sep. 29, 2008, 3 pages.
PCT International Search Report and Written Opinion for PCT/US07/15036, dated Sep. 23, 2008, 3 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US505/31400, dated Sep. 25, 2007, 12 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.
PCT International Search Report and Written Opinion of the International Searching Authority for PCT/US2008/007069, dated Sep. 8, 2008, 10 pages.
PCT International Search Report and Written Opinion of the International Searching Authority for PCT/US2010/001032, dated Jun. 16, 2010, 11 pages.
PCT International Search Report and Written Opinion, PCT Application No. PCT/US2013/062391, dated Dec. 17, 2013 13 pages.
PCT International Search Report and Written Opinion, PCT Application No. PCT/US2015/022158, dated Jun. 17, 2015, 13 pages.
PCT International Search Report and Written Opinion, PCT Application No. PCT/US2015/025420, dated Oct. 2, 2015, 15 pages.
PCT International Search Report and Written Opinion, PCT Application No. PCT/US2015/040196, dated Jan. 15, 2016, 20 pages.
PCT International Search Report and Written Opinion, PCT Application No. PCT/US2015/051038, dated Jan. 22, 2016, 11 pages.
PCT International Search Report and Written Opinion, PCT/US12/48706, dated Oct. 16, 2012, 12 pages.
PCT International Search Report for PCT/US2005/034737 dated Apr. 7, 2006.
PCT International Search Report for PCT/US2007/022894, dated Jun. 11, 2008, 2 pages.
Philippines Patent Application Formality Examination Report—Philippines Patent Application No. 1-2006-000302, dated Jun. 13, 2006.
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Prototype Glossary and Timelines; *Shuffle Tech International* v. *Scientific Games Corp*., et al. 1:15-cv-3702 (N.D. III.); undated; pp. 1-4.
Scarne's Encyclopedia of Games by John Scarne, 1973, "Super Contract Bridge", p. 153.
Service Manual/User Manual for Single Deck Shuthers: BG1, BG2 and BG3 by Shuffle Master .COPYRGT. 1996.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master Gaming, Service Manual, ACETM Single Deck Card Shuffler, (1998), 63 pages.
Shuffle Master Gaming, Service Manual, Let It Ride Bonus (Register) With Universal Keypad, 112 pages, (Copyright) 2000 Shuffle Master, Inc.
Shuffle Master's Reply Memorandum in Support of Shuffle Master's Motion for Preliminary Injunction for *Shuffle Master, Inc.* vs. *VendingDala Corporation*, in the U.S. District Court, District of Nevada, No. CV-S-04-1373-JCM-LRL, Nov. 29, 2004.
Shuffle Master, Inc. (1996) Let It Ride, the Tournament, User Guide, 72 pages.
*Shuffle Tech International LLC et al.* vs. *Scientific Games Corporation et al*., Order Denying Motion for Summary Judgement: Memorandum Opinion and Order, in the U.S. District Court, for the Northern District of Illinois Eastern Division, No. 15 C 3702, Sep. 1, 2017, 35 pages.
Shufflers—SHFL entertainment, Gaming Concepts Group, (2012), 6 pages.
Singapore Patent Application Examination Report—Singapore Patent Application No. SE 2008 01914 A, Jun. 18, 2008 3 pages.
Solberg, Halvard; Deposition; *Shuffle Tech International* v. *Scientific Games Corp., et al.* 1:15-cv-3702 (N.D. III.); Oct. 18, 2016; pp. 187, 224-246, 326-330, 338-339, 396; Baytowne Reporting; Panama City, FL.
Statement of Relevance of Cited References, Submitted as Part of a Third-Party Submission Under 37 CFR 1.290 on Dec. 7, 2012 (12 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
TAG Archives: Shuffle Machine, Gee Wiz Online, (Mar. 25, 2013), 4 pages.
Tracking the Tables, by Jack Bularsky, Casino Journal, May 2004, vol. 17, No. 5, pp. 44-47.
U.S. Patent Application filed Nov. 30, 2016, titled "CARD Handling Devices and Related Assemblies and Components", to Nelsen et al., 62 pages., U.S. Appl. No. 15/365,610.
U.S. Patent Application filed Sep. 26, 2016, tilled "Devices, Systems, and Related Methods for Real-Time Monitoring and Display of Related Data for Casino Gaming Devices", to Nagaragatta et al., 36 pages., U.S. Appl. No. 15/276,476.
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData :;orporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injectionfor *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, in the U.S. District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.

(56) References Cited

OTHER PUBLICATIONS

1/3 B/W CCD Camera Module EB100 by EverFocus Electronics Corp., Jul. 31, 2001, 3 pgs.
ACE, Single Deck Shuffler, Shuffle Master, Inc., (2005), 2 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Tille: Card Handling Apparatus, 13 pages.
Automatic casino card shuffle, Alibaba.com, (last visited Jul. 22, 2014), 2 pages.
Bally Systems Catalogue, Ballytech.com/systems, 2012, 13 pages.
Canadian Office Action for CA 2,580,309 dated Mar. 20, 2012 (6 pages).
Canadian Office Action for Canadian Application No. 2,461,726, dated Dec. 11, 2013, 3 pages.
Canadian Office Action for Canadian Application No. 2,461,726, dated Jul. 19, 2010, 3 pages.
Christos Stergiou and Dimitrios Siganos, "Neural Networks," http://www.doc.ic.ac.uk~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 18 of 23 color copies from Binder 1).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 19 of 23 color copies from Binder 3).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 20 of 23 color copies from Binder 4).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 21 of 23 color copies from Binder 6).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 22 of 23 color copies from Binder 8, part 1 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
Documents submitted in the case of *Shuffle Master, Inc.* v. *6Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
DVD Labeled "Exhibit 1". This is a DVD taken by Shuffle Master personnel of the live operation of a CARD One2Six.(Trademark). Shuffler (Oct. 7, 2003).
DVD Labeled "Luciano Deel. Ex. K". This DVD includes the video taped live Declaration of Mr. Luciano taken during preparation of litigation (Oct. 23, 2003).
DVD Labeled "Morrill Deel. Ex. A". This DVD includes the video taped live Declaration of Mr. Robert Morrill, a lead trial counsel for the defense, taken during preparation for litigation. He is describing the operation of the Rohiejo Prototype device, (Jan. 15, 2004).
DVD labeled Solberg Decl.Ex.C, which is not a video at all, is (see Binder 4-1, p. 34/206, Solberg Deck, para.8): Computer source code for operating a computer-controlled card shuffler (an early Roblejo prototype card shuffler) and Descriptive comments of how the code works. DVD sent to Examiner by US Postal Service with copy of this PTO/SB/08 form.
Error Back propagation, http://willamette.edu~gorr/classes/cs449/backprop.htm1(4 pages), Nov. 13, 2008.
European Examination Report for European Application No. 02780410, dated Aug. 9, 2011, 4 pages.
European Patent Application Search Report—European Patent Application No. 06772987.1, dated Dec. 10, 2009, 5 pages.
European Search Report for European Application No. 12152303, dated Apr. 16, 2012, 3 pages.
Genevieve Orr, CS-449: Neural Networks Willamette University, http://www.willamette.edu/-gorr/classes/cs449/intro.html (4 pages), Fall 1999.
Gola, Steve; Deposition; *Shuffle Tech International* v. *Scientific Games Corp.*, et al. 1:15-cv-3702 (N.D. III.); Oct. 13, 2016; pp. 1, 9-21, 30-69, 150-167, 186-188, 228-231, 290-315,441; Henderson Legal Services, Inc.; Washington, DC.

(56) References Cited

OTHER PUBLICATIONS

Google search for card handling device with storage area, card removing system pivoting arm and processor . , http://www.google.com/?tbm=pts&h1=en; Jul. 28, 2012.
Gros, Roger; New Card Management System to Be Tested At Baily's Park Place; Casino Journal; Apr. 1989; 5 pages.
hittp://www.google.com/search?tbm=pts&q=shuffling+zone+onOopposite+site+of- +input+. . . Jul. 18, 2012.
http://www.google.com/search?tbm=pts&q=Card+handling+device+with+input+and- +outpu . . . , Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
i-Deal, Bally Technologies, Inc., (2014), 2 pages.

* cited by examiner

METHOD FOR SHUFFLING AND DEALING CARDS

CROSS-REFERENCE TO RELATED APPLICATIONS

This application is a divisional of U.S. patent application Ser. No. 15/360,598, filed Nov. 23, 2016, which is a continuation of U.S. patent application Ser. No. 14/500,286, filed Sep. 29, 2014, now U.S. Pat. No. 9,713,761, issued Jul. 25, 2017, which is a continuation of U.S. patent application Ser. No. 13/942,551, filed Jul. 15, 2013, now U.S. Pat. No. 8,844,930, issued Sep. 30, 2014, which is a divisional of U.S. patent application Ser. No. 13/560,826, filed Jul. 27, 2012, now U.S. Pat. No. 8,485,527, issued Jul. 16, 2013, which is a continuation-in-part of U.S. patent application Ser. No. 13/194,652, filed Jul. 29, 2011, now U.S. Pat. No. 8,342,526, issued Jan. 1, 2013, the disclosure of each of which is hereby incorporated herein in its entirety by this reference.

BACKGROUND OF THE INVENTION

The present application relates to structure and use of mechanical card shufflers.

Mechanical shufflers have been known for over 100 years. Some mechanical shufflers in recent years have had a capability of dispensing two or more cards together as a hand for each of several players including the dealer.

Card games played in casinos utilize one or more decks of cards, with each deck usually consisting of 52 to 54 cards. For certain games, specialized decks of fewer cards or decks including one or two jokers in addition to the normal 52 are used. Other card games require cards to be dealt to players from as many as six or eight ordinary decks shuffled together as one combined, large, random group of cards at the beginning of play.

New decks of cards are normally delivered to a gaming table in a sequential arrangement in order of suit and rank, but the cards must be shuffled before beginning play so that they are in a random arrangement unknown to any of the players.

Various mechanisms have been designed for placing cards from a deck into a different, shuffled, order for use in play, sometimes by using a random number generator to define a random order of cards for a "shuffled" deck and then using a computer controlled mechanism to identify each card in a deck being shuffled and to place each card in its designated space.

Casinos prefer to use mechanical shufflers instead of having dealers manually shuffle the cards for several reasons: a major reason is to save time otherwise spent on shuffling, since the earnings of a casino depend upon the number of hands that can be played during a gaming session. Another reason is to be able to avoid or detect cheating. Partly for that reason, it is also desirable to be able to review the order in which cards have been dealt, and some available mechanical shufflers have the capacity to determine the order of cards in a shuffled deck and retain it in a computer memory. Known mechanical shufflers, however, have suffered from several shortcomings, such as simply being slower than desired, or being so large that they impede a supervisor's view of the game table or players' hands, or impede a casino security system surveillance camera's field of view. Other mechanical shufflers frequently jam and thus fail to provide a shuffled deck ready for use in play without a delay while the shuffler is cleared and a complete deck is then shuffled. Casinos frequently replace the decks of cards in play, but nervous or careless players may bend cards, or spill drinks, making cards likely to stick together, leading to some shuffler jamming.

What is desired, then, is an easily operated, dependable, and efficient shuffler able to handle playing cards that have been bent or that tend to stick to one another, and that is small enough not to require a specially built table or complex installation of the shuffler for it to be reliably usable in a casino situation, and a shuffler able to present shuffled cards either as a complete shuffled deck or as hands of a desired number of cards for each player or the dealer. It is also desired for such a shuffle to have the ability to shuffle multiple decks of cards and make them available for play quickly enough that it is unnecessary to utilize a "multi batch" system of shuffling and dealing.

SUMMARY OF THE INVENTION

Disclosed herein is a mechanical shuffler that in one embodiment includes a programmable computer-controlled mechanism for placing each card of a deck to be shuffled into a randomly selected one of a remaining plurality of empty receptacles in a dealing rack portion of the mechanism and in which cards can be removed from the dealing rack either as a complete shuffled deck or in a predetermined lesser number of cards as a player's or dealer's hand, or a predetermined number of cards or single cards for use in any stage of play of a game.

In one embodiment of the mechanism disclosed herein, a card shuffler includes a dealing rack defining a plurality of single-card receptacles; a deck-crib capable of containing a plurality of cards and located adjacent to and aligned with the dealing rack; a card moving mechanism associated with the deck-crib and operable to move a series of cards individually from the deck-crib to a selected one of the single-card receptacles; a motor arranged to move the dealing rack relative to the deck-crib so as to move a selected one of the single-card receptacles into a position of alignment with the card mover; and a controller arranged to select at random one of the plurality of empty receptacles in the dealing rack and to cause the motor to move the dealing rack to place the randomly selected receptacle into a position of alignment with the card moving mechanism.

In one embodiment of the shuffler, the controller may be programmed to move the dealing rack to a position presenting all of the cards in the dealing rack where they can be removed simultaneously as a shuffled complete deck of playing cards.

In one embodiment of the shuffler, the controller may be programmed to present a hand consisting of one or more cards in a position where they can be removed individually or simultaneously from the dealing rack to be dealt to a player or dealer.

In one embodiment, the shuffler may include a card reader capable of identifying each card as it is moved or about to be moved from the deck-crib to the dealing rack, and the controller may be programmed to record in digital computer memory the location of the particular single-card receptacle in the dealing rack to which each identified card is moved from the deck-crib.

In one embodiment, the shuffler can be used to shuffle two to eight ordinary decks of cards. In one embodiment, the shuffler has a moving deck-crib, used to place cards into randomly selected single-card receptacles in a horizontally oriented stationary dealing rack.

The present application also discloses a method of shuffling a large number of cards in incremental, sequentially shuffled small groups of cards that have been played from a large shuffled group of cards.

The foregoing and other features and advantages of the invention will be more readily understood upon consideration of the following detailed description of the invention taken in conjunction with the accompanying drawings.

DETAILED DESCRIPTION OF PREFERRED EMBODIMENTS

An embodiment of a card handling device, called a shuffler 10 herein for the sake of convenience, is shown in FIGS. 1-5 as designed to be a single deck shuffler for use in Blackjack, Poker, and "novelty" or non-traditional, games such as Pai Gow Poker, THREE CARD POKER®, CARIBBEAN STUD®, and many others. The shuffler 10 can be modified to handle multiple decks of cards for other games and formats, as described below under Multi-Deck Embodiment.

Figure 1:
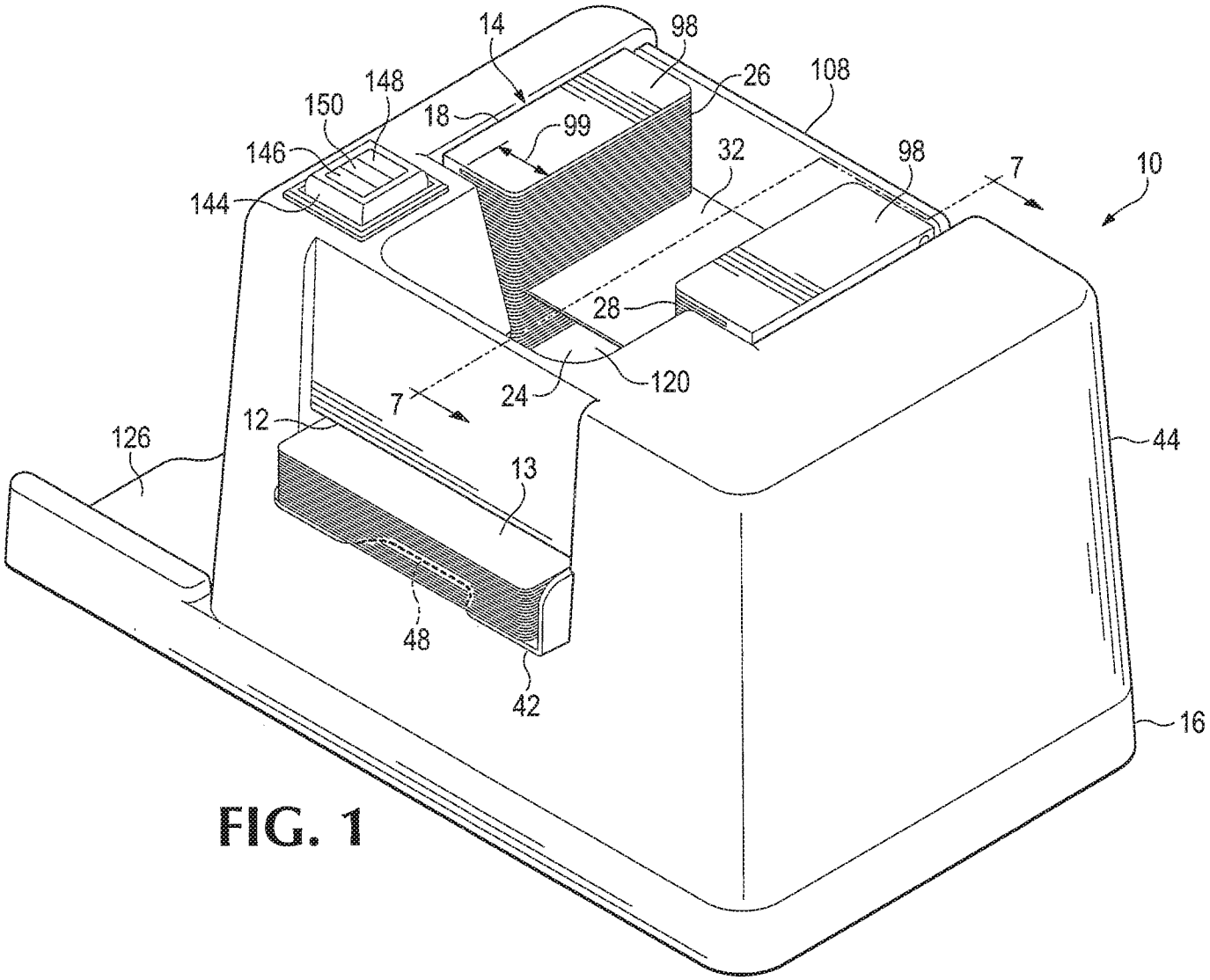
FIG. 1 is an isometric view of a playing card handling device, or shuffler, which is an embodiment of at least one aspect of the present invention, shown with a deck of cards beginning to be shuffled and as seen from above the left end corner of the rear side of the device.

The shuffler 10 has two main components, a deck-crib 12 and a dealing rack assembly 14, that operate together and are associated with a base 16. The deck-crib 12 is the starting position for each deck or group of cards to be shuffled and secures the unshuffled ones of the cards face down in a stack (or deck) 13 during the shuffling process. The dealing rack 14 receives all the cards as they are shuffled and holds them until they are presented to be dealt, either as an entire deck or as hands for individual players, or until they are removed to be reshuffled. The dealing rack 14 may, then, also be called a receiving rack. The dealing rack assembly 14 may include a frame 18 with a pair of upstanding opposite end members 20 and 22 interconnected by a horizontal bottom 24. Extending from each end member 20 and 22 toward the other are respective sets of thin partial shelves 26 and 28 defining a set of, for example, 54 or 55 receptacles 30 to receive a deck of 52 shuffled cards 32, as well as, optionally, a cut card and one or two jokers. (The shuffler 10 will be discussed from this point on as if only 52 cards are being shuffled.) Both long sides of the dealing rack 14 are open, as may be seen in FIGS. 1-4, leaving a card removal gap 33 shown in FIGS. 4 and 6 between the left shelves 26 and right shelves 28 to facilitate card removal. The middle portions of the backs of shuffled cards 32 may be seen in the gap 33 as the dealing rack 14 moves during the process of shuffling as shown in FIG. 1, and the shuffled cards 32 are in view after the process of shuffling has been completed. The dealing rack 14 is easily accessible from the top of the shuffler 10, through an opening in its body cover 44, as may be seen in FIGS. 1 and 2.

Figure 3:
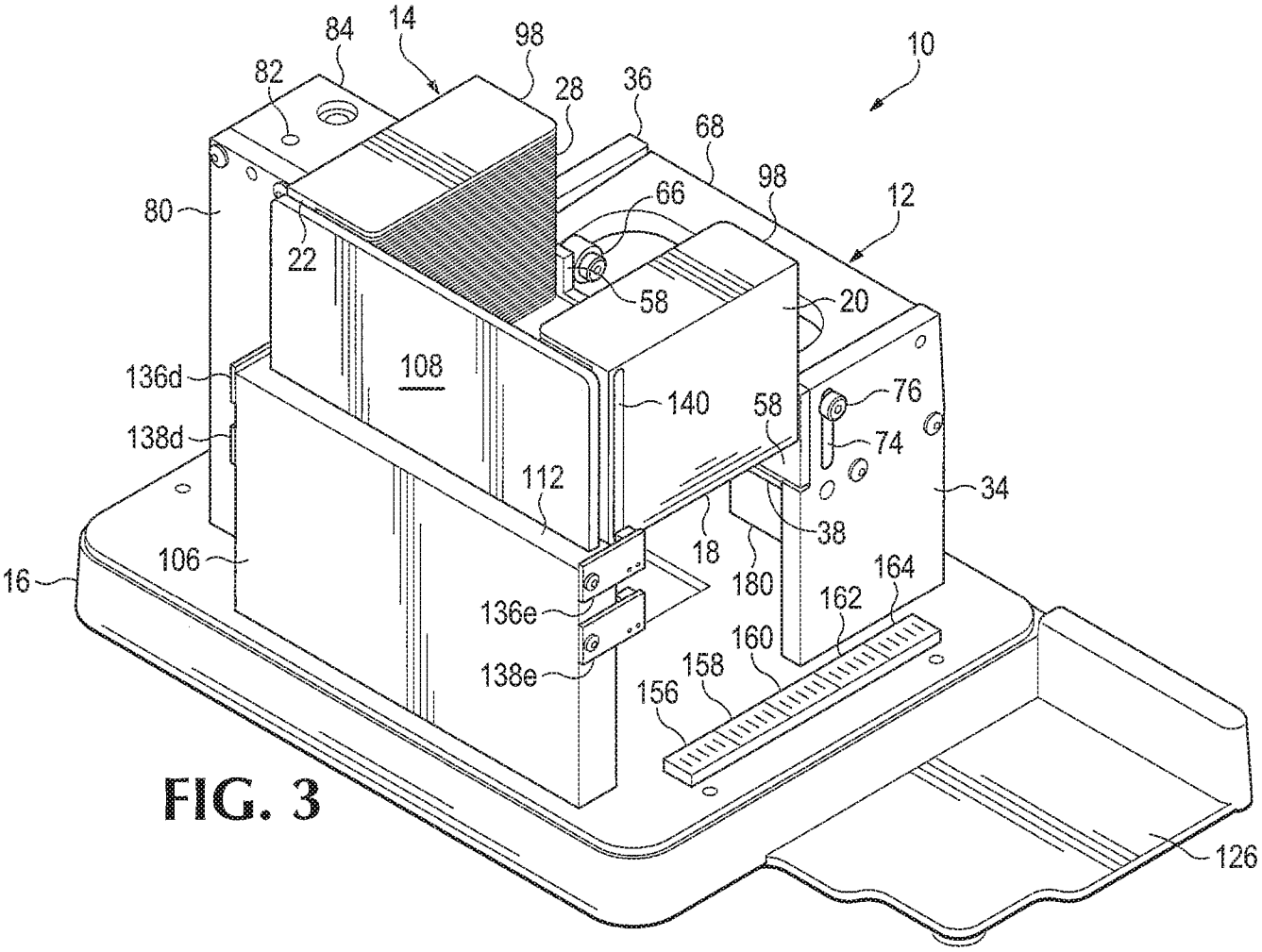
FIG. 3 is an isometric view taken from the upper right front of the shuffler shown in FIGS. 1 and 2, with its cover removed so that some of the operative components of the shuffler are in view.
Figure 4:
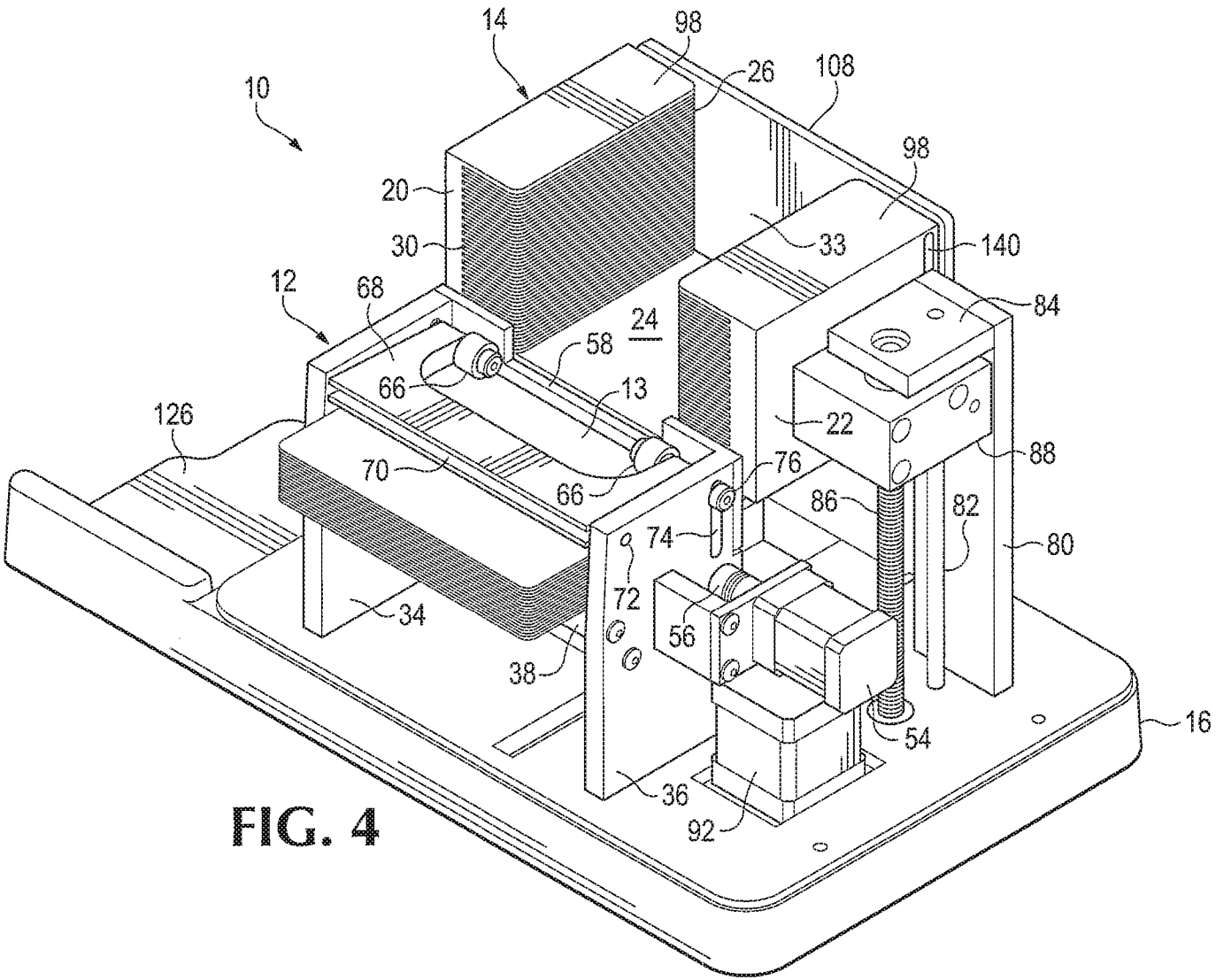
FIG. 4 is a view of the shuffler shown in FIGS. 1-3, from the upper left rear, with the cover removed and a deck in position in the deck-crib portion of the shuffler.
Figure 5:
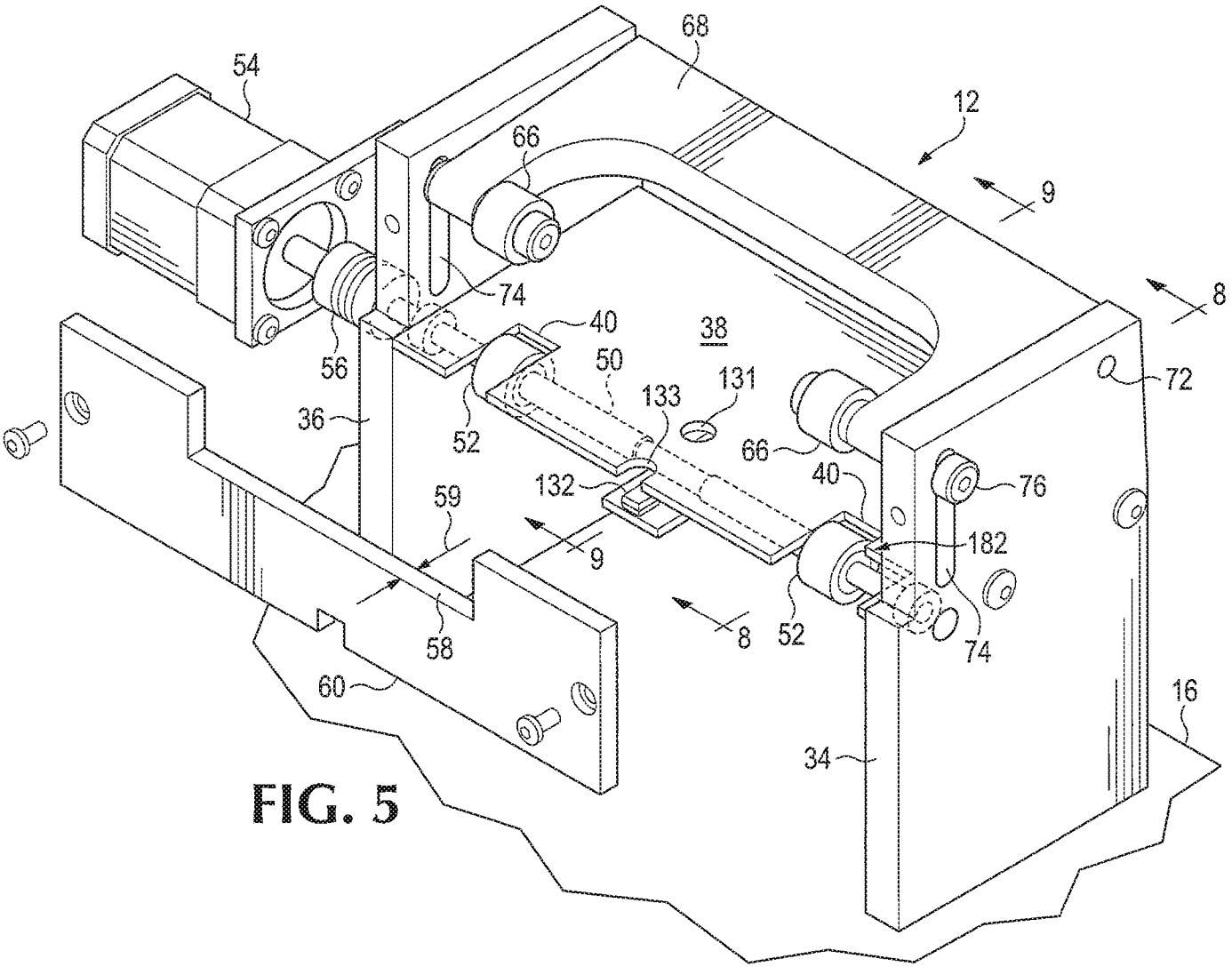
FIG. 5 is an isometric partially exploded view of the deck-crib and card mover portions of the shuffler shown in FIGS. 1-4, taken from the upper right front.
Figure 7:
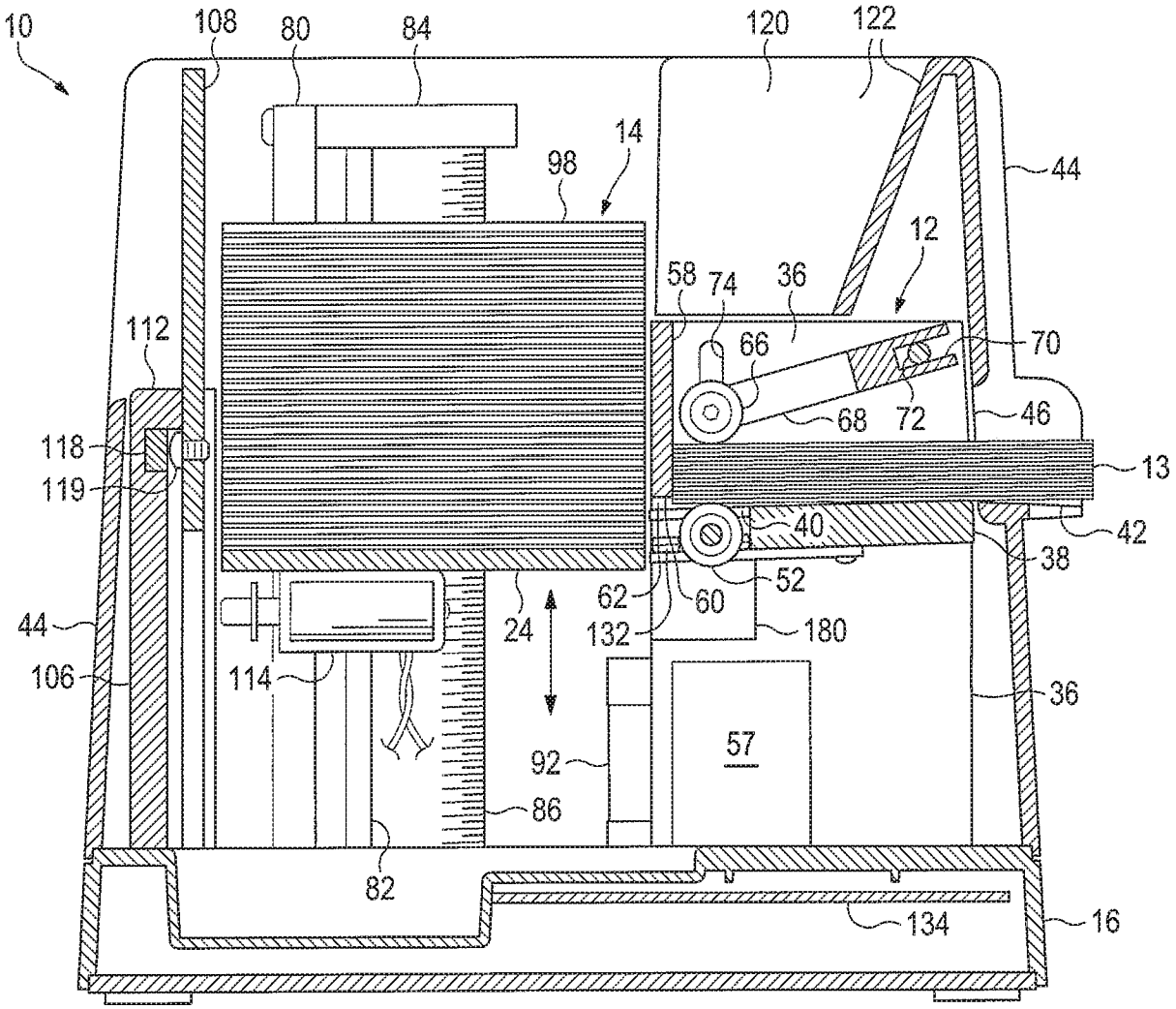
FIG. 7 is a sectional view of the shuffler shown in FIGS. 1-5 taken on line 7-7 in FIG. 1, with the shuffler about to begin shuffling a deck of cards held in the deck-crib.

The deck-crib 12 and dealing rack 14 are closely aligned alongside each other, separated, for example, by a small distance 35 (FIG. 8) preferably in the range of 0.020 to 0.090 inch, or of about 0.040 inch in one embodiment, although a distance 35 as great as 0.25 inch may be generally satisfactory. As shown in FIG. 3, the deck-crib 12 is a stationary component, supported on the base 16 by a pair of parallel upright members 34 and 36 that also act as ends of the deck-crib 12. The deck-crib 12 includes a bottom member 38 defining a pair of openings 40, as shown in FIGS. 5 and 7.

A small shelf 42 may extend outward as a part of the body shell or cover 44 of the shuffler 10, adjacent the bottom member 38 of the deck-crib 12, to receive and support a deck or stack 13 of cards placed into the deck-crib 12 through an opening 46 defined by the outer body or cover 44. The shelf 42 may be located level with the bottom member 38 of the deck-crib 12 and protects and hides the identity of the lowermost card of the stack 13 during the shuffle, while keeping part of the deck visible at all times through the opening 46, as shown in FIGS. 1 and 7. A finger notch 48 may be provided in the shelf 42 to allow for easy removal of the deck 13 if required.

Figure 8:
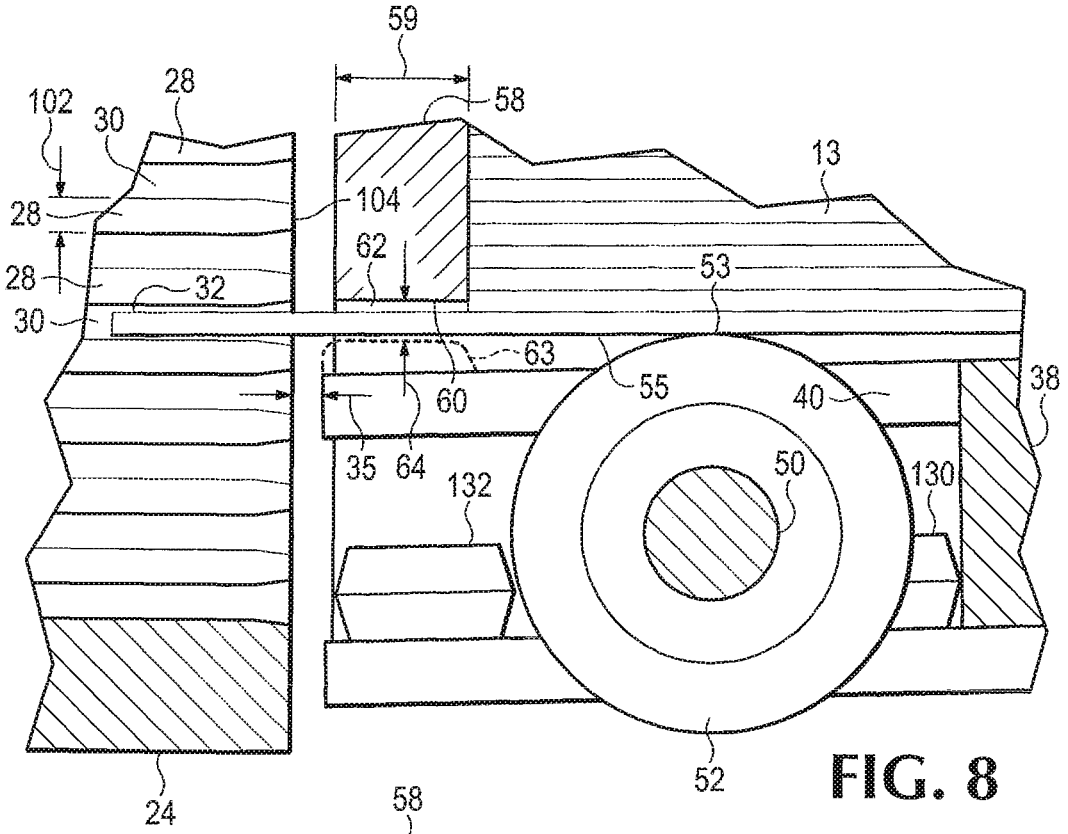
FIG. 8 is a sectional view, at an enlarged scale, of portions of the deck-crib and the dealing rack, taken on line 8-8 in FIG. 5.
Figure 9:
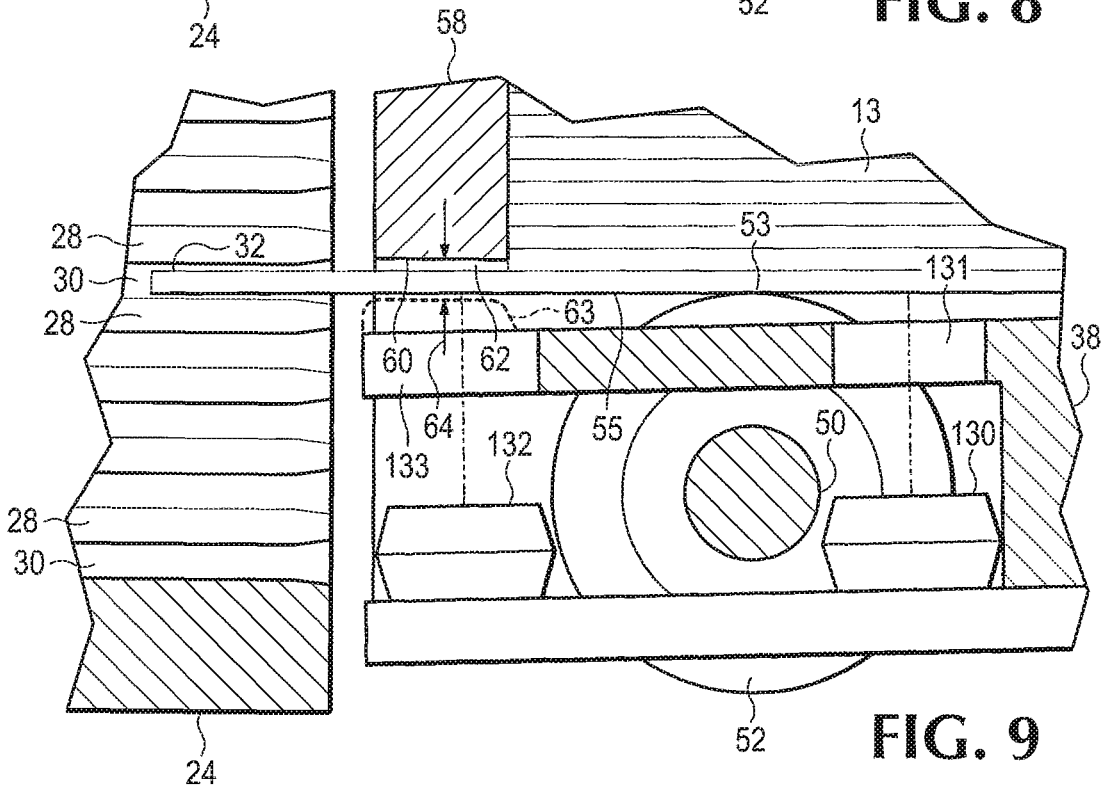
FIG. 9 is a sectional view at an enlarged scale of the deck-crib and the dealing rack, taken on line 9-9 in FIG. 5.

A card mover mechanism associated with the deck-crib 12 includes a drive shaft 50 carried in suitable bearings mounted adjacent to the uprights 34 and 36, beneath the bottom member 38 of the deck-crib 12, and a pair of drive rollers 52 are mounted on the drive shaft 50 for rotation therewith. As shown in FIGS. 8 and 9, the drive rollers 52 are aligned with the openings 40 in the bottom member 38 so as to protrude slightly, such as about 0.030 inch radially above the top surface of the bottom member 38, and thus have an upper surface 53, a part of the drive roller 52 above the bottom member 38 in position to engage the bottom surface 55 of the bottom or last card 32 of the unshuffled stack 13. This relationship is shown somewhat exaggerated in FIGS. 7-11. The drive rollers 52 should have a high-friction surface that may be of a material such as a rubber-like plastic, such as a urethane of 55A durometer hardness, or a suitable silicone rubber.

The drive rollers 52 are positioned under the long edge of the cards closest to the dealing rack 14, so as to propel the bottom or last card of the unshuffled stack 13 into one of the receptacles 30 of the dealing rack 14.

Figure 13:
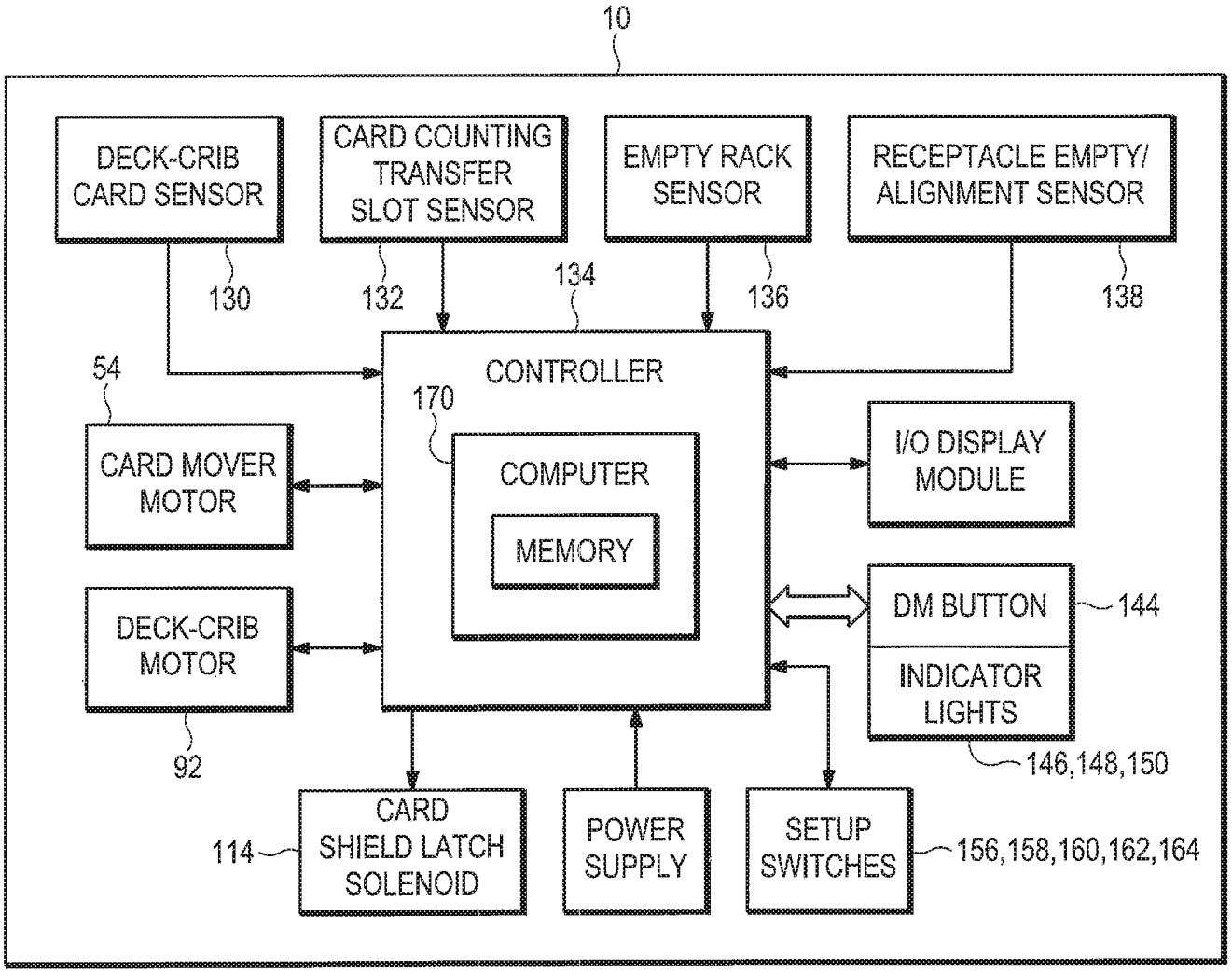
FIG. 13 is a simplified diagram of an arrangement of electrical components of the shuffler shown in FIG. 1.

The drive shaft 50 is driven by a motor 54, which may be a two-phase stepper motor, and which may be coupled to the card mover drive shaft 50 by a suitable coupling 56. A power supply 57 may be located on the base 16 beneath the deck-crib 12, as may be seen in FIGS. 7, 10 and 11. By incorporating a suitable battery power supply the shuffler 10 may be made in a portable version (not shown). A simplified diagram of the electrical and electronic arrangement of the shuffler 10 is shown in FIG. 13.

An upstanding card stop 58, a vertical partial wall, seen most clearly in FIG. 5, extends upward above the bottom member 38 as an inner wall of the deck-crib 12 and separates the deck-crib 12 from the dealing rack 14. The card stop wall 58 may have a thickness 59 in the range of, for example, 0.08-0.2 inch, if made of a plastic resin, or less if of metal, and has a lower edge surface or margin 60 that is located at a predetermined distance above the upper surfaces 53 of the drive rollers 52, as shown in FIGS. 8 and 9. The card stop wall 58 thus defines an upper side of an outfeed or card transfer slot 62 large enough for a single card from the deck 13 to pass through from deck-crib 12 to dealing rack 14, but small enough, that is, with the lower margin 60 located close enough to the upper surfaces 53 of the drive rollers 52, to prevent more than one card from the deck 13 from passing through the slot 62 at one time. For example, for a deck of ordinary cards each having a thickness of 0.012 inch the effective opening or gap height 64 of the slot 62 should be about 0.018-0.023 inch above the top surfaces 53 of the drive rollers 52, thus allowing a single card to pass through the slot 62, even if it had originally been slightly bent, but preventing two cards from passing through together. A ramp or lip 63 may be provided, as shown in broken line, at the end of the bottom member 38, beneath the margin 60 of the card stop wall 58 to establish a bottom of the slot 62. Each time an empty single-card receptacle 30 is lined up with the bottom card of the unshuffled stack 13, the drive rollers 52 impart just enough velocity to propel a card from the stack 13 all the way through the slot 62 into the aligned receptacle 30. The drive rollers 52 may then immediately reverse briefly to hold the next bottom card in place in the stack 13 until the dealing rack 14 is moved and another randomly selected receptacle 30 is lined up with the slot 62.

Alternatively, the drive rollers 52 may not need to propel the bottom card of the unshuffled stack 13 all the way into the receptacle 30, but just far enough to clear the drive rollers 52 and the stack 13, and then the next bottom card from the stack 13 would be moved a short distance by the drive rollers 52 to push the uncleared previous card all the way into the receptacle 30. Thus, for this embodiment of the shuffler 10, the complete action of the drive rollers 52 would start with a forward spin to propel the card, a short reverse to square-up the stack 13, a short spin forward, moving the next card a short distance to push the previous card all the way into the receptacle 30, and a final short reverse, after which the dealing rack 14 can freely move to present the next selected empty receptacle 30 to receive a card.

In order to keep the cards of a deck or stack 13 in the deck-crib 12 flat and close together, a deck follower including two idler rollers 66 applies constant pressure to the top of the stack 13 ensuring that each card remains flat as it is propelled into an empty receptacle 30, even if severely warped. Due to the closeness of the deck-crib 12 to the dealing rack 14, there is not enough room or chance for a card to flex, as it is moving from a forced flat plane and immediately into an empty receptacle 30. The pair of idler rollers 66 may be supported by suitable bearings carried on an idler arm 68 (FIG. 10) of an appropriate weight. The idler arm 68 may have a deep groove 70 defined in an upper, outer, margin, and a pivot rod 72 may be received in the groove 70, so that the idler arm 68 is free to pivot and translate about the pivot rod 72. The pivot rod 72 may be mounted parallel with the bottom member 38 and the card stop wall 58, with its ends in corresponding holes defined in the uprights 34 and 36. The uprights 34 and 36 may define respective slots 74, and suitable pins such as screws 76 may extend through the slots 74 into the idler arm 68. The slots 74 thus guide the idler arm 68 downwardly along the card stop wall 58 to keep the idler rollers 66 in contact with the uppermost card of a stack 13 in the deck-crib 12. The idler rollers 66 may be located in alignment with the openings 40 and the drive rollers 52 so as to keep the cards of the stack 13 in contact with the drive rollers 52.

The dealing rack assembly 14, shown in FIGS. 1-6 and in section view in FIG. 7, is located adjacent to the deck-crib 12, with the opposite ends 20 and 22 of the frame 18 of the dealing rack 14 aligned with the uprights 34 and 36 of the deck-crib 12, so that a card from the stack 13 may be moved through the slot 62 beneath the card stop wall 58 into one of the receptacles 30 defined by aligned corresponding ones of the left and right shelves 26 and 28.

The dealing rack 14 is moved up and down by stepper motor technology, within a range defined by a lift tower 80 mounted on the base 16. The lift tower 80 supports a guide rod 82 extending from the base 16 upward to a pillow block 84 mounted at the top of the lift tower 80, as may be seen in FIGS. 6 and 7. A lead screw 86 is supported in suitable bearings mounted in the base 16 and in the pillow block 84 and extends parallel with the guide rod 82 through a carrier lift block 88 including a lead screw nut 90. The carrier lift block 88 is securely fastened to the end member 22 of the dealing rack 14 and is guided along the guide rod 82 by suitable bearings, so that movement of the lead screw 86 in the lead screw nut 90 causes the dealing rack 14 to rise or descend along the guide rod 82. A suitable stepper motor 92 mounted on the base 16 as shown in FIGS. 4, 10, 11, and 12 is connected drivingly with the lead screw 86, as by a suitable endless belt 94 and pulleys 96 in the bottom part of the base 16.

The dealing rack 14 may include, in the embodiment illustrated, intended for shuffling an ordinary deck of 52 ordinary playing cards and possibly one or two jokers or a cut card, 55 left shelves 26 and 55 right shelves 28, establishing 55 receptacles 30 each capable of receiving and holding a single card. For the sake of clarity, fewer shelves 26 and 28 are shown in the drawings, so that shuffled cards 32 can be shown more clearly in some of the receptacles 30 in the drawings. A protective upper member 98 may extend from each of the ends 20 and 22 toward the opposite end, above the respective shelves 26 and 28. Each shelf 26 and 28 extends longitudinally with respect to a card and the bottom 24 of the dealing rack 14, toward the opposite end member 20 or 22 with a length 99 of, for example, about 0.5 inch. This length 99 is enough to ensure that even a warped card can be received and will lie flat in any of the receptacles 30 between respective shelves 26 and 28. Since each shuffled card 32 is held in a separate receptacle 30, a moist card is less likely to contaminate other cards so that a deck of cards may be used longer before it is replaced. Each shelf 26 and 28 may be constructed with a minimum thickness, in order that the height of the entire dealing rack 14 be kept to a minimum, so that an entire deck of shuffled cards 32 may be removed easily by a dealer. Thus, for example, each shelf 26 or 28 may have a thickness 102 of about 0.018 inch, for example, as required for ample strength according to the material of which the dealing rack 14 is constructed.

It is desirable that the dealing rack 14 be constructed of a material that is of low density, in order to minimize the mass, which has to be raised and lowered during operation of the shuffler 10. The dealing rack 14 may, for example, be of aluminum such as a 7075-T6 aluminum alloy, machined to form individual card receptacles 30. It will be apparent that other materials could also be used. For example, the bottom 24 may be of aluminum while the ends 20 and 22 and the shelves 26 and 28 may be constructed of a strong plastics resin having a low coefficient of friction and which is resilient enough to withstand pressures encountered as a dealer grasps and removes a deck of shuffled cards 32. For example, a suitable material that can be molded and machined to satisfactory tolerances is a polyoxymethylene resin available from du Pont de Nemours and Company under the tradename DELRIN®. As another option, the dealing rack 14 may be constructed as an assembly with the shelves 26 and 28 fashioned separately and attached to the frame 18. For example, a laminate of alternating spacers and shelves 26 or 28 may be fitted on alignment posts (not shown) and fastened to the bottom 24.

Desirably the separation between successive ones of the shelves 26 or 28 will be about equal to the gap height 64 of the slot 62, in the range of at least 0.014 inch to less than 0.024 inch, or about 0.018 inch, thus greater than the thickness of an individual playing card, and less than twice the thickness of an individual playing card, but no less than the gap height 64 of the slot 62. To facilitate receipt of a card in a receptacle 30, an edge 104 of each shelf 26, 28 nearest to the deck-crib 12 may be rounded or tapered as shown in FIG. 8 to lead a card into the receptacle 30. Based on the above measurements, the total height of the dealing rack 14 may be only about 2 inches, easily small enough to allow a dealer to remove an entire shuffled single deck of playing cards from the dealing rack 14.

Figure 6:
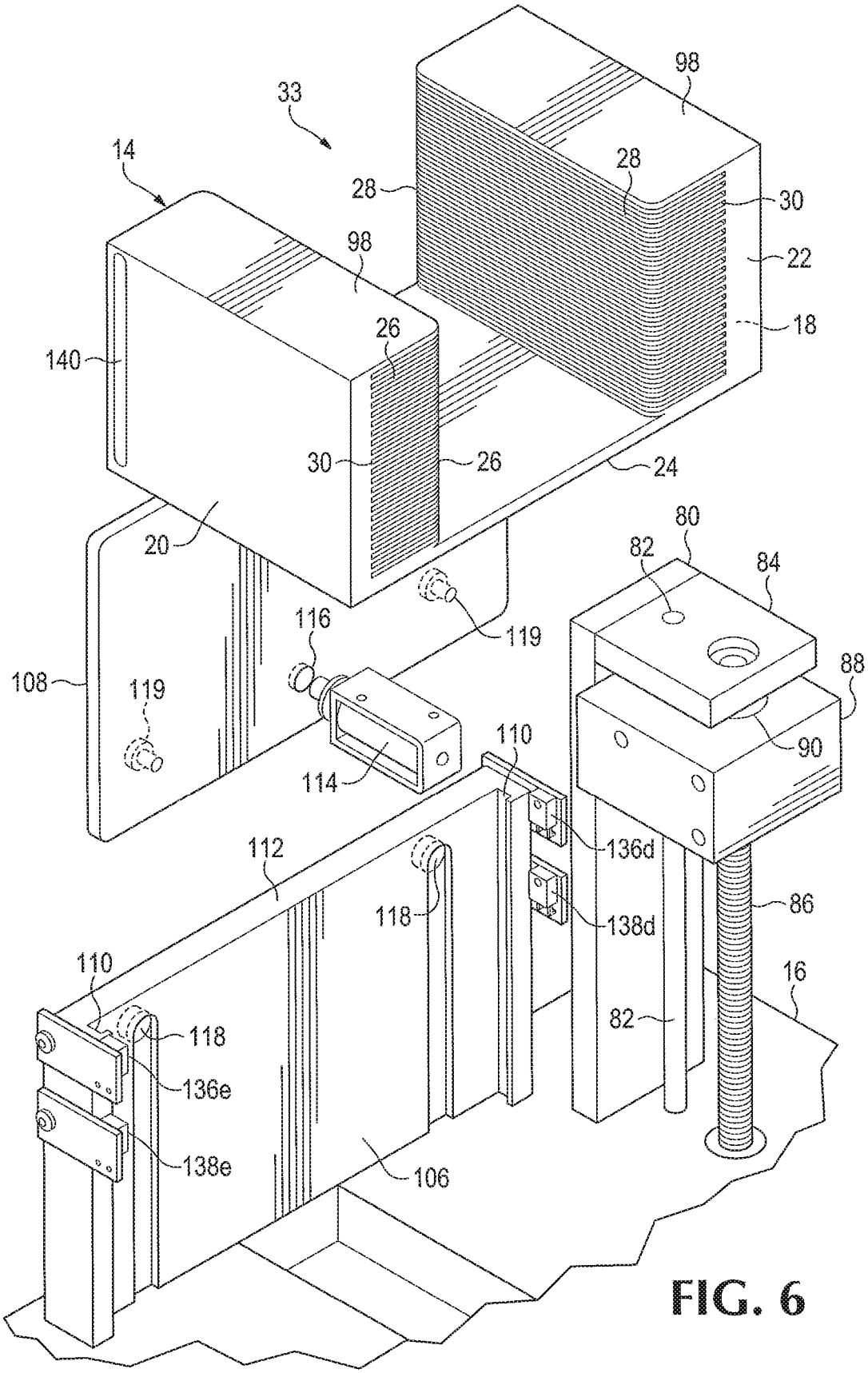
FIG. 6 is an isometric partially exploded view of portions of the shuffler shown in FIGS. 1-5, including the dealing rack, an associated blocking wall, and a card shield mechanism, taken from the upper right rear, at an enlarged scale.
Figure 10:
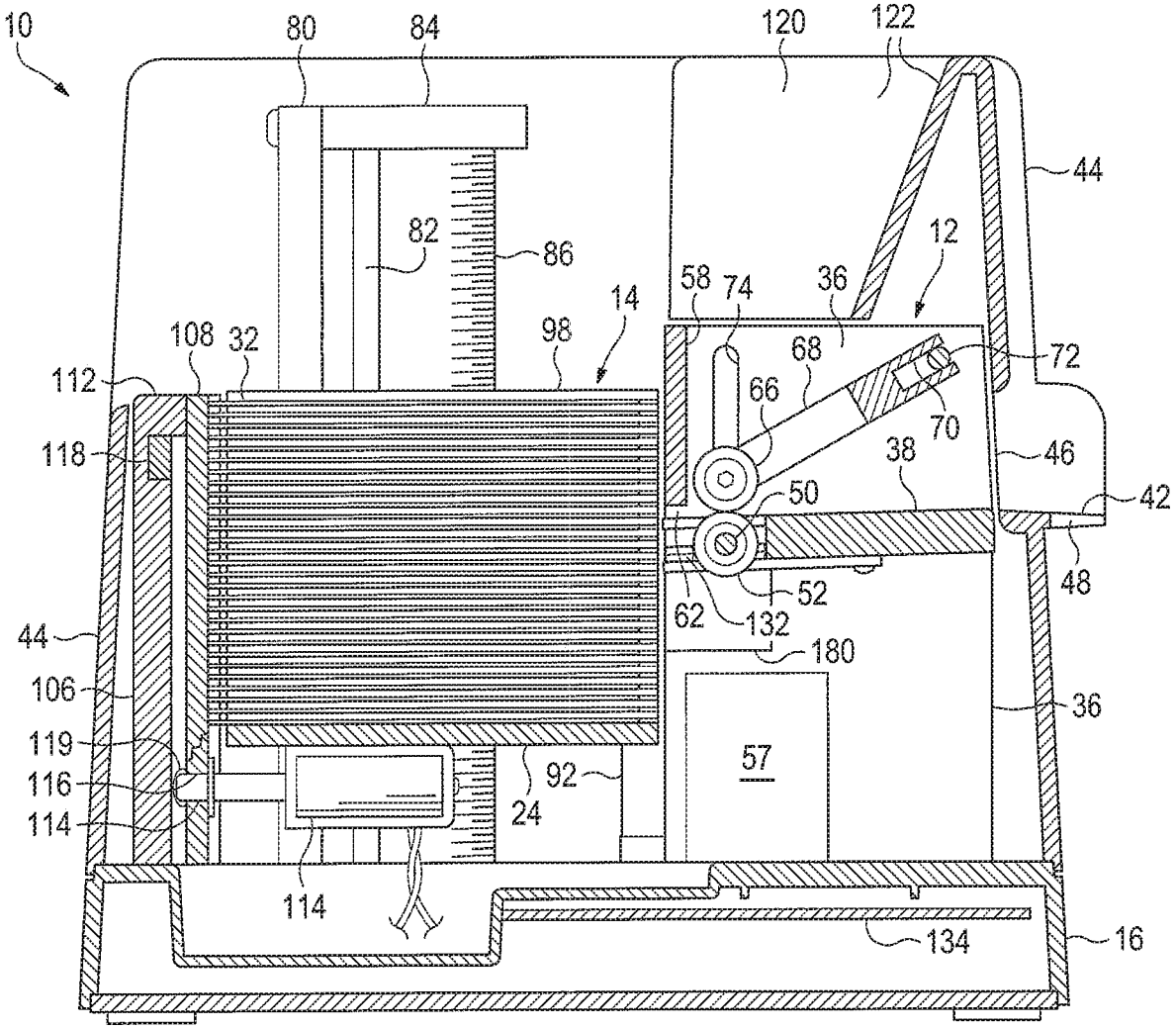
FIG. 10 is a sectional view of the shuffler shown in FIGS. 1-5, taken along line 7-7 in FIG. 1, with shuffled cards in the dealing rack and the card shield lowered.

Referring now also to FIGS. 6 and 10, adjacent the dealing rack assembly 14, on an outfeed side of the dealing rack 14, opposite the location of the deck-crib 12, there is a blocking wall 106 mounted on and extending upwardly above the base 16. A movable card shield 108 in the form of a generally flat panel may be slidably disposed in a pair of channels 110 extending vertically along the inner side of the blocking wall 106. The card shield 108 can be moved between a lowered position, in which an upper margin of the card shield 108 is aligned with the top margin 112 of the blocking wall 106, and a raised position, in which the card shield 108 extends upward alongside the entire height of the dealing rack 14 when the dealing rack 14 is in an uppermost position, as shown in FIGS. 1-4. The card shield 108 is located closely alongside the opposite or far side of the dealing rack 14, spaced away from the deck-crib 12, and serves to prevent a shuffled card 32 from protruding from the far side of the dealing rack 14 as a result of being moved too far by the drive rollers 52.

The card shield 108 is movable between its raised position and its lowered position by being carried along with the dealing rack 14, as when the controller 134, through an electrical signal, causes a suitable latch to be engaged, such as when the plunger of a bistable solenoid 114 shown in FIGS. 6, 10, 11, and 12 is extended into a socket or hole 116 in the card shield 108. The card shield 108 may be stable in each of those positions, as a pair of magnets 118 in the blocking wall 106 can act on ferromagnetic screws 119 in the card shield 108 to hold it in the raised position when the plunger of the solenoid 114 is retracted from the hole 116, and gravity or other magnets (not shown) or other means will keep it in the lowered position. During the process of shuffling a deck 13 of cards or when a completely shuffled deck of cards 32 is in the dealing rack 14, the card shield 108 is normally in its raised position as shown in FIGS. 1, 2, 3, and 4, where it hides shuffled cards 32 in the dealing rack 14 from being seen by players during the course of shuffling the cards. When shuffling is finished the dealing rack 14 is raised, the plunger of the solenoid 114 engages the hole 116, and the dealing rack 14 automatically moves the card shield 108 to its lowered position alongside the blocking wall 106. The plunger of the solenoid 114 is then retracted from the hole 116 to release the card shield 108. Each time the dealing rack 14 is cleared, and a stack or deck 13 is in the deck-crib 12 and ready to be shuffled, at the beginning of a shuffling operation the dealing rack 14 automatically fetches the card shield 108 and raises it to hide the vertical movement of the dealing rack 14 from view during shuffling. Other mechanisms could also be used to move the card shield 108 at the appropriate times, but should be small and simple to construct and operate.

Figure 2:
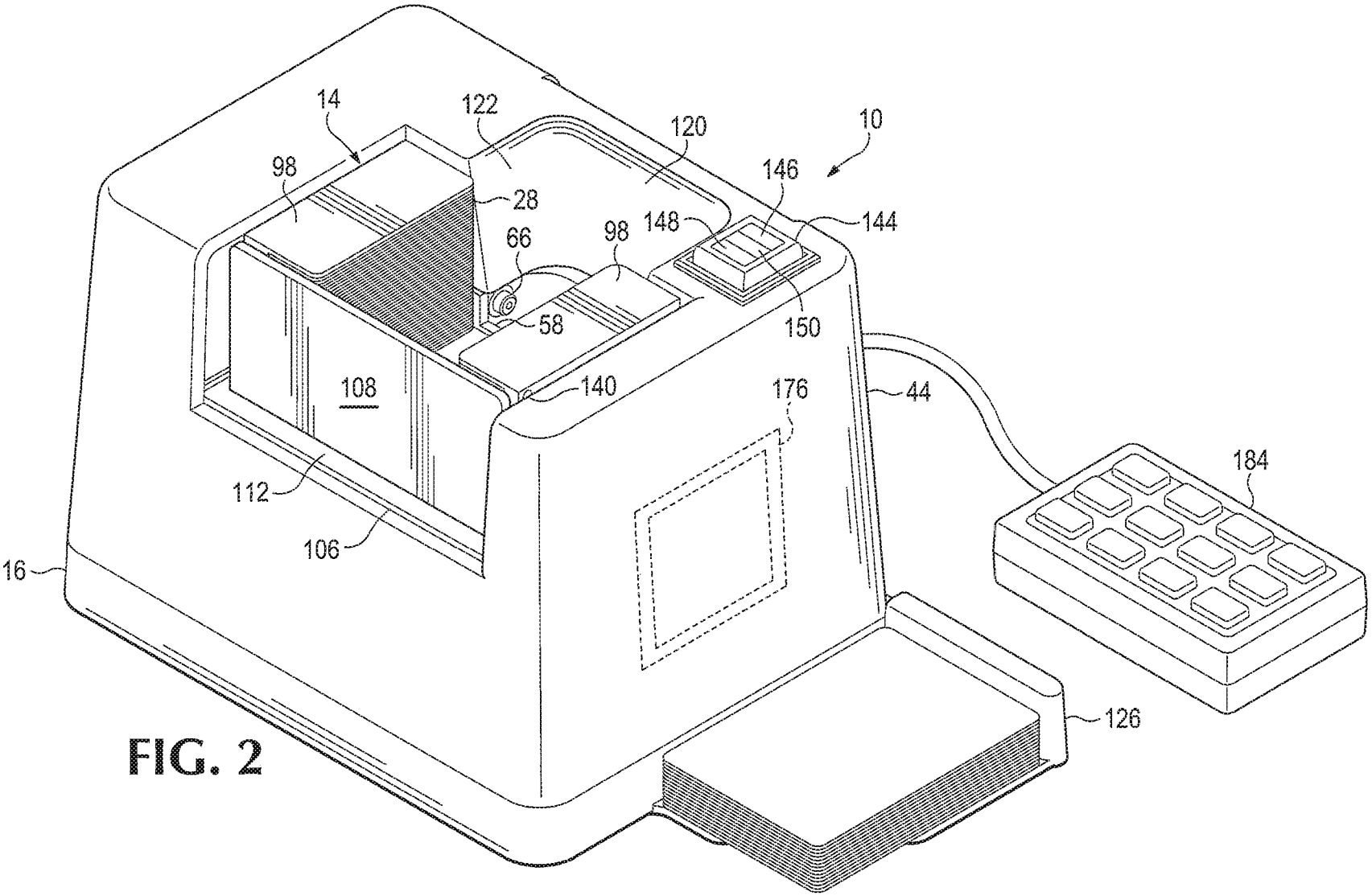
FIG. 2 is an isometric view of the shuffler shown in FIG. 1, from the upper right end of its front, or player-facing side, and showing a second deck of cards held in a discard bin.

When the body cover 44 is in place as shown in FIGS. 1 and 2 an opening into a card removal cavity 120 is available above a deck or stack 13 of cards in the deck-crib 12, so that the top card of a stack 13 remaining in the deck-crib 12 might be seen by looking down into the card removal cavity 120. The opening gives the dealer access to the shuffled cards 32, and the card removal cavity 120 may be defined by inwardly sloping sides 122 to guide the dealer's fingers into a position aligned with the exposed edges of the shuffled cards 32 in the gap 33 (see FIGS. 4 and 6). To verity that a complete shuffle has occurred, a dealer, supervisor, or some players, depending on their locations relative to the shuffler 10 can see the full dealing rack 14 and the back of the deck-crib 12 and may be able to view the deck-crib 12 from the front through the card removal cavity 120. The body cover 44 also may include a discard rack 126 as a convenient place for holding cards that have been "burned" or played until an appropriate time to place them into the deck-crib 12. Since some games do not involve discards before reshuffling, the discard rack 126 may be a separate detachable piece.

As may be seen best in FIGS. 6, 7, 8, and 9, various sensors are provided in the shuffler 10 to monitor and help control operation of the shuffler 10. A deck-crib sensor 130, which may be located in or beneath an aperture 131 in the bottom member 38 of the deck-crib 12, senses the presence or absence of one or more cards to be shuffled and may be connected to provide a signal to a controller 134, to inform the controller 134 when to commence or cease shuffling. The controller 134 is shown as a circuit board in FIGS. 7 and 12. The deck sensor 130 shown in FIGS. 8 and 9 may, for example, be an SMT reflective sensor with an LED emitter and a Schmitt trigger, such as OSRAM part No. SFH 9240.

A card counting sensor 132, which may be similar to the sensor 130, is aligned with a corresponding opening 133 in the bottom member 38 adjacent the card stop wall 58, where it can sense the presence of a card 32 in the slot 62 (FIGS. 8, 9), and thus can be used to sense whether the slot 62 is open or blocked by a card. It may also provide a signal to the controller 134, which can be used to count each card as it is moved from the deck-crib 12 through the slot 62 into the dealing rack 14.

A third sensor, an empty rack sensor 136, shown best in FIG. 6, may include an emitter 136*e* and a detector 136*d* mounted on the blocking wall 106 at opposite sides of the dealing rack 14, aligned with the location where the bottom receptacle 30 of the dealing rack 14 will be located when the dealing rack 14 is in its uppermost position. A similar sensor, a receptacle status and alignment sensor 138 including a paired sensor emitter 138*e* and sensor detector 138*d* may be located beneath the sensor pair 136, 138 and aligned with the height of the outfeed slot 62 (FIGS. 8 and 9) of the deck-crib 12, where it can sense and inform the controller 134 whether a receptacle 30 is aligned with the slot 62 and thus provide information to the controller 134 for use in moving the dealing rack 14 to bring a receptacle 30 into alignment. The alignment sensor 138 can also detect whether a receptacle 30 is empty or a card is present in a receptacle 30 of the dealing rack 14 aligned with the slot 62 at a particular time, in order to signal to the controller 134 whether the dealing rack 14 can be moved. Vertical slots 140, also shown in FIG. 6, may be defined in the ends 20 and 22 of the dealing rack 14 to provide a clear path through the dealing rack 14 between the emitters 136*e*, 138*e* and detectors 136*d*, 138*d* of the sensors 136 and 138.

The empty rack sensor 136 is used after a shuffle is completed to sense and provide a signal to the controller 134 that a hand of cards has been removed from the dealing rack 14, or that an entire shuffled deck of cards 32 has been removed from the dealing rack 14 following shuffling. Since the shuffled cards in the dealing rack 14 are close together, when several cards are presented above the top margin 112 of the blocking wall 106, the bottom card, held in the receptacle 30 and aligned with the empty rack sensor 136, can be reasonably easily removed by the dealer only by removing all the cards above it. Absence of the card 32 from the bottom exposed receptacle 30, as detected by the empty rack sensor 136, thus indicates removal of all the cards that had been presented.

The controller 134 can be programmed so the dealer can control all pre-game settings, live game functions, and special features and security functions of the shuffler 10 by the use of a single switch, for example, a pushbutton switch that may be called a dealer manager or "DM" button 144 (see FIGS. 1 and 2), and that is connected electrically with the controller 134. The DM button 144 may incorporate signal lights to indicate status of the shuffler 10 during operation. For example, the DM button 144 may include signal lights in the form of LEDs 146, 148 and 150 to display green, red, and yellow lights, respectively, each indicating a different status of the shuffler 10. For example, a green LED 146 may be used to indicate that the shuffler 10 is in a normal operating mode. A red LED 148 may indicate that the shuffler 10 is in a "problem" or "security" mode of operation and that the dealer must press the DM button 144 to cause the shuffler 10 to revert to normal operating mode. A yellow signal LED 150, if included, may be used to indicate that the shuffler 10 is in a waiting mode, waiting for the dealer to press the DM button 144 to place the shuffler 10 back into normal operating mode.

The controller 134 of the shuffler 10 may be programmed to operate the shuffler 10 in a selected one of various shuffling modes, including two-deck batch mode, traditional one-deck mode, one-deck incremental mode, and continuously complete single deck mode. Shuffled cards can be presented to the dealer in various modes, including a complete deck removal mode, a programmed single hand removal mode, and a random number hand removal mode.

The shuffler 10 must be preset before live play, establishing various parameters of the functions of the shuffler 10 for a game for which it is to be used. In a pre-game settings mode, several subsidiary modes can be selected and defined, including the dealing sequence (and defining, for example, up to three additional betting phases that may involve dealing extra cards), shuffling mode, card removal mode, card cutting mode, burn card mode, starting position for the deal mode, and more.

Once preset and powered, the shuffler 10 requires only the "dealer manager button" or DM button 144, for usage in live play. The DM button 144 may be set to use only the green LED 146 and the red LED 148 for Poker and Blackjack, and may also use the yellow LED 150 for novelty games. The DM button 144 is used to direct the sequence of cards dealt according to pre-game settings, and signals to the controller 134 to move the dealing rack 14 accordingly, in accordance with the programming of the controller 134.

As an option, five binary dip switches shown schematically in FIG. 3 can provide inputs to preset the controller 134 for all games and dealing sequences, one switch 156 to provide the controller 134 an input regarding the players, and four switches 158, 160, 162, and 164 to provide inputs regarding the dealer, including three additional betting rounds if needed. Utilizing a 5-place binary format (up/down, in/out, etc.), each switch can be set for the numbers zero to 15, to provide ample flexibility in setting the numbers of cards to be dealt, through from one to eight in the first two switches 156 and 158 (players and dealer) and from one to five in the last three switches 160, 162, and 164 (betting rounds) would be likely to be more than sufficient.

Figure 12:
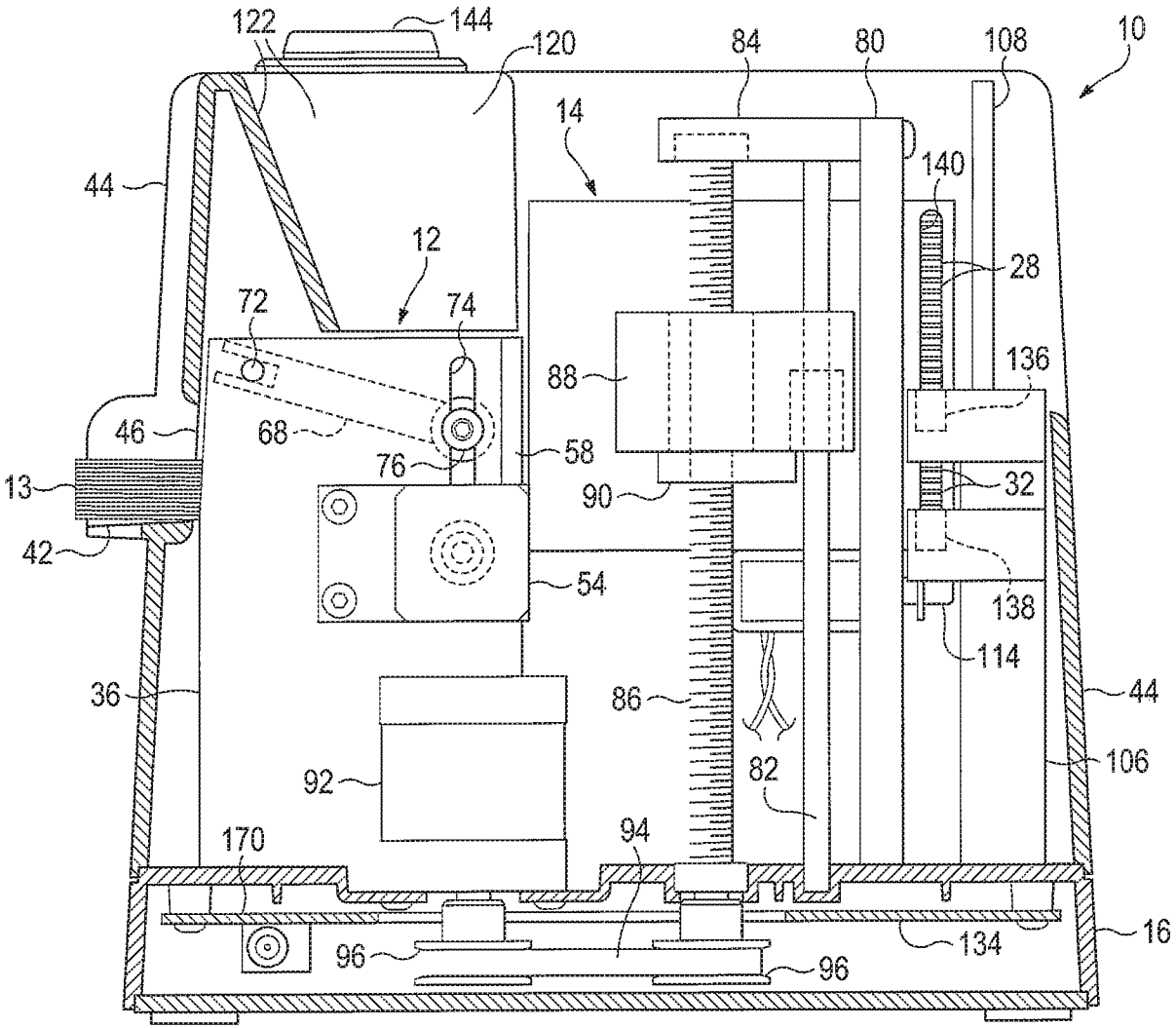
FIG. 12 is a sectional view taken from the right end of the shuffler as shown in FIG. 1, showing positions of some components of the shuffler during a shuffling operation.

The controller 134, as shown in FIGS. 12 and 13, includes a computer such as a suitably programmed digital microcomputer 170 electrically interconnected with the DM button 144, the sensors 130, 132, 136, and 138, the signal LED 146, 148, and 150, and the switches 156, 158, 160, 162, and 164, (see FIGS. 3 and 13) and programmed to control the motors 54 and 92, and the solenoid 114. To provide a truly random shuffle, and to facilitate approval from appropriate gaming labs, a random number generator (RNG), such as the accepted RNG known as the "Mother of all Random Number Generators," may be incorporated in the controller 134 in association with the microcomputer 170.

Figure 11:
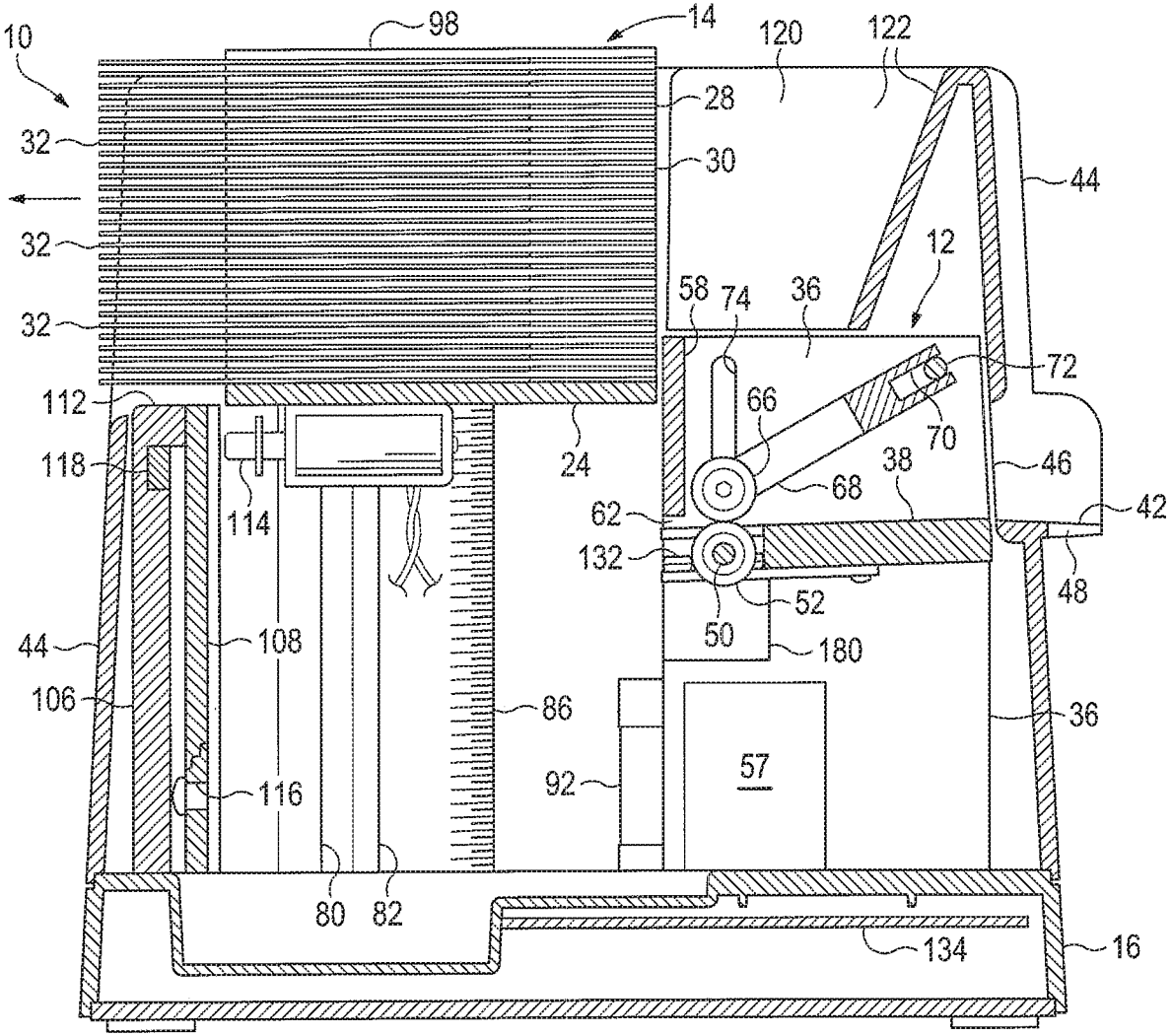
FIG. 11 is a sectional view taken along line 7-7 in FIG. 1, with the dealing rack in position for removal of a shuffled complete deck.

As an optional feature, the shuffler 10 may also be equipped with a card reader 180 that may be located beneath the bottom member 38 of the deck-crib 12, as shown in FIGS. 7, 10, and 11. Such a card reader could incorporate various technologies, including bar code technology, optical character recognition (OCR), intelligent character recognition (ICR), optical mark recognition (OMR), encoded or marked cards, digital camera technology, and others. A suitable aperture 182, as shown in FIG. 5, or multiple apertures may be provided in the bottom member 38 of the deck-crib 12 to expose a portion of each playing card including the suit and rank indicia or special markings. Each lowermost card in the deck-crib 12 can be scanned by the card reader 180, either before or while it is moved to a receptacle 30. The card reader 180 may be connected electrically with the microcomputer 170 of the controller 134 so as to store in computer memory the identity of each shuffled card 32 and to correlate the card identity with the location of the particular receptacle 30 into which it is moved from the deck-crib 12. Ultimately, the identity of a card dealt to a particular player or the dealer may be determined through use of the microcomputer 170 and using the shuffler 10 to present groups of cards 32 as hands for players, as will be described more fully below.

For some games the dealer will usually use the complete deck removal mode and remove the entire deck of shuffled cards 32 from the dealing rack 14 before beginning play. When the shuffler 10 is set for the complete deck removal mode, upon completion of shuffling, the card shield 108 is lowered to rest alongside the blocking wall 106 and the dealing rack 14 is raised to its fully raised position as shown in FIG. 11. The card removal cavity 120 communicates with the gap 33 between the left partial shelves 26 and the right partial shelves 28 of the dealing rack 14 so that the dealer can insert his fingers into the card removal cavity 120 to grasp the edges of all of the shuffled cards 32 in the gap 33 and then slide the entire deck of shuffled cards 32 outward over the top margin 112 of the blocking wall 106.

Once the entire deck of shuffled cards 32 has been removed from the dealing rack 14, a signal from the empty rack sensor 136 that the lowest receptacle 30 of the dealing rack 14 is empty is received by the microcomputer 170, which then commences the shuffling procedure if there is another deck 13 of cards in the deck-crib 12.

The open and visible structure of the deck-crib 12 and dealing rack 14, combined with the locations of the deck sensor 130, card counting sensor 132, empty rack sensor 136 and dealing rack alignment sensor 138, make it simple to locate and clear a jam or identify a malfunction. Should a card not be moved completely from the deck-crib 12 to a single-card receptacle 30 the sensor 132 should provide an indication in the form of an electrical signal to the controller 134. Should a controller malfunction result in a receptacle selection error, the dealing rack 14 can be raised to its uppermost position to allow all cards to be removed easily, and all cards can always be removed easily from the deck-crib 12.

Figure 14:
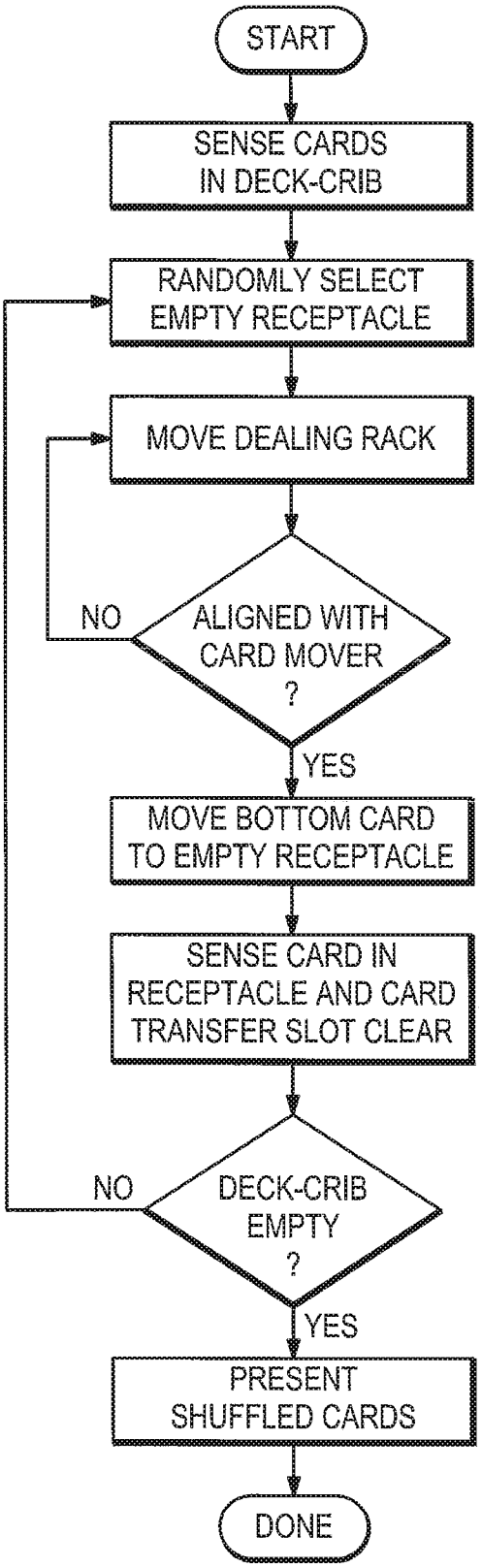
FIG. 14 is a flowchart for operating a shuffler to shuffle a deck of cards.
Figure 15:
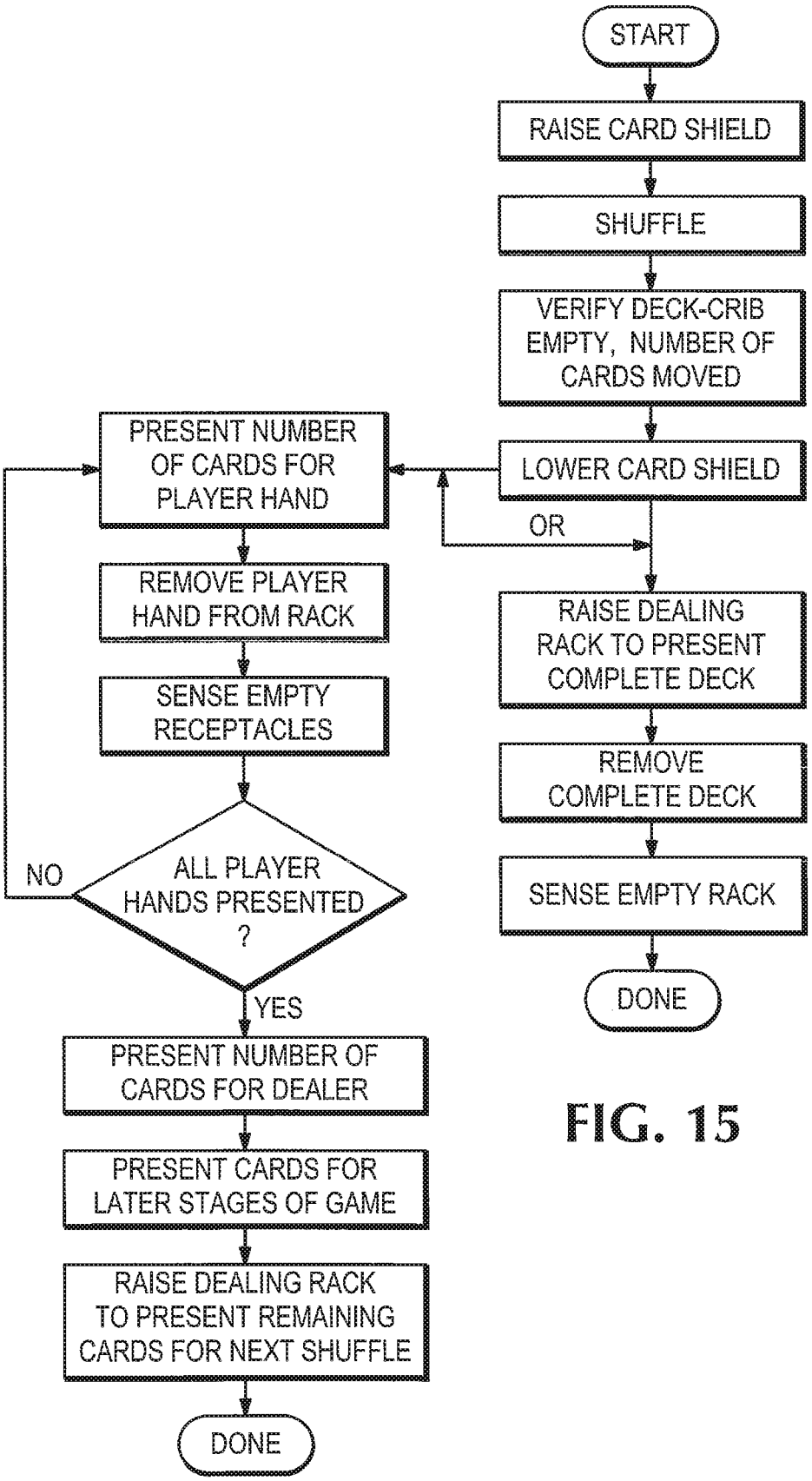
FIG. 15 is a flowchart showing operation of the shuffler in presenting shuffled cards.

The shuffling steps are directed by the controller 134 as shown in simplified form in flow diagrams in FIGS. 14 and 15. The controller 134 prepares to begin shuffling by lowering the dealing rack 14 to its lowermost position, there extending the solenoid plunger 114 to engage the hole 116, followed by raising of the card shield 108 to its raised position above the blocking wall 106, and then retracting the solenoid plunger 114 so that the card shield 108 will remain up held by the attraction of the magnets 118 for the ferromagnetic screws 119, while the cards in the deck-crib 12 can be shuffled. Referring also to FIGS. 4-11, to shuffle the cards in the deck-crib 12, for the first or lowermost card in the stack 13, the random number generator associated with or incorporated in the microcomputer 170 of controller 134 randomly selects one receptacle 30 from the 52 empty receptacles 30 in the dealing rack 14 and causes the stepper motor 92 to run for the required distance as tabulated in the microcomputer 170 to drive the lead screw 86 far enough to move the dealing rack 14 along the guide rod 82 by acting on the lead screw nut 90 engaged with the lead screw 86 and mounted in the carrier lift block 88. The dealing rack 14 is moved to place the randomly selected receptacle 30 directly adjacent to slot 62, aligning the receptacle 30 in position to receive the bottom card or last card from the unshuffled stack 13.

The alignment of the dealing rack 14 to the deck-crib 12 may be monitored throughout the shuffle. To align each receptacle 30 precisely, the laser alignment sensor 138 may sense the bottom or top of a shelf 26 or 28 and send a signal to the microcomputer 170 as an alignment datum. From that datum, the microcomputer 170 may tell the stepper motor 92 to move up or down a certain number of steps to align the center of the respective receptacle 30 with the slot 62 of the deck-crib 12. Alternatively, there may be one datum related to a particular receptacle 30 and the controller 134 may move the dealing rack 14 up or down a number of steps times the number of receptacles 30 from the datum to align the dealing rack 14 in a position aligned with the next selected receptacle 30. It may be necessary to make calibration adjustments throughout the shuffle, and such adjustments can be tabulated in the memory of the microcomputer 170. The dealing rack 14 could thus have a home position datum at a certain receptacle 30 and be programmed to go slightly short of alignment for any other receptacle 30 so the alignment sensor 138 would always be blocked by the shelf 26 or 28 when it arrived. The stepper motor 92 would then adjust the position of the dealing rack 14 in incremental steps until the shelf 26 or 28 no longer blocks the signal from the sensor emitter 138*e*. When the sensor detector 138*d* acquires the signal, it would then tell the controller 134 that the receptacle 30 is aligned with the deck-crib 12 and a card can be moved from the stack 13 to the dealing rack 14, and the position tabulation in the microcomputer 170 could be updated.

When the motor 92 has run an ordered distance and the alignment sensor 138 determines that the randomly selected receptacle 30 is aligned with the slot 62, the alignment sensor 138 sends a signal to the microcomputer 170 of controller 134. In response to receipt of that signal, the microcomputer 170 of controller 134 causes the card mover stepper motor 54 to rotate, driving the feed drive shaft 50 and the drive rollers 52, in contact with the face, or bottom side of the bottom card in the deck-crib 12, far enough to move the bottom card in the deck-crib 12 away from the deck 13, through the slot 62, and into the aligned receptacle 30 of the dealing rack 14. The controller 134 may be programmed optionally to cause the motor 54 to rotate the drive rollers 52 far enough immediately thereafter to move the next subsequent bottom card from the deck 13 a small distance if necessary, pushing the card that has just earlier been removed completely from the deck-crib 12 a small distance to clear it from the slot 62, and then reversing the motor 54 to move the subsequent card back into position at the bottom of the deck 13. The dealing rack 14 is then clear to be moved upward or downward to place another receptacle 30 into a position of alignment with the slot 62 to receive a subsequent card from the deck 13.

Once the first card is shuffled to the dealing rack 14, only 51 empty receptacles 30 remain, and the microcomputer 170 randomly selects a receptacle 30 for the next card, from the remaining 51 empty receptacles. The microcomputer 170 then again directs the stepper motor 92 to drive the lead screw 86 to move the dealing rack 14 to align the designated receptacle 30 for the second card with the slot 62, and once the receptacle 30 is determined to be aligned with the slot 62, the microcomputer 170 of controller 134 again causes the motor 54 to move the bottom card from the deck 13 into the receptacle 30 in the manner described above. This sequence is repeated until each of the 52 cards has been inserted into a respective randomly selected receptacle 30, one card at a time, one card per receptacle 30. As a security measure to hinder tracking of cards, the controller 134 may be set to cause the dealing rack 14 to be moved to position a receptacle 30 in alignment with the slot 62, as a fake insertion, without moving a card into the receptacle 30 at one or more times during the shuffle.

Once the entire deck 13 has been moved from the deck-crib 12 into the dealing rack 14, a memory component of the microcomputer 170 contains a record of the sequence of placement of cards into the receptacles 30. If the shuffler 10 also includes a card reader 180, the suit and rank of each card can also have been stored in memory together with the location in the dealing rack 14 to which that card has been moved.

Because the distances through which the dealing rack 14 has to be moved are small, each movement of the dealing rack 14 during shuffling being no greater than about two inches and most movements being significantly less, from the location of one receptacle 30 to the location of the next receptacle 30 into which a card is to be placed, the total time to shuffle the 52 cards of a complete deck 13, placing each into a randomly selected receptacle 30, may be about 15 seconds. When the last card of a stack 13 is moved from the deck-crib 12, the deck sensor 130 sends a signal to the controller 134, whose microcomputer 170 then determines based on the signals received from the card counting sensor 132 (see FIGS. 8, 9, and 11) whether the deck has apparently been correctly shuffled.

Once all 52 receptacles 30 are filled and the shuffle is complete, in the "complete deck removal mode" the card shield 108 is lowered and the dealing rack 14 is automatically raised upward above the blocking wall 106 so that all 52 receptacles 30 are accessible from the front and back, as shown in FIG. 11. The dealer can then slide all 52 shuffled cards 32 out of the dealing rack 14 over the top margin 112 of the blocking wall 106 on the side of the dealing rack 14 opposite from and spaced apart from the deck-crib 12 as a complete deck, which can now be presented to the players for the cut (Blackjack) or cut by the dealer (Poker). Play then continues in the traditional format with the dealer dealing from the shuffled deck.

In order to protect the cards from view before shuffling and to protect cards in the dealing rack 14 from view during shuffling, before the deck is placed into the deck-crib 12, the deck may be placed, face down, on a plastic cut card, and the deck and the cut card can be placed in the deck-crib 12 together. The controller 134 can be programmed to always put the cut card into the top receptacle 30 of the dealing rack 14 before moving the playing cards to randomly selected receptacles 30.

Figure 16:
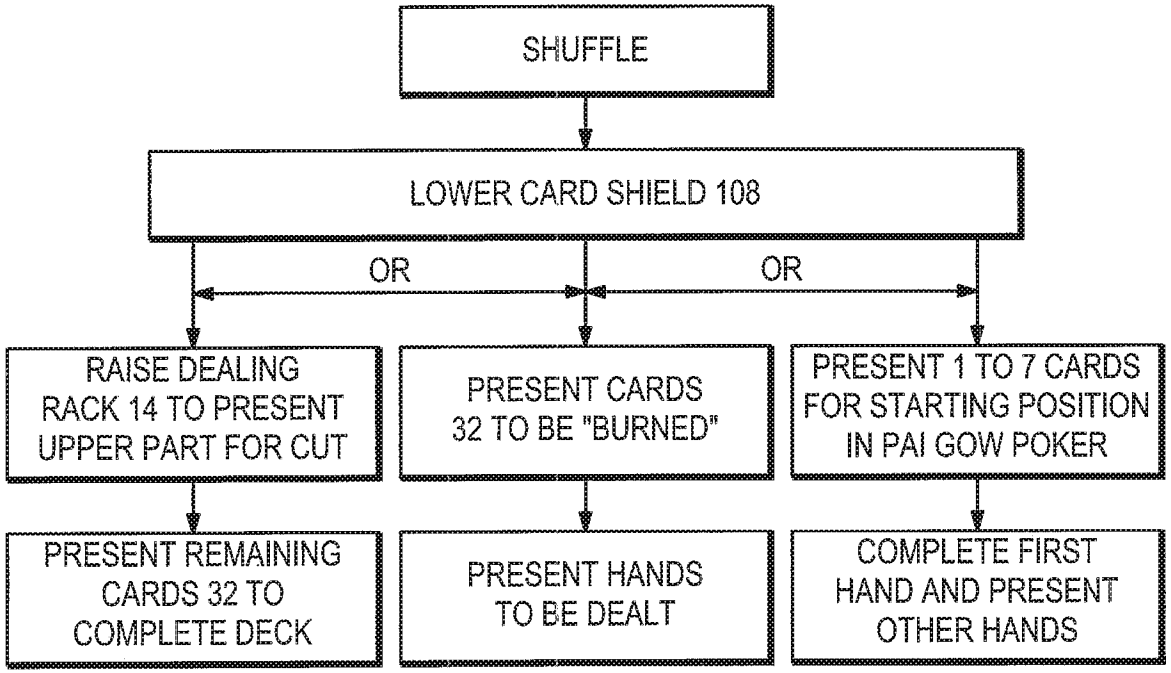
FIG. 16 is a simplified flowchart of operation of the shuffler in performing optional steps before presenting hands of cards.

As an additional option, when the shuffler 10 is in the whole deck removal mode, the controller 134 may be programmed to cut the deck of shuffled cards 32, also shown in FIG. 16. When a shuffle is complete, and when the shuffler 10 presents the shuffled cards 32, the controller 134 will automatically select a randomly selected number of cards to cut from the deck of shuffled cards 32, within an acceptable range, which may be defined and programmed to be in accord with applicable regulations, since cutting too thin or too deep may not be considered a valid cut. The controller 134 would cause the dealing rack 14 to rise to present the randomly selected number of cards above the blocking wall 106 to be removed by the dealer, and the dealer would remove those cards, constituting the upper part of the deck. Immediately after removal of those cards, the controller 134 would raise the dealing rack 14 to its highest position for the removal of the remaining cards, the lower part of the shuffled deck, to be placed atop the upper part of the deck thus emulating the classic cut. Optionally, the cut could instead be initiated by the dealer's signal using the DM button 144 according to a programmed protocol.

Alternatively, in an interactive deck cutting mode, upon completion of the shuffle the controller 134 causes the dealing rack 14 to rise slowly or to rise and fall through a range of positions waiting for a player to call out "cut." At this call the dealer hits the DM button 144 to stop the dealing rack 14, allowing the cards to be cut at this point. The player has thus "cut the cards" without intervention by the random number generator of the controller 134. Verbally calling out "cut" (or the use of player hand signals) is just one way for the players to interact with the shuffler 10 in this regard. As another option, for example, the player making a cut could utilize a small remote-control unit shaped and sized, for example, like half a billiard ball with a button on the top. Pressing the button would remotely stop the dealing rack 14 as it slowly rises, allowing the shuffled cards 32 to be cut at a point chosen by a player.

In whole deck removal in a two-deck batch playing mode, once the shuffling operation is completed and a subsequent deck 13 is placed into the deck-crib 12, the signal of the empty rack sensor 136 to the controller 134 indicating that the shuffled deck has been removed from the dealing rack 14 results in the controller 134 commencing the shuffling procedure for the subsequent deck 13.

Blackjack and Poker are usually dealt in "complete deck removal mode." Once the shuffler 10 is turned on, provided the dealing rack 14 is empty, placing a deck 13 into the deck-crib 12 will automatically prompt a shuffle after a preset time, such as three seconds, has been measured by the controller 134. Since the time to shuffle a deck is so short (10-15 seconds), it is unnecessary stop a shuffle mid-way and manually dear both the deck-crib 12 and dealing rack 14 before resuming play after an interruption.

Shuffling for the two-deck batch system for play in the complete deck removal mode can continue without any interaction from the dealer, since the deck sensor 130 signals to the controller 134 as each deck 13 is inserted into the deck-crib 12. The deck sensor 130 also senses when the deck-crib 12 is again empty, and the controller 134 in response then causes the dealing rack 14 to lower the card shield 108 and then move to its highest position for deck removal. When the empty rack sensor 136 then detects that the dealing rack 14 is empty and ready to receive cards, the controller 134 automatically causes the shuffler 10 to raise the card shield 108 and begin shuffling. Alternatively, the shuffle can be initiated manually, by the use of the DM button 144.

The controller 134 may be programmed so that, if for any reason the game needs to be stopped, pressing the DM button 144 in a programmed sequence, such as twice within a programmed time, such as one second, signals to the controller 134 to light the red LED 148, stop the shuffling routine, and move the dealing rack 14 to its highest position. In this mode, the shuffler 10 will not operate until the DM button 144 is pressed again, signaling to the controller 134 to resume, which makes the controller 134 turn on the green LED 146.

For Poker and Blackjack, the green LED 146 is always on unless the game is stopped, as by pressing the DM button 144 twice, as for security reasons; or if too many cards are present or cards are missing as detected by the controller 134 in response to card count signals from the sensor 132, and the shuffler 10 stops automatically in response; or when there is a jam or malfunction and the shuffler 10 stops automatically, as in response to excessive current being drawn by one of the motors 54 and 92.

A two-deck batch system allows one deck to be shuffled while the other is being dealt and the game is being played. The shuffler 10 may instead be used for traditional single-deck Blackjack and other games where multiple rounds are dealt before reshuffling instead of using the batch system requiring two decks in rotation. For this mode, the controller 134 may also be programmed to shuffle the cards from each round, fewer than a complete deck, incrementally, immediately after a round has been played, commencing the incremental shuffle as soon as the cards from a round are inserted into the deck-crib 12 and a preset timed delay has elapsed, or the dealer has pressed the DM button 144, placing the cards from each round into randomly selected receptacles 30 in the dealing rack 14. This is in contrast to the traditional procedure in any multiple round game where the cards from each round are placed into the discard rack, and after one or more rounds, combined with the remaining unplayed cards and shuffled as a complete deck. Shuffling the cards from each round after it has been played has the effect of shuffling portions of the deck as the game progresses. After all rounds are played from the deck being used, the shuffling process no longer involves all 52 cards but only the remaining undealt cards and the cards from the last round played. The same incremental method of shuffling could be used for shuffling cards as they are played from a multi-deck shoe, to reduce the time needed eventually to complete the shuffling process, and thus make it unnecessary to use a multi-deck batch system. Also, in a multi-deck system, the tail end of the shuffled multi-deck group of cards is usually not played, and that portion of the group of cards could be placed into the shuffler and be shuffled as the first increment even before beginning to deal a round from the front end of the multi-deck group. The same could be done with the cards at the bottom of a single deck after it has been cut.

Figure 17:
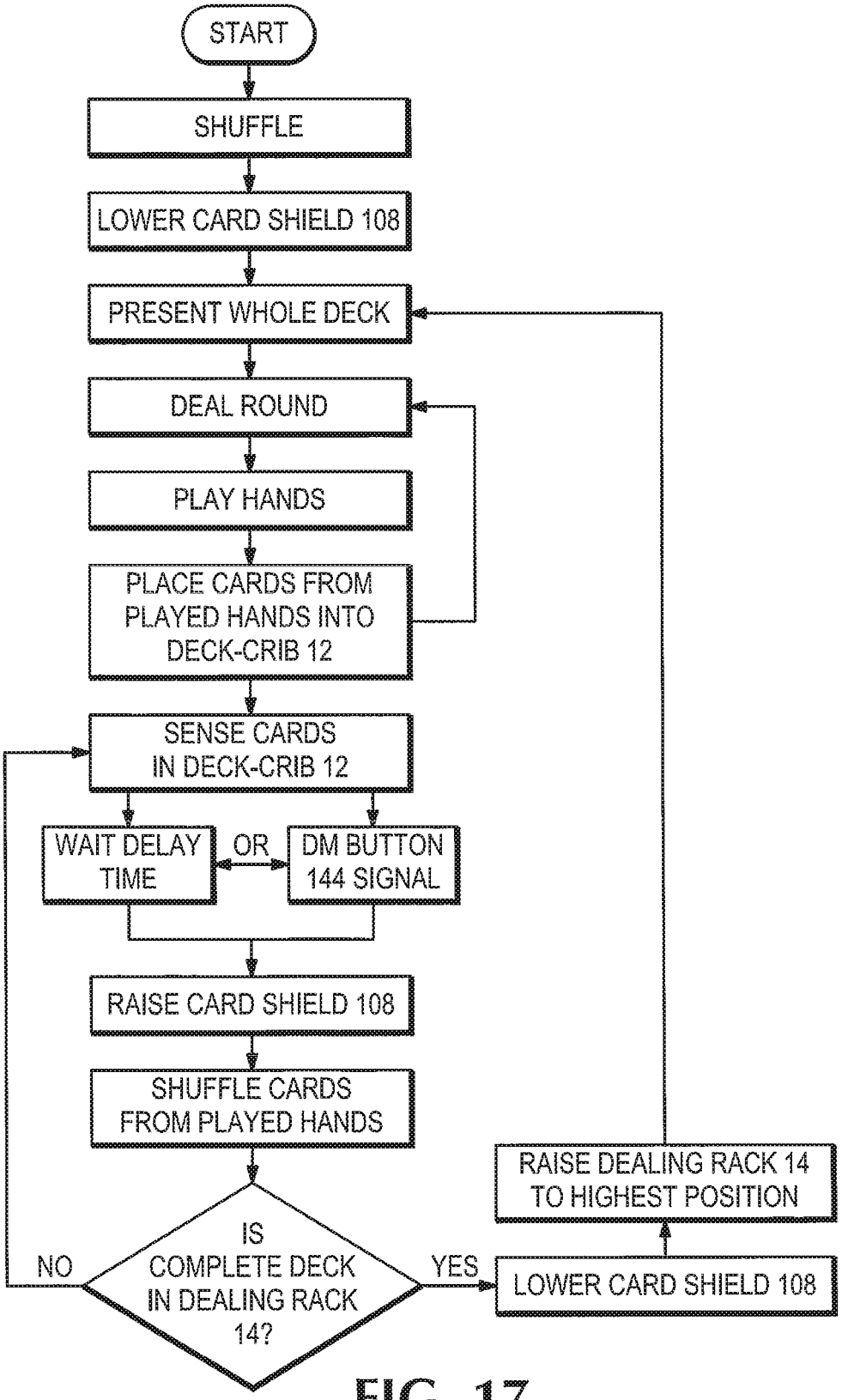
FIG. 17 is a flowchart showing operation of the shuffler to perform incremental shuffling of a plurality of cards.

For example, as illustrated in simplified flow diagram form in FIG. 17, if the first round uses 15 cards, these cards are inserted directly into the deck-crib 12 (instead of the discard rack 126), and after, for example, a programmed delay, or upon a signal initiated by the dealer, using the DM button 144, the cards are automatically and randomly distributed into the dealing rack 14 (while the second round is dealt). If the second round consists of 11 cards, then 11 more cards are inserted into the deck-crib 12 and randomly distributed to open receptacles 30 (while the third round is dealt). Assuming that a third and final round is dealt before shuffling, since 26 cards have already been shuffled (15+11), only 26 more cards, including cards from the third round, need be shuffled to complete the entire shuffling process, and make the complete deck 13 available for play.

With this approach, the biggest savings in shuffling speed will occur with one player since a complete round may only consist of 5 or 6 cards. If the dealer dealt down to the 40th card before dealing the last round, the shuffler 10 would only have to shuffle 12 remaining cards to complete the shuffle. At a full table where only two rounds are generally dealt before reshuffling, and assuming that 26 cards are used to deal a round, the shuffler 10 would only have to shuffle the 26 cards of the second round to complete the process.

Using the shuffler 10 for such incremental shuffling in such a one-deck system can maintain the dependent nature of Blackjack or other games. If the four aces were played in the first round, they could not be dealt in later rounds before the entire deck has been shuffled.

The shuffler 10 can be used, in what may be called a continuous shuffling manner, to provide a shuffled complete deck for each round of play, where actual play of the game does not require additional cards to be dealt during play. As soon as a hand has been dealt to each player and to the dealer, the remaining shuffled cards may be placed into the deck-crib 12 and shuffling may be initiated automatically by the controller 134 upon receipt of a signal from the deck-crib sensor 130 and a programmed delay, or by the dealer's pressing of the DM button 144. The cards not dealt for the round being played are already shuffled by the time the round of play is completed and the cards that have just been used in play can then be placed into the deck-crib 12 and shuffled. This completes shuffling of the entire deck, which can then be used for the next round of play, in significantly less time than waiting for an entire deck to be shuffled.

In one embodiment of the shuffler 10, the DM button 144 may be used for the entire pre-game process of setting the shuffler 10 for a particular novelty game. The controller 134 could be programmed to enter into a pre-game settings mode, in response to a selected pattern and durations of pushing the DM button 144. Other patterns can be used in the pre-game settings mode to set the shuffler 10 for use in play of a card game by entering pre-game settings through the DM button 144 to establish how the shuffler 10 is intended to operate for a particular game. For example, settings for a hand removal mode may be entered into the controller 134 to cause the shuffler 10 to present serially to the dealer, during play, a desired number of cards for each player, and for the dealer, for a game such as one of many games termed "novelty games," in which a certain number of cards are dealt to each player and either the same or a different number of cards may be dealt to the dealer, and in which a prescribed number of additional cards may be dealt at one or more later times.

Once in a pre-game settings mode, in one embodiment of the shuffler 10 a deck 13 could be placed into the deck-crib 12 and shuffled, and the supervisor could then hit the DM button 144 once for each card required in a hand for each of the players; thus in a game where each player is dealt three cards, the DM button 144 would be hit three times. Following a prescribed delay thereafter, such as three seconds, the dealing rack 14 could move and present three cards, which may be removed and spread on the table for confirmation, ending phase one. As a second phase, to set the controller 134 for the dealer's hand the same procedure is followed. If there are no additional phases or betting rounds requiring additional cards, the DM button 144 would then be pressed twice and then held down for a predetermined longer time to get out of the pre-game settings mode (the same procedure used to get into the pre-game settings mode). The controller 134 in such an embodiment might be programmed to allow up to five additional phases to be handled as described, for example. Having the dealing rack 14 present the desired number of cards after the number of cards to be presented is set for each hand or following phase gives visual confirmation.

With another alternative embodiment of the controller 134, once the shuffler 10 is in the pre-game settings mode the controller 134 could delay for a time such as three seconds and then blink one light, such as the green LED 146, one time every three seconds thereafter. To set up for a game where the players are each dealt three cards, after the third blink, the supervisor would then hit the DM button 144 twice to establish a setting of "three cards for each of the players." Then, after another delay of three seconds, the programmed controller 134 could cause the green LED 146 to resume blinking. If the dealer is to be dealt five cards, after the fifth blink, the supervisor would hit the DM button 144 twice to establish "five cards for the dealer." If there were no additional betting rounds, the supervisor could then hit the DM button 144 twice to clear "additional betting round number 1," and then twice more to clear "additional betting round number 2," and twice more to clear the "last additional betting round number 3." That is, after the appropriate number of blinks equal to the number of cards required for a particular stage of the dealing sequences (five total stages), the DM button 144 is hit twice to set a number of cards or clear a stage. After the fifth (final) stage is established or cleared, the shuffler 10 would revert to normal play mode and be ready for play. The foregoing is only one more of several possible ways to input this information, and as another option, the controller 134 could also be programmed to respond to a setting by blinking a certain one of the color LEDs 146, 148, or 150, or rapidly blinking sequences could signify "cleared" or be used for verification.

In an embodiment of the shuffler 10 that includes the five switches 156, 158, 160, 162, and 164, mentioned above, they may be used with the shuffler 10 in the pre-game settings mode. The switch 156, then, may be utilized to set the shuffler 10 to deliver a certain number of cards for each player, and the switch 158 may be utilized to set the number of cards to be presented for the dealer. The three additional similar switches 160, 162, and 164 may be set to instruct the controller 134 to deliver additional numbers of cards to the dealer or players in a prescribed sequence according to the rules of a game that is to be played. For example, switch 156 may be set to make available a hand of three cards to each player. Switch 158 may also be set to provide three cards to the dealer. In a game where no additional cards are to be dealt, switches 160, 162, and 164 may then all be set to zero. For a different game, for example, TEXAS HOLD'EM BONUS®, switch 156 may be set to provide two cards to each player and switch 158 to provide two cards to the dealer, followed by switch 160 set to provide three community cards to be placed on the table as the "flop" and switches 162 and 164 each set to provide one more card when prompted by use of the DM button 144, a single card for the "turn" when prompted and another single card for the "river" when prompted a second time. The controller 134 may be programmed so that after the "river" card is dealt, completing the deal for a round, the controller 134 would cause the dealing rack 14 to rise automatically to its highest position, allowing the remaining cards to be reshuffled.

Novelty games may be dealt by the shuffler 10 in a "hand removal mode," in which the cards can be removed one "hand" at a time. This mode may be established for the shuffler 10 as described above by the pre-game settings of the switches 156-164, or by the use of the DM button 144. In the case of the shuffler 10 being set to the hand removal mode, for a novelty card game, numbers of cards preset into the controller 134 can be dealt to individual players and to the dealer as hands. Once the deck 13 has been completely transferred from the deck-crib 12 to randomly selected receptacles 30 in the dealing rack 14, the card shield 108 is placed in its lowered position, in which an upper edge of the card shield 108 may be aligned alongside the top margin 112 of the blocking wall 106, and the dealing rack 14 is initially kept in its lowermost position alongside the blocking wall 106. The controller 134 may be programmed so that at that time a different one of the lights associated with the DM button 144, for example, the yellow LED 150, is illuminated. In that case, once the dealer presses the DM button 144 the yellow LED 150 is extinguished, the green LED 146 is lighted. The controller 134 then causes the stepper motor 92 to drive the lead screw 86, and the dealing rack 14 is raised to a position exposing a number of receptacles 30 containing the number of cards that a player is to be dealt. (Alternatively, and ordinarily, the controller 134 would be programmed to raise the dealing rack 14 as soon as a programmed delay time has elapsed after the shuffling operation has been carried out.) The dealer can then remove those cards from the dealing rack 14 by sliding them out across the top margin 112 of the wall 106 and would place them on the table before the first player. Once the first player's cards have been removed from the dealing rack 14, the empty rack sensor 136 can sense that the lowest receptacle 30 above the top margin 112 of the wall 106 is empty. The empty sensor 136 then sends a signal to the controller 134, which raises the dealing rack 14 so as to present the receptacles 30 containing the selected number of cards for the next player's hand, ready to be removed. Alternatively, the dealer could press the DM button 144 to signal to the controller that it is appropriate to raise the dealing rack 14 to present the receptacles 30 containing the selected number of cards for the next player's hand. As yet other alternatives, an additional sensor (not shown) could be located in the card removal cavity 120 to detect the dealer's hand as it removes cards from the dealing rack 14, or a sensor could be located where it can detect the passage of cards out from the dealing rack 14 and send an electrical signal to the controller to initiate raising the dealing rack 14.

The microcomputer 170 may be programmed in one embodiment so that for every round dealt, the dealer must press the DM button 144 before dealing to the last player. This action signals the shuffler 10 to present one last player hand followed finally by the dealer's hand. After the dealer's hand is removed, the controller 134 moves the dealing rack 14 to its uppermost position so that the remaining unplayed shuffled cards 32 can be removed and placed into the discard rack 126 or deck-crib 12.

After each hand is removed from the dealing rack 14 by the dealer, the empty rack sensor 136 signals the controller 134 to cause the dealing rack 14 to rise again, presenting another complete player hand to be dealt. Once all hands have been dealt (including the dealer's), following a programmed delay, or upon the dealer pressing the DM button 144, the dealing rack 14 is automatically raised to its uppermost position, as shown in FIG. 11, allowing all remaining cards to be removed and be placed in the discard rack 126 (FIGS. 1 and 2) or deck-crib 12. Immediately after the dealing rack 14 is cleared of all remaining unplayed cards and while players are making decisions about their hands, if the shuffler 10 is operating in the two-deck batch mode, the next shuffle begins.

In this hand removal mode of operation the controller 134 may provide a visual signal change during the dealing procedure. That is, upon completion of the shuffle, the green LED 146 goes dark and the yellow LED 150 is lighted by the controller 134 the instant the dealing rack 14 presents the first player's hand. The yellow light 150 serves as a reminder to the dealer to press the DM button 144 once before dealing to the last player. Once the DM button 144 is pressed, the green LED 146 turns on, showing that the shuffler 10 has returned to the normal operating mode. The shuffler 10 then presents the last player hand, and when the empty rack sensor 136 detects that hand has been removed or upon a prompt from pushing the DM button 144, the controller 134 raises the dealing rack 14 to present the dealer's hand.

Previously known shufflers are capable of dealing hands where the dealing sequence is definite and predictable and thus easy to program in advance. For playing certain games, however, the shuffler 10 may be set to present cards in a "dynamic game" mode. For example, some games (such as Baccarat) may not require that the players or dealer be dealt individual hands. The shuffler 10 can be programmed to present rounds of one or more cards to be dealt to the center of the table where the players wager on various outcomes, and the shuffler 10 can continue to deal these rounds unaffected by timed delays until a particular result ends the hand, or until the dealer presses the DM button 144 to manually end the hand, or until the shuffler 10 reaches a predetermined point in the deck of shuffled cards 32 and automatically moves the dealing rack 14 to its highest position to end the hand. As another example, for stages of play following a first deal of a predetermined number of cards to the players and dealer, the controller 134 may be set to present three cards, to be used by all players, for an additional betting round and then continue presenting three cards for subsequent betting rounds until a series of rounds is terminated by one of the methods described. Such a round may even consist of a random number of cards as selected by the controller 134, or there may be multiple drawing phases for each player. Other formats are possible. Also, with a card reader 180 included in the shuffler 10, a particular card combination or some other game-rule-identified event can be used as a trigger to signal to the controller 134 to end the hand and automatically raise the dealing rack 14 so that the remaining cards can be reshuffled. Thus, dynamic-game capabilities can be set during the pre-game settings, and the shuffler 10 can handle games with more than five stages, and games in which the outcome path or number of cards needed to complete a hand, phase, or round cannot be predicted or programmed in advance.

As another example, Blackjack is a game normally dealt from the hand even if the cards have been shuffled by machine. Blackjack has a dynamic game format because it is impossible to predict how players will play their hands, e.g., hit, stand, double, and split, or to predict how many cards will be required to complete each player's turn. Assuming that the shuffler 10 presents two cards at a time for each player as the initial deal, the controller 134 would be set to present one card at a time for a first additional betting round and would be locked into the dynamic format procedure. Thus, after the players and dealer are each dealt two cards, the shuffler would thereafter present one card at a time and continue to present one card at a time until the process is terminated.

With the microcomputer 170 of the controller 134 programmed in a slightly different manner, in any novelty game where the players and dealer receive the same number of cards, the dealer need not press the DM button 144 at any time during or after the deal. If the shuffler 10 is preset to deal three-card hands, for example, the dealing rack 14 would rise to present three cards for each player, and three cards for the dealer, simply presenting three cards each time the empty rack sensor 136 detects that the lowest receptacle 30 above the top margin 112 of the blocking wall 106 is empty. After the dealer's hand is removed, the dealing rack 14 will again rise to present three cards, but these cards will never be dealt. If those cards are not removed from the dealing rack 14 as sensed by the empty rack sensor 136 during a programmed delay time, such as 3-5 seconds, the dealing rack 14 will automatically rise the rest of the way to its highest point for the removal of all remaining shuffled cards 32. That is, elapse of the programmed delay time immediately following the removal of the dealer's hand, or the dealer's pressing of the DM button 144, signals the controller 134 to automatically raise the dealing rack 14 to its highest position.

In one embodiment of the shuffler 10, the controller 134 may also be programmed for the hand removal mode so that in any game where the pre-game settings of the shuffler 10 are that the players and dealer are dealt different numbers of cards, the DM button 144 needs to be pressed before the dealer's hand is removed. For example, in a game where the players are each dealt three cards and the dealer is dealt five cards, the dealing rack 14 would present three cards for each player, and three cards for the dealer, but before removing these cards the dealer would hit the DM button 144, thus signaling the dealing rack 14 to present two additional cards, according to the pre-game setting, allowing the dealer to remove a complete hand of five cards. With the pre-game settings made for a game requiring that the dealer be dealt fewer cards than the players, the dealing rack 14 would lower accordingly after the dealer hits the DM button 144. As a further option for security, the controller 134 may present an additional card for the dealer, and the bottom card can be "burned," or discarded, so that the dealer's actual bottom card will not be "flashed."

The shuffler 10 can allow new interactive games in which combined hands of varying numbers of cards can instantly be provided. For example, a game might have two phases. In the first phase, each player is dealt the required number of cards. In the second phase, each player decides whether to forfeit his bet and end the hand, or to increase his bet and draw one to three cards. As each player verbally expresses a decision to draw cards or indicates a decision with hand signals, the dealer accordingly presses the DM button 144 one to three times within a programmed time, and the proper number of cards are presented to be dealt. A remote player console (not shown) linked to the shuffler 10 could also handle this task.

As another game for which the shuffler 10 would be useful, all players and the dealer may be dealt three cards, after which in a draw stage the dealing rack 14 would be raised to present from one to three cards as randomly selected by the controller 134; the shuffler 10 would be set in pre-game setup mode to present three cards to each player and the dealer, and then convert to "random" mode. In the random mode, each time the DM button 144 is pressed, the shuffler 10 randomly presents from one to three cards.

As another example, a game could include dealing each player from one to three cards, as determined randomly by the controller 134. Players would still have a chance to win with just one card—and winning with one card would garner bigger payoff—while being dealt three cards improves their chances. The shuffler 10 could easily be programmed to deal the requested number of cards to each player for such a game.

In another a game for which the shuffler 10 could be programmed, the rules would dictate that community cards, to be used by all players as in Hold'em, be presented in a number, such as from one to five cards, randomly selected by the shuffler 10. That is, the shuffler 10 can be programmed and directed by pre-game settings to present cards in random numbers.

In some card games, immediately following the shuffle and cut, one or more cards may be burned (discarded) before starting the deal. The shuffler 10 offers four burn card options: (a) no burn card (default setting); (b) burn one card, the traditional play in Blackjack, assuming the game is dealt by the shuffler 10 in hand removal mode—otherwise, it is easier just to manually burn a card; (c) burn one to ten cards in Baccarat: turn the top card face up; if that card is a 3, the dealer presses the DM button 144 three times to increment three cards, which are removed and burned; if the card is a 9, the dealer presses the DM button 144 nine times to burn nine cards; and if the card is a ten-valued card (10, J, Q, K), the DM button 144 must be pressed ten times to burn ten cards; and (d) as a correction function, should a dealer make an error, the dealer could provide a programmed signal through the DM button 144 to have an appropriate number of cards presented to be discarded, at any time during a game. Burning the first cards in Baccarat, without a card reader 180, can be done by pressing the DM button 144 accordingly, say five times, each time within a second; then after a one second delay, the dealing rack 14 would automatically increment five cards. This procedure could be automatic using a card reader 180; the dealing rack 14 would present one card as the burn card indicator that would be removed and turned face up, and then automatically rise to present the number of cards to be burned as indicated (and determined by the controller 134 based on knowing the rank of the top card). The capability to burn cards during live play has many benefits—for example, when the dealer deals past a live player, but the player insists on receiving a hand, or when a supervisor, for any reason, decides to intervene and ask the dealer to burn three cards. A supervisor could put the shuffler 10 in this special burn card mode by using the DM button 144, for example, by hitting the DM button 144 three times and holding it down until the red LED 148 is lighted. The dealer would then be instructed to hit the DM button 144 as many times as corresponds to the number of cards that are needed to rectify a situation, which are presented by the dealing rack 14 and dealt to the player. The supervisor would then again hit the DM button 144 three times and hold it down until the green LED 146 turns on, thus restoring the game to normal mode.

The shuffler 10 can be used to randomly designate where the dealing is to begin. If the shuffler 10 has been preset to deal Pai Gow Poker, once the cards have been shuffled, instead of automatically presenting seven cards, the dealing rack 14 presents a randomly selected number of from one to seven cards. These cards are removed by the dealer and spread face down in front of all to be counted. If one card is presented, the starting position for the deal is position number "1" (dealer). If two cards are presented to be spread, the starting position for the deal is position number "2" (generally the player to the dealer's immediate right). The number of cards randomly incremented (one to seven) determines the position to receive the first dealt hand. Instead of discarding these cards, they are used as part of the first dealt seven-card hand. Thus, the controller 134 of the shuffler 10 is programmed so that if one card is initially selected, the moment this card is removed from the dealing rack 14, the dealing rack 14 rises and presents six more cards to complete the first hand (seven cards) to be dealt. If two cards are initially presented, the moment these cards are removed from the dealing rack 14, the dealing rack 14 is raised to present five more cards to complete the first hand, and so forth. In the case of seven cards being initially presented, no additional cards are required for the first hand. So, from one to seven cards are initially presented to determine the player position to receive the first hand dealt, and then the number of cards needed to complete a seven-card hand are presented, if necessary, to complete dealing the hand. Once the complete first hand is removed from it, the dealing rack 14 automatically presents seven cards for each of the other hands until a predetermined delay time passes without the next hand being removed, or until the dealer hits the DM button 144 (after the last hand). Although the dealing rack 14 would have automatically presented another hand of seven cards, they will not be utilized, and the dealing rack 14 will then be raised to its highest point to present all the remaining cards for removal, to be shuffled for the next round of play.

The controller 134 may also be programmed to automatically require a deck to be reshuffled, so that in playing a single-deck game, such as Blackjack, where more than a single round may be played before reshuffling, once a predetermined number of cards have been dealt from the shuffled cards 32, when the DM button 144 is hit to signal to the controller 134 that a round is complete, the dealing rack 14 automatically rises to its highest position so that the remaining cards 32 can be removed from the dealing rack 14 to be placed into the deck-crib 12. This automatic prompt of a reshuffle can reassure players that the dealer is not choosing an advantageous time to reshuffle.

ADDITIONAL FEATURES AND OPERATION

The shuffler 10 can also be built with a dealing rack (not shown) that has movable sides. Once the shuffle is completed and dealing rack is filled and raised to its uppermost position, the ends 20, 22 may be moved apart by a motor such as a solenoid controlled by the controller 134, allowing the shuffled cards 32 to coalesce into a traditional stack ready for complete deck removal, as for dealing Blackjack and Poker. Alternatively, the stack may be raised to a required height to present only a desired number of cards that can be removed and dealt while other cards are retained in the stack.

The shuffler 10 can also be made for use in multi-deck games, such as to shuffle two to eight decks. Converting the shuffler 10 to a two-deck shuffler would require a simple modification to a taller configuration. Converting the shuffler 10 to handle four to eight decks, however, may require that the shuffler 10 be mounted to the side of the table to keep a low profile, hiding most of the vertical movement of the dealing rack. Alternatively, the shuffler 10 may be reoriented by essentially turning it on its side, to have the dealing rack 14 move horizontally, with cards standing on their sides in the deck-crib 12. Cards would then be available at a side, rather than the top, of the reoriented shuffler.

As one alternative, the deck-crib 12 and dealing rack 14 may both be rotated by ninety degrees and aligned to handle the cards in a "short end to short end" configuration thus elongating and reducing the width of the shuffler 10, although this arrangement would require each card to be moved further to clear the deck-crib 12 and occupy a receptacle 30.

The shuffler 10 can be built in a somewhat smaller version still fully capable for use for Poker. Since individual hands are not dealt from the shuffler 10 for Poker and there is no reason to facilitate the single hand removal dealing action, the motors 54 and 92 and the DM button 144 could be on the same side without making use of the shuffler 10 inconvenient for the dealer. There would be no need for the card shield 108 to be lowered for player hand presentation, and saloon-style spring-loaded swinging doors or a similar door design would therefore suffice. The DM button 144 would rarely be used and would need to show only two colors. No discard rack 126 and no internal pre-game settings switches 156, 158, 160, 162, and 164 are needed. Only 52 receptacles 30 are needed in the dealing rack 14. In short, a poker model could be stripped down to the barest minimum without giving up anything; a poker shuffler only needs to shuffle and allow for easy loading and unloading.

For such a Poker-only version of the shuffler 10, given its smaller size, a possible installation option is for the shuffler 10 to be built directly into the poker chip-tray. Since bins or holders traditionally built into poker chip-trays for two decks of cards would not be needed, the shuffler 10 could be installed in their usual place in a custom made chip-tray. The shuffler 10 could be recessed into such a chip-tray far enough that the card opening 46 of the deck-crib 12 is level with the chip-tray, directly facing the dealer's belly, conveniently available to the dealer.

Rake-slides are standard pieces of equipment found on poker tables, used to allow chips to drop into under-table drop boxes. For a casino-style Poker table, another possible installation option is to mount the shuffler 10 on a special base or add-on base (not shown) that straddles the rake-slide. This base would support the shuffler 10 above the rake-slide in an arrangement that would not interfere with the normal operation of the rake-slide.

For another embodiment, the shuffler 10 could also include a cover (not shown) movable over the open top and card removal cavity 120 and the open front of the body cover 44, to protect the front and top, perhaps contoured around the DM button 144 and arranged to slide away from the dealer automatically to extend past the machine and make the 52 shuffled cards available, after a shuffling process is complete.

In one embodiment, the shuffler 10 could be mounted in a recess or cavity defined in a gaming table. With the base 16 of the shuffler 10 sitting below table level, the blocking wall 106 and the opening 46 to the deck-crib 12 would be exposed just slightly higher than table level. This would allow the cards both to be inserted into the deck-crib 12 and removed from the dealing rack 14 practically at tabletop level, a desirable security goal that prevents flashing.

As an alternative to the drive rollers 52, a card feed belt may be used to push the bottom card of the stack 13 using an elongated "caterpillar tread" endless card feed belt with nibs that protrude by less than the thickness of a card and thus can push only one card, or that can contact the face of the lowermost card with this same tread design and one or more contact point(s) of some kind. Drive wheels for the belt may be driven by the stepper motor 54 to control the card feed belt.

The shuffler 10 may utilize video projection devices coupled with input devices for programming. For example, a standard touchpad 176 or trackpad utilizing a tactile sensor could be included in the body cover 44 of the shuffler 10 and a small aperture would allow the projection of the output on to a clipboard, screen, piece of paper, or other suitable device, allowing the pre-game settings, diagnostics, hand histories, and other tasks to be managed and viewed.

If the shuffler 10 is equipped with a card reader 180, several additional functions are possible. If a player is dealt a jackpot hand, the shuffler 10, if equipped with a card reader 180, can be programmed to redeal the cards that it had presented for the player claiming to have a jackpot hand, from the "second deck" of the batch game, or from an additional, separate deck, for a visual confirmation of the initial dealing sequence leading to a jackpot.

Figure 18:
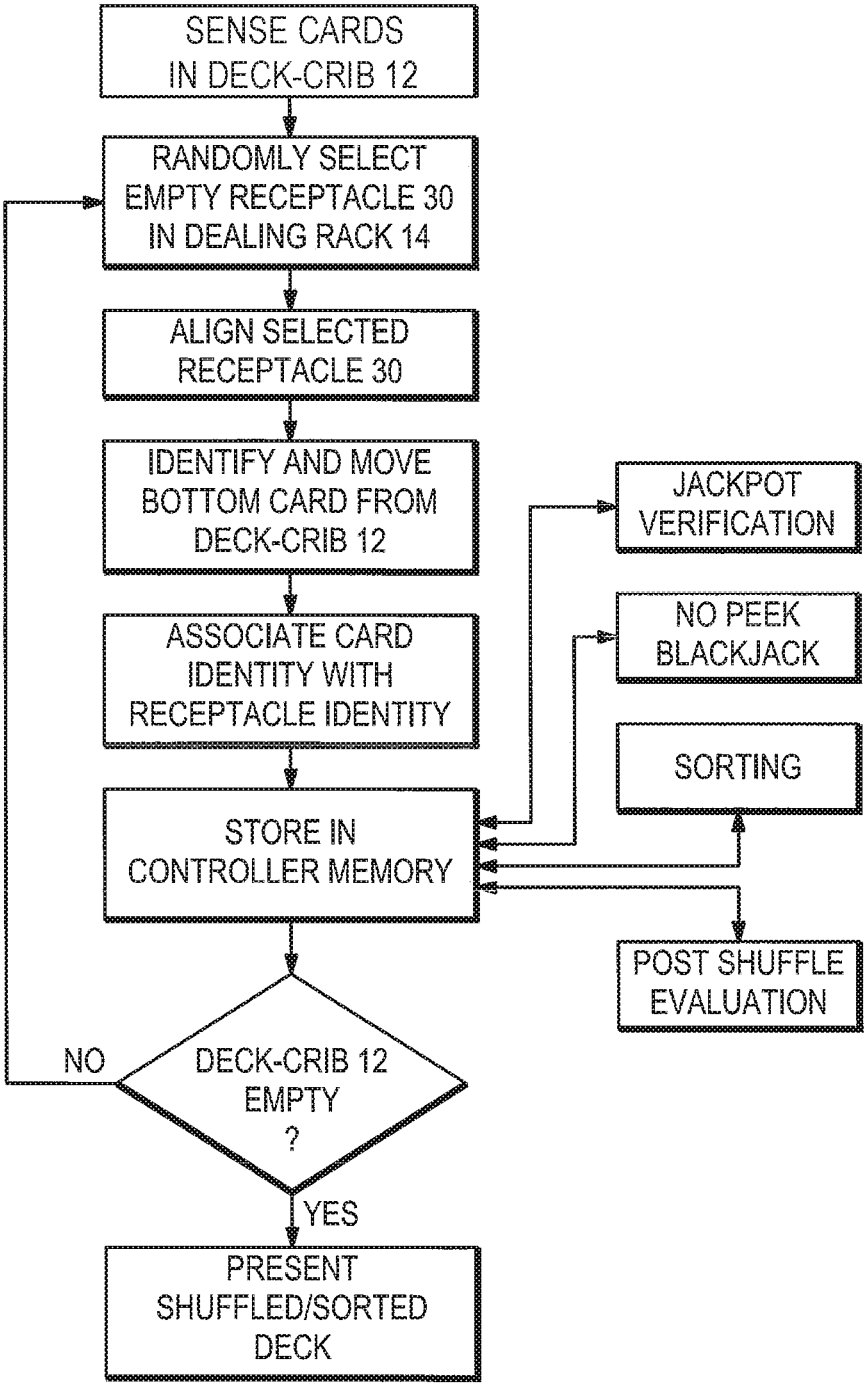
FIG. 18 is a simplified flowchart of operation of the shuffler including use of a card reader.

In an embodiment of the shuffler 10 equipped with the card reader 180, the post-shuffle position of every card 32 can be recovered from memory of the microcomputer 170 of controller 134, as shown in simplified flow diagram form in FIG. 18. During shuffling, each card is identified as it is moved to a respective randomly selected receptacle 30 in the dealing rack 14, and the location, or identity, of the receptacle 30 is associated with the identity of the card in the memory component of the microcomputer 170 in the controller 134. This means that not only can the shuffler 10 identify individual cards for deck verification, but it can also be programmed to evaluate the deck's card order after the shuffle, and to retain "hand histories" for time periods as required by governmental regulation authorities. Thus, in a game where each player is dealt five cards (standard poker rankings), software of the controller 134 could be designed to consider the suit and rank of each of the five cards in the top five receptacles 30 of the dealing rack 14 after the shuffle, the next group of five cards, the next group of five cards, etc. Should a player hit a jackpot, to verify that everything is legitimate, the supervisor could ask the dealer to hit the DM button 144 in a prescribed pattern, such as three times. The controller 134 can be programmed so that if the green LED 146 starts rapidly blinking it means that a jackpot hand was "present" in the last shuffled order. The controller 134 could also be programmed to have the green LED 146 blink slowly to show the number of players needed for the cards dealt to include a jackpot hand. If the red LED 148 starts rapidly blinking, there is a problem, as the shuffler 10 is indicating that there was no jackpot hand in the last shuffled order.

In the game of Blackjack, the players and dealers are dealt two cards with one of the dealer's cards dealt face up (upcard) while the other remains face down (hole card). To prevent or detect cheating, devices are utilized to determine the value of the hole card when Blackjack is possible, that is, any time the upcard is an Ace or a card with a value of 10. When the shuffler 10 is equipped with a card reader 180, the controller 134 can be set up to memorize the location of each card as it is placed into dealing rack 14, and the shuffler 10 can eliminate the need for the separate peeking devices currently in use. Using the "no-peek" capabilities of the shuffler 10 requires that the card reader 180 be capable of determining the rank of the cards and requires the shuffler 10 pre-game settings to provide for hand removal mode and dealing the cards to the players and the dealer from the dealing rack 14, presenting two cards together for each player and the dealer.

Traditionally, the first card dealt to the dealer by hand is the "upcard," but a safer procedure for using the shuffler 10 is to reverse the roles of the dealer's cards and have the upcard be the lower one of the two cards removed from the dealing rack 14. Since it will be turned face up anyway, exposing the bottom card of a pair being removed from the dealing rack 14 is irrelevant, and the bottom card hides the identity of the top card.

Each round of Blackjack play consists of two phases. The first phase consists of dealing two cards to each player and the dealer, and the dealer turning the lowermost card face up. The second phase is the decisional phase where players can hit, double, and split; this phase ends with the dealer drawing to his or her hand if required by the house rules.

After two cards have been presented by the shuffler 10 and dealt to all players and the dealer, the dealing rack 14 will automatically and instantly rise to present two additional cards, as the dealing rack 14 does not know how many players are present. With the controller 134 appropriately programmed, a two-second delay during the deal without the removal of these two next cards will signal the controller 134 that the initial phase is over (players and dealer have all been dealt two cards).

At the end of the initial phase, signaled by the above-mentioned two-second delay after the dealing rack 14 has presented two additional cards, the dealing rack 14 will then automatically prepare for the next phase, by moving down by one single-card receptacle 30, leaving only a single card available to the dealer for the decisional phase where the cards are dealt one at a time, if the dealer's upcard face value is anything from 2 to 9.

When the dealer's upcard is a ten-valued card (10, Jack, Queen, or King) the dealer is required to "peek," that is, to determine immediately whether the dealer has blackjack; when the dealer's upcard is an ace, the dealer is required to first offer insurance to the players before peeking for a blackjack.

Since the controller 134 has available in the memory of the microcomputer 170 the post-shuffle card order and how much the dealing rack has moved since the shuffle, it knows how many hands have been dealt. If the dealing rack 14 rose five times, the controller 134 knows that there are three players, the dealer, and one additional rejected presentation of two cards. Consider the following post-shuffle sequence: 2-5, 7-A, 4-J, 6-K . . . .

Once the shuffler 10 determines the number of players in the game, it looks at the sequence and sees that the dealer has a K (king) in the upcard position and a 6 in the hole. Since the dealer does not have blackjack, play continues normally following the two-second delay, and the controller 134 may provide a signal to all, such as the DM button green LED 146 blinking three times for "GO" to signal this status.

Now consider the following sequence: 2-5, 7-A, 4-J, A-K

This time the dealer has blackjack (King upcard and Ace in the hole) so play must stop; the hand is over and the dealer must turn over the holecard to reveal the blackjack. In this case, once the microcomputer 170 considers the dealer's hand the controller 134 provides a signal such as the DM button red LED 148 blinking red three times for "STOP."

In all rounds where the dealer's upcard is an Ace, insurance must be offered to the players, a process that can take several seconds. The controller 134 should be programmed so that when the dealer's upcard is an Ace, after all players have made their decisions regarding insurance, the dealer must hit the DM button 144 to ask the controller 134 for the dealer's status; specifically, is the holecard a ten-valued card? Only when the dealer has an upcard Ace would the shuffler 10 need to be prompted, as all other blackjack combinations (ten-valued upcard) are handled automatically and without interaction from the dealer.

As the players hit, double, and split, one card is dealt per player decision. After the last player has acted, the dealer's hand is revealed and additional cards are drawn to the dealer if required by the rules. The controller 134 may be programmed so that the end of the round can be signaled to the controller 134 by the dealer hitting the DM button 144 as the played cards are scooped and placed in the discard rack 126 or deck-crib 12. As this occurs, the dealing rack 14 would already have a single card presented, but hitting the DM button 144 signals the controller to cause the dealing rack 14 to rise to also present another card so that two cards are ready for removal to begin the next round.

The shuffler 10 can also be used to sort a deck to facilitate confirming that it is complete, by placing the shuffler 10 into the required mode and placing a randomly ordered deck into the deck-crib 12. The card reader 180 identifies the bottom card and always places it in the top receptacle 30, barely requiring the dealing rack 14 to move as it begins to shuffle or sort already in the lowermost, home position. For example, assume the bottom card is the six of diamonds. Then assume the next card happens to be the ten of clubs; it is placed in the 5th receptacle 30, leaving the 2nd, 3rd and 4th receptacles 30 open for the other sixes. The next card up is the ace of spades. It is placed in the 9th position, leaving the 6th, 7th, and 8th receptacles 30 for the other tens. If the next card up is one of the remaining sixes, it goes to the 2nd receptacle 30, and if the next card is one of the remaining tens, it goes to the 6th receptacle 30, and so on. When the process is complete, the deck will have been sorted into groups of equal ranks, but in no particular order or sequence of ranks. When sorted and grouped by rank, and in no particular order of ranks, it is just as easy to verify a complete deck as when sorted into a new deck sequence. Cards can be sorted into any other desired, more or less specific, sequence as well. For example, the cards could be sorted to a "new deck" order, or sorted into groups according to rank, as all aces, all kings, etc., through all deuces, but without considering suit order in each rank.

As a security tool to detect wagering opportunities for card counters, the shuffler 10 can use the location of each of the shuffled cards 32, identified by the card reader 180 and with identity and post-shuffle location stored in digital memory by the microcomputer 170, to evaluate the entire post-shuffle order before the first card is dealt. As a security assurance feature, the shuffler 10 can evaluate the entire shuffled deck by utilizing the card location information in the digital memory of the microcomputer 170 to inform the pit or house surveillance personnel of impending "rich decks" (i.e., containing more tens and aces then usual and therefore providing mathematical advantages to card counters) long before they occur, giving house management a chance to direct their attention accordingly, before play with the rich deck happens instead of having to wait until it happens. This can make a significant difference, as every card room supervisor is responsible for watching multiple games, every surveillance operator is responsible for watching multiple monitors, and such advance notice can help with time management.

Knowledge of the entire post-shuffle card order can also be used for new games on which players can gamble. For example, a single-deck game could have the players bet on the number of aces that will appear in the first 20 cards. The controller 134 could be programmed so that after the shuffle, if all four aces happen to fall in the first 20 cards, the DM button 144 would flash four times, alerting players to this fact. If only three aces happen to be in the first 20 cards, the DM button 144 could flash three times, and so on. Depending on the number (from zero to four) of aces randomly shuffled into the top 20 cards, the game could have five different paths, based on knowledge of the shuffled order, and each path could offer a different wagering opportunity. This is an example of a game that depends on knowledge of the post-shuffle card order, and is thus an example of a game that could be dealt by the shuffler 10 including a card reader 180.

Computer-related image recognition technology such as the Tangam System is used in casino surveillance systems to identify the cards as they are dealt, number of active players in a hand, player ID cards, markers, etc. This technology, including cameras in surveillance or some other viewing structure, connected to the shuffler 10 via a standard wireless or hard-wired link, could be used to control certain aspects of the shuffler 10, resulting in a remote control shuffling platform/format. For example, in a game where the dealer and players receive different numbers of cards, the controller 134 would be signaled in advance how many players are to be dealt hands, and could automatically adjust the dealing rack, without dealer intervention, to present the correct number of cards to the dealer at the appropriate time. Other advantages are possible. Utilizing such a system to control the shuffler 10 would eliminate the need for any input from the dealer. Systems such as Tangam use camera imaging and video recording to reconstruct everything that happens on a game.

The shuffler 10, equipped with a card reader 180, could handle all televised poker games, or other games, and the resulting combined system would be capable of handling any number of players, any rules, or any procedural oddities, while achieving the same audience viewpoint without a special camera-table. A single camera or the card reader 180 built into the shuffler 10 could replace two to eleven cameras used currently for televising players' hands, and televised Poker and other games where players hands are normally hidden from each other could be played on any table and broadcast accordingly.

The shuffler 10, in one embodiment, could include a simple digital signal hookup from the controller 134 to a properly programmed computer in a control station. This could not only provide a more contemporaneous, efficient way to observe and record the proceedings during these games, it could provide perspective never seen before, as the shuffler 10 would be able to display all possible results, including hands that are not played out. For example, a player discarding his hand before the last card is dealt will often ask the dealer to turn over the last card just to see what would have happened. Though this custom is generally frowned upon, the shuffler 10 could handle such a request with ease and without actually exposing the card, simply by referring to the order of shuffled cards 32 stored in memory in the controller 134.

Pai Gow Poker is a popular Asian game played in most casinos. The players and the dealer are each dealt seven cards. Players arrange their cards into two poker hands: a five-card hand and a two-card hand. The most important rule governing play is that the five-card hand must always be the higher ranking hand (traditional poker rankings apply). After the players set their hands, the dealer flips his cards face up and sets the hand according to house rules. If both of a player's hands win, the player wins; if both of a player's hands lose, the player loses; and winning one hand while losing the other results in a tie (called a "copy"). Should the player's hand and the dealer's hand rank equally, the house wins.

In Pai Gow Poker, the dealer's hand of seven cards is dealt and ordinarily arranged by the dealer according to house rules after being turned face up. This can take several steps depending on the complexity of the hand. For example, consider a very simple hand A-A-K-9-8-5-4 and a corresponding house rule. House rules may dictate that for any hand with one pair, the pair must be played in the five-card hand (referred to as the "high hand" or "back hand"), and the two highest non-pair cards must be placed in the two-card hand (referred to as the "low hand" or "front hand"). According to these house rules, this hand would be arranged: A-A-8-5-4 K-9.

In a less simple hand with two pairs and a spade flush: As, Js, Jd, Ts, Th, 6s, 3s, the house rule is always play a flush in back (the five card hand) unless you have two pairs and both are tens or higher, then play two pairs (one pair in the front hand and one pair in the back hand). According to house rules, the spade flush is not played and the hand would be arranged: Js-Jd-As-6s-3s Ts-Th. The casinos want to bring the strength of the two hands as close together as possible as this produces higher average front and back hands, and has been shown to be most profitable, since to win a round both parts of the hand must win. Playing the flush in the back hand leaves Jd-Th for the front hand, a very weak, overall losing front hand.

The microcomputer 170 of the shuffler 10 equipped with the card reader 180 can be programmed to arrange the dealer's hand according to the house rules. Where the dealer has little experience dealing Pai Gow Poker, this could be very helpful. The arrangement of the dealer's hand according to house rules may be presented by the properly programmed shuffler 10 by keying on the two cards that will be played as the front hand, and having the dealing rack 14 present the hand in steps, if necessary, of from one to three raises of the dealing rack 14, then removing and stacking the cards into the proper arrangement. For example, with the dealer's hand consisting of seven shuffled cards 32 lying in the top seven occupied receptacles 30 in the dealing rack 14, the shuffler 10, because of the card reader 180, knows the order of the cards and knows how the dealer's hand should be arranged according to the house rules. In the simplest case, if the two "front" hand cards are presented in the first and last positions (cards number 1 and number 7 from the top of the dealing rack 14), the dealer's entire seven-card hand can be removed in a single group, resulting in the desired order F-X-X-X-X-X-F ("F" refers to cards in the front hand).

If the two front cards randomly fall together, but lie in any other position, the dealer's hand can be dealt in two steps by simply raising the dealing rack 14 in the first step to present enough cards to include, as the bottom card presented in the dealing rack 14, the uppermost front hand card of the dealer's seven-card hand. That group of one to six cards is removed from the dealing rack 14 and dropped face down on the table. The dealing rack 14 is then raised to present the remaining one to six cards needed to complete the dealer's seven-card hand. These cards are removed and dropped on top of those cards previously removed, still face down, so that the second front hand card will be at the top of the dealer's seven-card hand as it will be stacked on the table face down. For the dealer's hand X-X-F-F-X-X-X, as in the top seven occupied receptacles 30, the dealing rack 14 would thus first present XXF, followed by FXXX, resulting in the hand finally being stacked on the table in the order: F-X-X-X-X-X-F.

Even when the front hand cards are separated, the controller 134 can cause the shuffler 10 to present them so as to result in the desired order when stacked. For X-F-X-X-X-F-X, the dealing rack 14 would present XF, followed by XXX, followed by FX, resulting in the order: F-X-X-X-X-X-F. For X-X-X-X-F-X-F, the dealing rack 14 would present the cards XXXXF, followed by X, followed by F, resulting in the order: F-X-X-X-X-X-F when the three presentations are stacked on the table.

In these examples, the two front hand cards always end up on the top and bottom of the dealer's hand as stacked on the table. In this arrangement, the dealer can take the top card, slide it under the other six cards, and then turn the entire seven-card hand face up. When the seven cards are then spread from left to right, the two cards furthest to the right will always be in place to be played up front according to house rules. The same principles could apply to arranging a dealer's hand in a required order for other card games.

In Poker, the dealer would remove the entire deck from the dealing rack and cut it by hand (about half the deck is cut to the cut-card and the remaining half is placed on top to complete the cut). If cutting only one card were permissible, a random cut produces one of 51 possible orders. But with the identity of just a single card exposed at a predetermined position in the hand communicated to the controller 134, the card's position and identity reduces the possible orders to only ten in Hold'em (from two to eleven players), or seven in Stud (from two to eight players), etc.

Assume a Hold'em game with a "bad-beat" jackpot (for example, two players split the jackpot when one has four of a kind and loses to a straight flush or higher). Assume the "river" card, the last card dealt in Hold'em, is the exposed card or "key-card." If this card happened to be the ace of spades, the shuffler 10 could reconstruct the orders for two to eleven players given the position of this card. With two players, the ace of spades had to be the 12th card in the post-shuffle order since each player is dealt two cards, the board (cards face up on the table) consists of five cards, and there are three burned cards. For three players, the ace of spades had to be the 14th card in the post-shuffle position, and so on. With knowledge of the identity and location of a single card (played or unplayed), it is possible to "back up" and reconstruct the hands for two to eleven players. To provide a requested jackpot confirmation, the dealer could, for example, press the DM button 144 three times, or as otherwise programmed, to place the shuffler 10 into the jackpot verification mode, and if a jackpot hand was identified, the DM button 144 would flash a signal, for example, rapidly blink the green LED 146 for a second or two, stop for a second or two, and then slowly blink two to eleven times to indicate the number of players that must be present for the jackpot to be valid.

With the capability of the shuffler 10 to record in memory the entire post-shuffle order of the shuffled cards 32, it is possible to use this capability to verify a jackpot hand even in games where the cards are cut randomly after the shuffle, by the players (Blackjack), or dealer (Poker), so long as the identity of a key card can be verified and communicated to the microcomputer 170.

The rank and suit of the river card, or any other key card that would provide the shuffler 10 a reference point, may be entered into the microcomputer 170 through a keypad 184, either incorporated in the shuffler 10 or provided separately and connected through a suitable digital communication cable or wireless connection. Identification to the controller 134 of a single card in a key position allows confirmation that a jackpot hand was present in the post-shuffle card order.

Also using the keypad 184 (see FIG. 2) to enter the number of hands dealt in a particular round into the microcomputer 170 allows the lone applicable jackpot hand to be verified.

As can be understood from the foregoing, the shuffler 10, particularly when equipped with a card reader 180, is very versatile and flexible. By use of suitable programming of the microcomputer 170, the shuffler 10 can be set up, by use of suitable patterns of numbers and durations of pushes on the DM button 144, to select among various options at several levels. The shuffler 10 can thus be set for use simply to shuffle a deck to be dealt from the dealer's hand or so that the shuffler 10 can present the cards for complex games such as Pai Gow Poker, as outlined below. Thus, with a programmed sequence of pressing the DM button 144 to enter the desired pre-game settings mode, a desired setting can be entered for various options within a category by pressing the DM button 144 a corresponding number of times within an available time such as two or three seconds. A list of some possible categories of set-up options in a possible order of entering selections to set up the shuffler 10, and related options within categories follows:

Shuffle (In each category of setup options, for example, to select an available option from the following choices the supervisor would press the DM button 144 one, two, three, or four times.)

(1) two-deck batch (default),
(2) one-deck—traditional,
(3) one-deck—incremental,
(4) one-deck—continuous;

Cutting the Cards (1) no cut (default),
(2) shuffler randomly cuts the cards,
(3) interactive player cut;

Burning a Card(s)

(1) no burn cards (default),
(2) one burn card—Blackjack,
(3) one to ten burn cards as indicated by the top card—Baccarat;

Dealing Starting Position (1) traditional deal—always start to the dealer's left (default), (2) randomize the position of the starting hand in Pai Gow Poker;

Dealing Direction (1) traditional—clockwise (default), (2) Asian style—counterclockwise;

Dealing Sequence (Novelty Games—Hand Removal Mode Only)

(1) number of cards in players' hands, (2) number of cards in dealer's hand, (3) if required, number of cards in additional betting round number "1", (4) if required, number of cards in additional betting round number "2", (5) if required, number of cards in additional betting round number "3", (6) any game with a random deal or phase as directed by RANDOM MODE;

Dealer's Hand (1) no special arrangement of dealer's hand (default), (2) arrangement of dealer's hand according to house rules for Pai Gow Poker (using an included card reader 180), (3) no-peek Blackjack (using an included card reader 180);

Automatic Shuffle Up (1) dealer uses DM button 144 to raise dealing rack 14 to remove cards for the next shuffle (default), (2) automatically raises the dealing rack 14 after round including the 26th card presented, (3) automatically raises the dealing rack 14 after round including the 34th card presented, (4) automatically raises the dealing rack 14 after round including the 40th card presented;

Random Mode (1) sets the number of cards or range of numbers of cards to be presented to the players, (2) sets the number of cards or range of numbers of cards to be presented to the dealer, (3) if required, sets the number of cards or range of numbers of cards to be presented in additional betting round number "1", (4) if required, sets number of cards or range of numbers of cards to be presented in additional betting round number "2", (5) if required, sets number of cards or range of numbers of cards to be presented in additional betting round number "3";

Security Modes (1) normal pre-game settings (default), (2) fake insertion mode, (3) extra card dealt to dealer's hand, (4) dealer's hand not dealt until all players have acted, (5) fake insertion mode AND extra card dealt to dealer's hand, (6) fake insertion mode AND dealer's hand not dealt until all players have acted;

Additional Game Features (1) no special features (default), (2) jackpot query, (3) jackpot redeal, (4) sorting, (5) predeal deck composition evaluation, (6) dynamic game dealing.

Multi-Deck Embodiment

As mentioned briefly above, the shuffler 10 can be made for use in multi-deck games, by modifying the dealing rack 14 to include a larger number of single-card receptacles 30. Because of the resulting increase in height of the shuffler 10, however, it may instead be desirable to move the dealing rack 14 to a horizontal orientation, for shuffling two or more decks of cards 32 together.

In a multi-deck shuffler 210 shown in FIGS. 19-26, there is a deck-crib 212 that moves relative to a receiving rack 214, similar to the dealing rack 14 of the shuffler 10, but not actually used for dealing in this shuffler 210, with the receiving rack 214 oriented at 90 degrees from the arrangement of the dealing rack 14 in the shuffler 10, so that cards 32 in the deck-crib 212 and the receiving rack 214 are on edge in a horizontal stack. The multi-deck shuffler 210 includes a base 216 supporting a frame 218 of the receiving rack 214. The receiving rack 214 is larger than the dealing rack 14 of the shuffler 10 and has sufficient single-card receptacles to receive several standard decks of cards. For example, in the shuffler 210 as shown herein, there may be 314 individual single-card receptacles 220, in order to receive six decks of playing cards 32, as well as a pair of cut cards 222, with all of the playing cards and cut cards 222 on edge and their planar surfaces facing one another. The frame 218 of the receiving rack 214 is mounted fixedly on the base 216, and the deck-crib 212 is arranged to be moved along the receiving rack 214 as required to place individual ones of a group of cards being shuffled into randomly selected single-card receptacles 220, as will be explained subsequently.

In the multi-deck shuffler 210 as illustrated each playing card 32 and cut card 222 is held on edge, with one of its longer side edges down and with the shorter top and bottom edges of each card 32 extending vertically, although the cards could be arranged with their top or bottom edges down and their side edges extending vertically. The orientation shown in the drawings results in the multi-deck group of shuffled playing cards being presented in the conventional orientation used in a card-dealing shoe in casinos.

Figure 19:
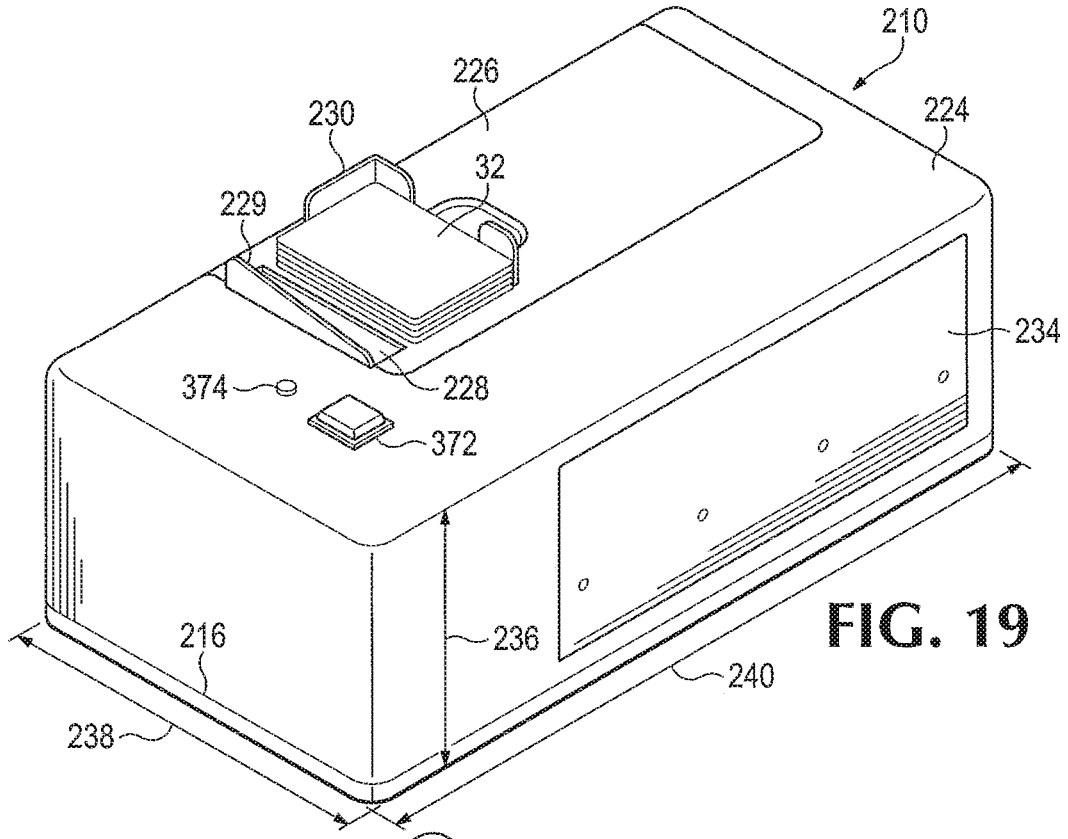
FIG. 19 is an isometric view from an upper left front of a card shuffler for producing a shuffled group of several decks of cards.
Figure 20:
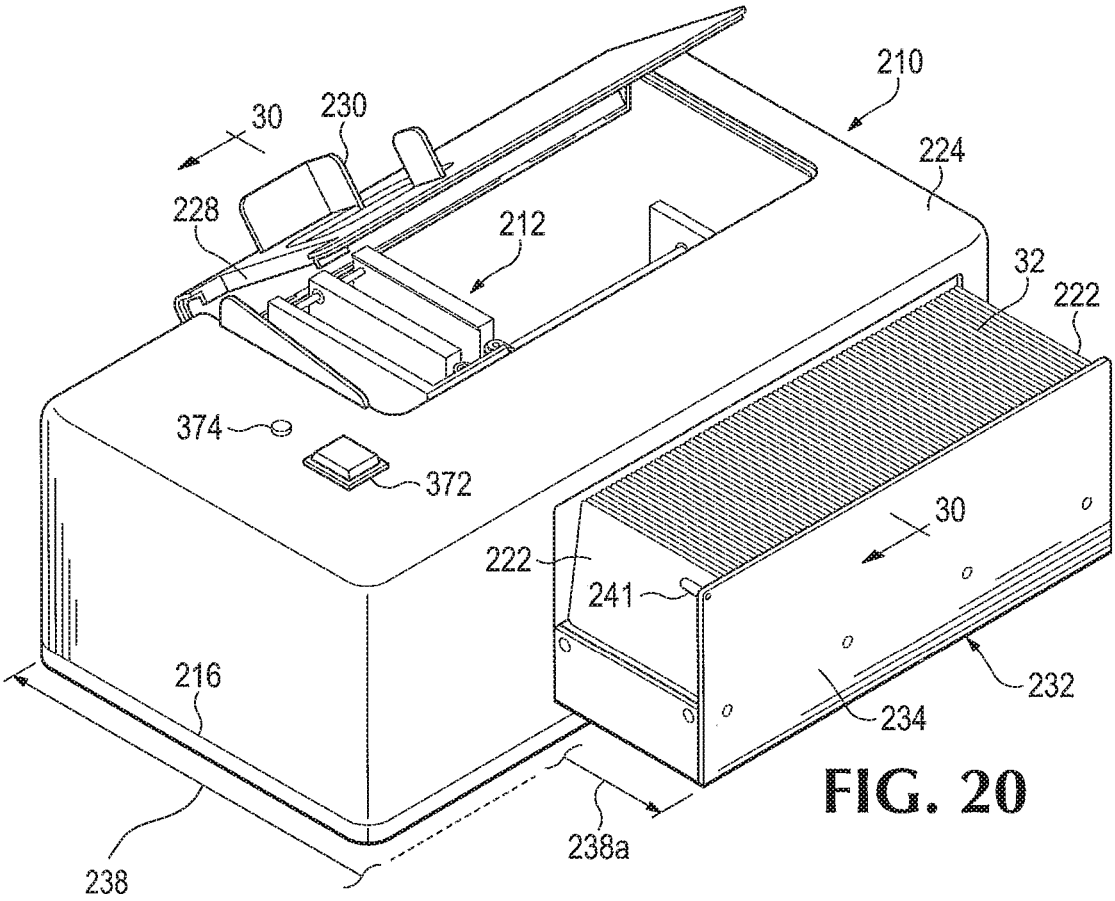
FIG. 20 is an isometric view similar to that of FIG. 19, but showing an access cover open and a card presentation tray, from which a group of shuffled cards is ready to be removed, in an extended position.

As shown in FIG. 19, the multi-deck shuffler 210 includes an outer or main cover 224 to which an access cover 226 is attached, as by hinges, so that it may be raised as shown in FIG. 20 to provide access to the deck-crib 212. An opening 228 is defined by the access cover 226, to permit groups of playing cards 32 to be inserted through the opening 228 into the deck-crib 212, to be shuffled. A fin-like bumper 229 extends upward on the main cover 224 along the opening 228 to protect cards from being exposed to view.

A discard rack or tray 230 may be located on the top of the access cover 226 adjacent to the opening 228, and a depressed area may be provided in the top of the access cover 226 adjacent and extending underneath the discard tray 230 to facilitate picking up cards from the discard tray 230.

A card presentation tray 232, a portion of the receiving rack 214, has an outer wall 234 that is part of the front side of the shuffler 210, as may be seen best in FIG. 20. The height 236 of the multi-deck shuffler 210, not including the discard tray 230, may be, for example, about 5.5 inches, less than three times the width of a playing card, and the shuffler 210 is thus unlikely to interfere with the dealer's or a supervisor's view of the playing table when the multi-deck shuffler 210 is in a normal location to the right of the dealer. The depth 238 of the shuffler 210, with the card presentation tray 232 retracted as shown in FIG. 19, may be, for example, about 8.5 inches, or less than three times the length of a playing card. The width 240 of the shuffler 210 depends upon the number of cards for which the receiving rack 214 is designed, and in the embodiment shown in the drawings of this application, in which the receiving rack 214 is designed for six decks of playing cards 32, the width 240 may be about sixteen inches. Including the card presentation tray 232 extended as shown in FIG. 20, the depth 238*a* of the multi-deck shuffler 210 may be, for example, about 12.5 inches. The depth 238 of the shuffler 210 between the dealer and the shuffled playing cards 32 may be about 8.3 inches. The size of the shuffler 210 is thus small enough not to intrude excessively.

The multi-deck shuffler 210 is intended to shuffle six decks of playing cards into a single randomly shuffled arrangement of 312 cards, and to do so with a minimum delay of playing by shuffling six or more smaller increments of a large group of cards 32 sequentially before presenting the entire group of shuffled cards. The resulting multi-deck group of shuffled cards 32 is thus equally as randomly arranged as would be the case if all 312 cards had been shuffled simultaneously in a single operation. Since in multi-deck systems of play the tail end of a shuffled multi-deck group of cards is usually not played, that portion of the shuffled multi-deck group of cards can be put back into the shuffler 210 and shuffled even before beginning to deal from the front end, and the cards 32 from each round of play can be shuffled while play continues using remaining ones of a previously shuffled large group of shuffled cards 32. The shuffling operation, while not continuous, is equally as random in the eventual placement of each card 32 into the receiving rack 214 as though all 312 cards 32 were placed into the deck-crib 212 at one time. Use of a deck-crib 212 of a smaller size, however, allows the multi-deck shuffler 210 to have a smaller overall size, since a larger deck-crib 212 would require a greater width 240.

Once the entire group of several decks of cards has been shuffled, the card presentation tray 232 is extended to the position shown in FIG. 20, and the shuffled cards, no longer separated from each other in the single-card receptacles 220, may be removed manually from the card presentation tray 232, as by simply sweeping them together horizontally toward the far, or left, end of the card presentation tray 232. A finger 241 on the upper left corner of the outer wall 234 makes the cards 32 lean toward the opposite, right, end of the presentation tray 232 as it is moved. The shuffled cards 32 may, for example, be removed onto the table top, into a dealing shoe, or onto a ramp that might be attached to the base 216 of the multi-deck shuffler 210 or attached to the card presentation tray 232 and movable along with it. A mechanical pusher could be provided to push the shuffled cards together and toward one end of the card presentation tray 232, if desired, although such additional attachments and mechanisms are not essential to the present invention and are therefore not depicted in the drawings nor described in detail.

Referring to FIGS. 21-26, in which the main cover 224 and the access cover 226 have been removed, the base 216 supports the frame 218 of the receiving rack 214. A top member 242 of the frame 218 supports divider leaves 244 in the form of thin, planar leaves extending downwardly by a height of about 1.75 inch, or about ¾ of the width of a playing card 32. The top member 242 has a length determined by the number, thickness, and spacing of the divider leaves 244 defining the single-card receptacles 220, and each leaf 244 has a front-to-rear depth 248, which may be less than the length of a playing card, yet should be great enough to align each playing card 32 in one of the single-card receptacles 220 so that the shuffled cards are parallel with one another. For example, the front-to-rear depth 248 may be about 1.9 inches, or about one-half the length of a playing card 32. The divider leaves 244 may have thicknesses and be of material similar to those of the partial shelves 26 and 28 (FIG. 6) of the shuffler 10 (FIG. 1), and may be similarly spaced apart, but may also be thinner, for example, having a thickness of about 0.010 inch, as they are not required to support the weight of a card 32.

A rear face 250 of the receiving rack 214 may be defined by the rear margin of the top member 242 of the frame 218 and the vertical rear edges of the divider leaves 244. The rear edges are all aligned with and coplanar with each other, in a vertical plane extending parallel with the width 240 of the shuffler 210, slightly forward of the midpoint of its depth 238.

The deck-crib 212 is supported for movement parallel with the rear face 250 of the receiving rack 214, through a range allowing a card mover portion of the deck-crib 212 to place a card 32 into any of the single-card receptacles 220. The deck-crib 212 is supported by and slides along a guide rod 252 that extends parallel with the rear face 250, supported by a pair of upstanding end walls 254 and 256, and is also supported, and moved, by a lead screw 258 that extends parallel with the guide rod 252 and is supported for rotation in suitable bearings in the end walls 254 and 256.

Figure 21:
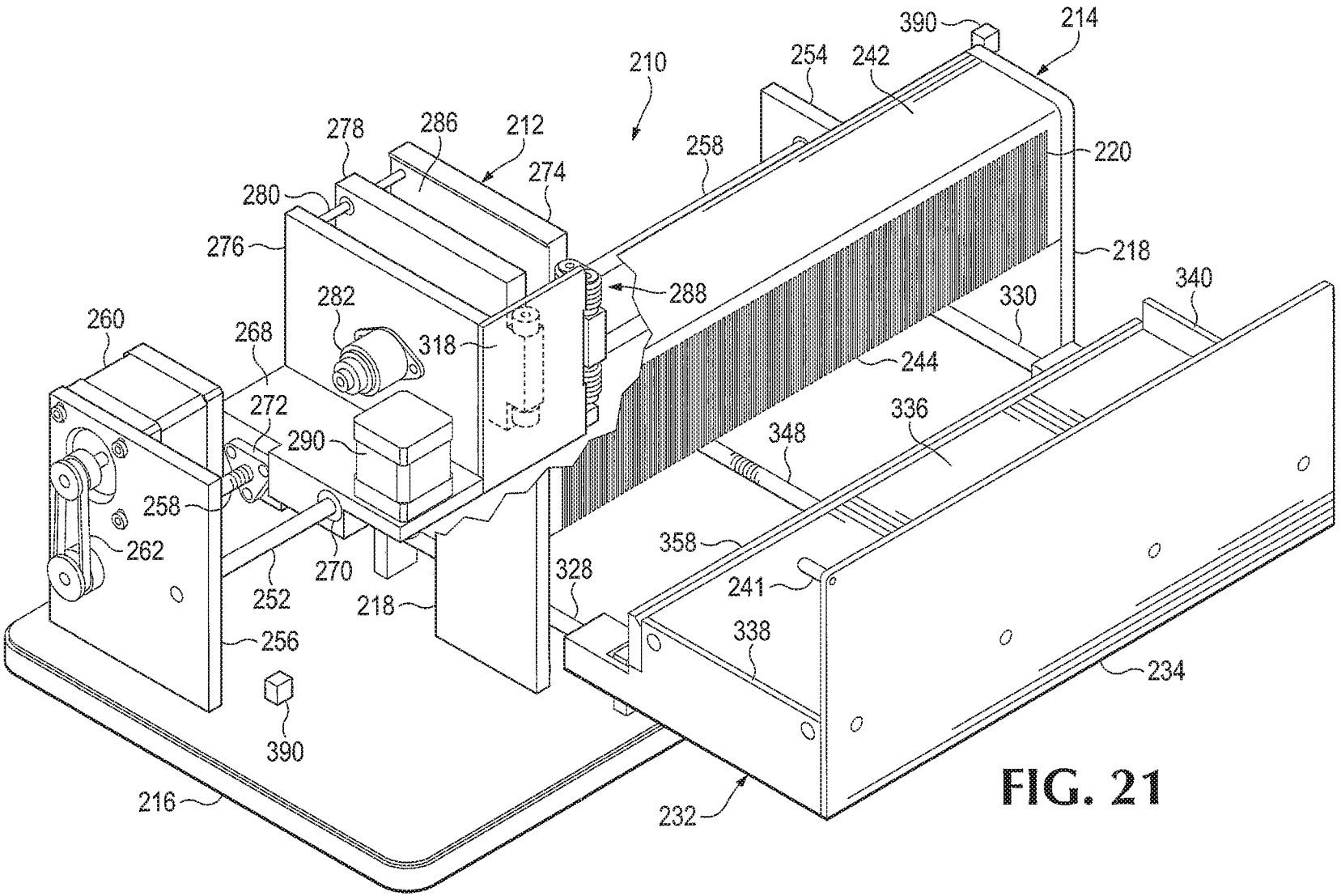
FIG. 21 is an isometric view taken in the same direction as FIG. 20, but with the covers removed from the shuffler and with no cards in the card presentation tray.

Mounted on the end wall 256 and with its shaft extending through an opening defined in the end wall 256 is a stepper motor 260, such as a stepper motor, arranged to drive the lead screw 258 through an endless belt 262 and corresponding pulleys, as seen best in FIG. 21. The lead screw 258 moves the deck-crib 212 along the receiving rack 214 to align it with a selected single-card receptacle 220.

The deck-crib 212 includes a generally horizontal base portion 268 having a generally planar upper surface and including bearings 270 disposed around the guide rod 252 to keep the base portion aligned with it. A drive nut 272 is engaged with the threads of the lead screw 258, so that when the stepper motor 260 rotates the lead screw 258 the deck-crib 212 is moved along the guide rod 252.

A planar end member or wall 274 of the deck-crib 212, corresponding with the bottom member 38 of the deck-crib 12 in the shuffler 10 described previously, extends upward from the right end of the base 268. An upright planar member or wall 276 is mounted on the base 268 parallel with the end member 274 and spaced apart from it toward the opposite, or left, end of the base 268. A planar deck follower 278 is mounted to slide on a pair of horizontal guide rods 280 supported by and extending between the end member 274 and the upright planar member 276. A precisely controllable motor 282, which may be a linear actuator stepping motor, may be mounted on the upright wall 276 and is connected with the deck follower 278, to move the deck follower 278 toward and away from the end member 274. A pressure sensor 284 is arranged to measure the force used to urge the deck follower 278 toward the upright planar end member 274. The motor 282 is controlled to provide an appropriate amount of pressure to urge a group of playing cards 32, held in a space 286 between the deck follower 278 and the upright planar end member 274, toward each other and toward the end member 274, to permit a card mover mechanism 288 to move the individual card 32 that is closest to the planar end member 274, referred to for convenience as the bottom card, from the deck-crib 212 into a selected one of the single-card receptacles 220 with which the deck-crib 212 is aligned.

The card mover mechanism 288 includes a motor such as a stepper motor 290 mounted on the base 268 of the deck-crib 212. Two sets of frictional drive members 292 and 294, which may be O-rings of a suitable elastic material such as a silicone rubber, are located near the front portion of the fixed upright end wall 274 of the deck-crib 212. The frictional drive members 292 and 294 have driving surfaces facing toward the card or deck follower 278 and protruding slightly beyond the plane of the end wall 274, similar to the drive rollers 52 of the shuffler 10, for example, protruding about 0.030 inch. The frictional drive members 292 and 294 extend around respective sets of pulleys 296 and 298 carried on an idler shaft 300, and respective sets of pulleys 304 and 306 carried on and driven by a card mover drive shaft 302. The shafts 300 and 302 are parallel and are arranged for the drive shaft 302 to drive the frictional drive members 292 and 294. The frictional drive members 292 and 294 thus can engage a card 32 along driving surfaces that are as long as the center-to-center spacing between the shafts 300 and 302. The drive shaft 302 extends downward through bearings mounted in the base 268 of the deck-crib 212. The motor 290 has a rotating shaft extending vertically downward through an opening through the base 268. A driven pulley 308 mounted on the lower end of the drive shaft 302 is driven by a belt 310 driven by a pulley 312 on the shaft of the card mover motor 290.

A pair of idler rollers 314 are carried on a shaft 316 mounted in the forward portion of the sliding card or deck follower 278. The idler rollers 314 are aligned with and located opposite the frictional drive members 292 and 294, protruding radially beyond the surface of the deck follower by a small distance, similar to the idler rollers 66 of the shuffler 10 (FIG. 7), and are free to rotate as driven by the card mover frictional driving members 292 and 294 or by movement of a playing card between them and the idler rollers 314.

A deck-crib front plate 318 is upright and perpendicular to the end wall 274 and upright wall 276 and is attached to the base 268 and the upright wall 276, so that they can support each other as a rigid assembly. The front plate 318 acts as a card stop, similar to the card stop wall 58 of the shuffler 10 described above, and includes a right end face 320 located so that together with the frictional drive members 292, 294 it defines an outfeed or card transfer slot 322 having a gap width 324 similar to the gap height 64 of the shuffler 10, large enough to permit only a single card to pass out through the card transfer slot 322 at one time, from the space 286 between the end member 274 and the sliding card follower 278. A portion 325 of the end face 320 may be indented so as to avoid friction caused by contact with a card 32 passing through the outfeed or card transfer slot 322.

The front plate or card stop 318 is spaced apart from the rear edges of the divider leaves 244 of the receiving rack 214 by a gap 326, equivalent to the gap 35 of the shuffler 10 and which may be of a similar size, such as in the range of 0.020-0.25 inch, or more preferably 0.020-0.090, or about 0.040 inch, so as to optimize the distance through which a card 32 must be moved.

The card presentation tray 232 is located beneath the array of single-card receptacles 220 of the receiving rack 214 and is movable from its retracted position, shown in FIG. 19, where it is located during the process of shuffling cards, to a card presentation position shown in FIG. 20, by moving along a pair of support rails 328 and 330, which may be rods extending forward from uprights 332 mounted on the base 216 beneath the deck-crib 212 to uprights 334 mounted near the front of the base 216. The card presentation tray 232 includes a rigid, planar, horizontal bottom member 336 extending between and supported by end walls 338 and 340, above the support rails 328 and 330. The outer wall 234 is mounted to the bottom member 336. End walls 338 and 340 extend a distance below the bottom member 336 and rearward toward the deck-crib 212, and include slide bearings engaging the support rails 328 and 330 and thus supporting the card presentation tray 232. The end wall 340 may extend upward above the bottom member 336 by a distance such as about 0.6 inch, to retain and support a group of shuffled playing cards 32.

Figure 22:
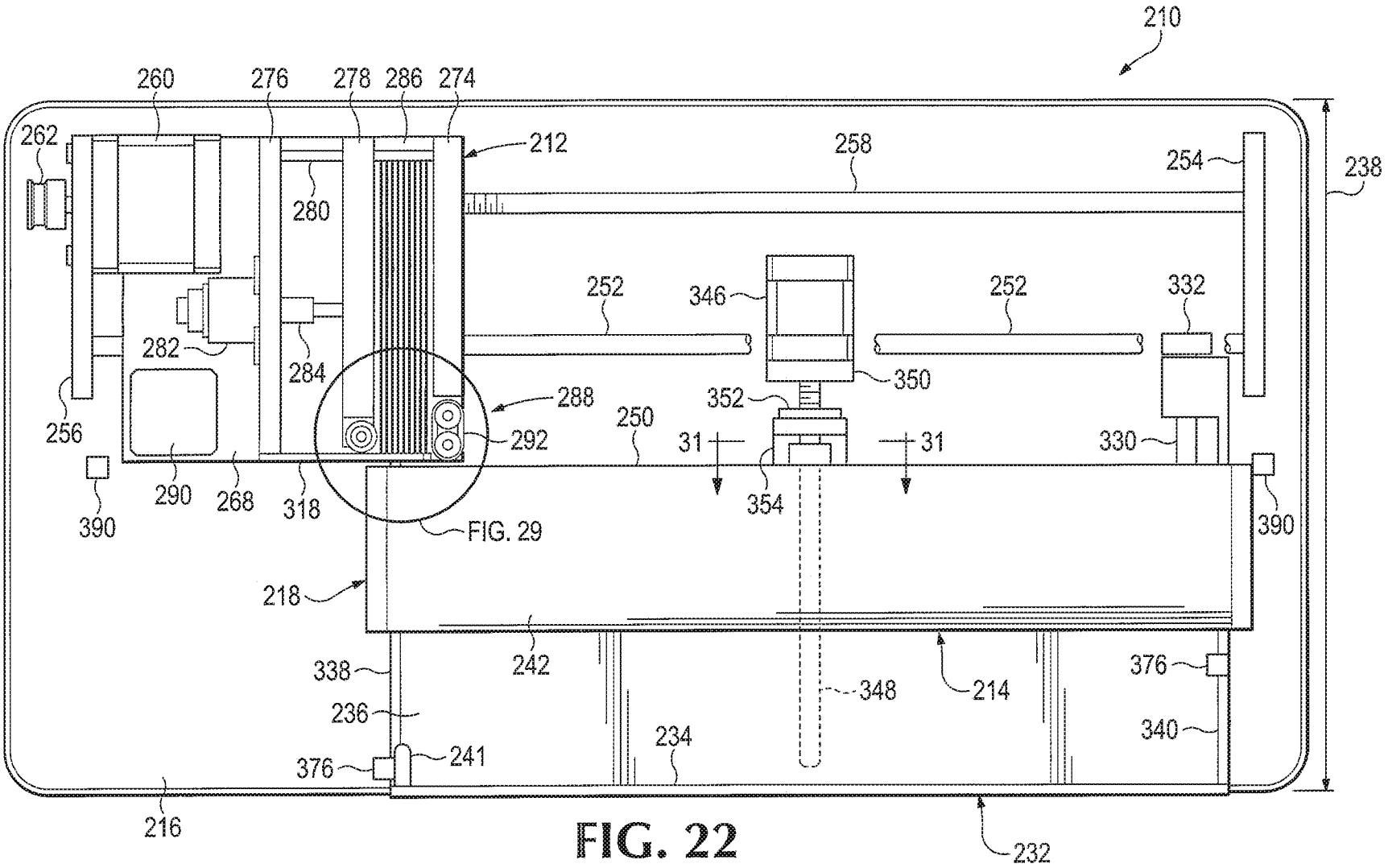
FIG. 22 is a top plan view of the card shuffler shown in FIGS. 19-21, with the covers removed.
Figure 23:
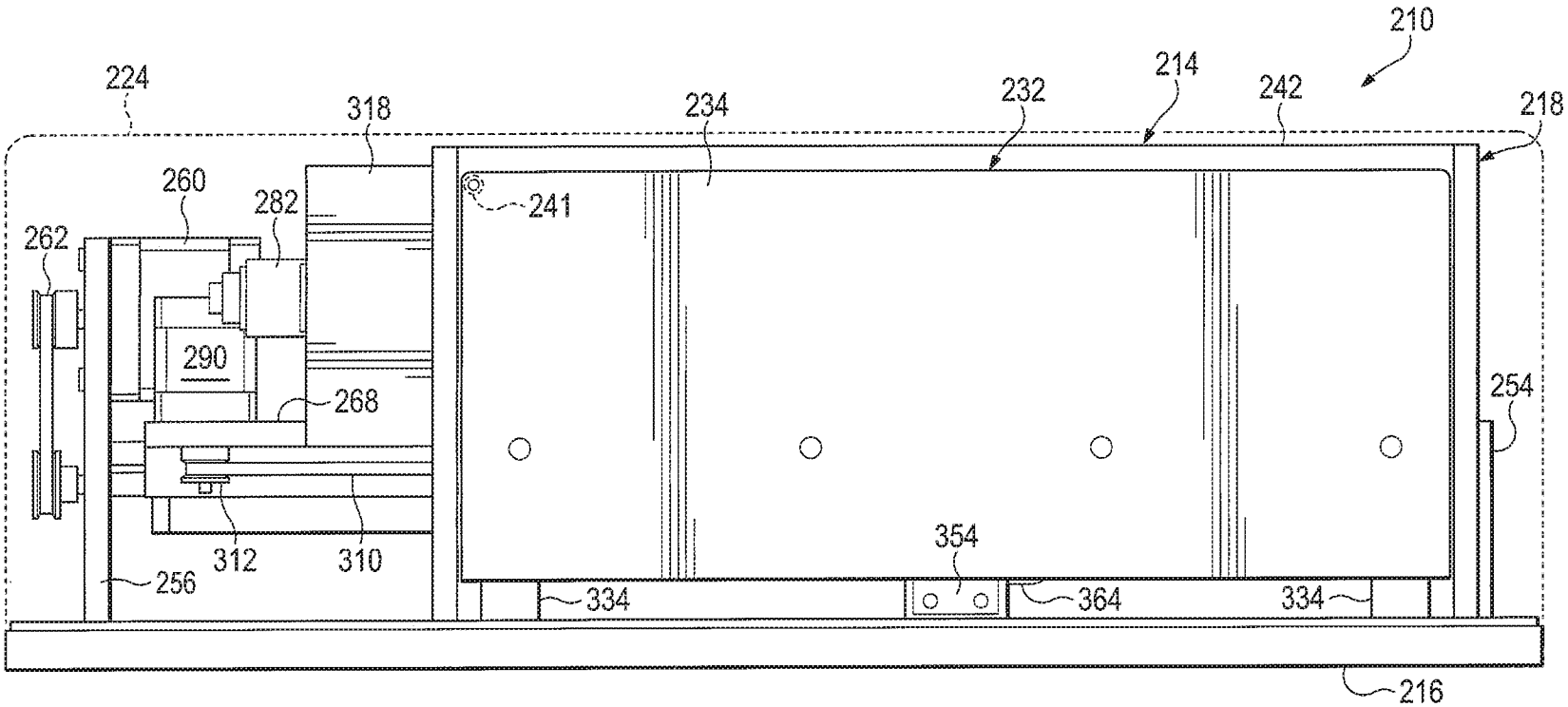
FIG. 23 is a front elevational view of the shuffler shown in FIGS. 19-21 with the covers removed.

Referring next to FIGS. 22 and 30-32, a precisely controllable motor such as a stepper motor 346 is mounted on the base 216 beneath the guide rod 252 and is connected to drive a lead screw 348 aligned horizontally and extending forward beneath the bottom member 336 of the card presentation tray 232 when the card presentation tray 232 is in the retracted position shown in FIG. 22. The lead screw 348 is connected to the stepper motor 346, which is mounted in a support member 350. An outer, or front, end of the lead screw 348 extends through a drive nut 352 mounted on a bracket 354 carried on the underside of the rear margin of the bottom member 336.

A card pusher bar 358 is attached to the rear margin of the bottom member 336, as by a pair of fasteners such as screws 360 mounted in the bottom member 336 and extending through vertically oriented elongated holes 362. The card pusher bar 358 can be raised or allowed to drop relative to the bottom member 336 by a cam 364 moved by the lead screw 348 through an angle defined by limit stops, such as the ends of an arcuate slot 366 in the cam 364 and a member such as a screw 368 mounted in the bracket 354 and extending into the slot 366. It will be understood that rotation of the cam 364 can be limited in other ways, such as, for example, by shaping portions of the cam 364 to contact portions of the bracket 354. The shape of the cam 364 is designed so that rotation of the lead screw 348 in the direction required to drive the card presentation tray 232 outward toward the card presentation position shown in FIG. 19 will raise the card pusher bar 358 before the card presentation tray 232 moves too far. A collar 363 attached to the cam 364 and surrounding the lead screw 348 may include a slip clutch 369, which may be as simple as a screw having a resilient tip adjusted to bear on the lead screw 348 sufficiently to carry the cam 364 through the required angle of movement and then slip on the lead screw 348 as it continues to rotate in the direction required to move the card presentation tray 232. A top margin of the card pusher bar 358 may be chamfered, so as to engage the rounded corners of cards 32 and move them forward if necessary as the card pusher bar 358 is raised. The card pusher bar 358, when raised, will bear on the rear corners and a portion of the upright ends of the shuffled cards 32 to push them forward from the single-card receptacles 220 as the card presentation tray 232 moves forward toward the presentation position, so that the cards can be removed from the card presentation tray 232 by the dealer. The raised card pusher bar 358 is low enough, and the bottoms of the depending divider leaves 244 defining the single-card receptacles 220 are high enough, to provide clearance beneath the divider leaves 244 for the card pusher bar 358. Once the cards have been removed from the card presentation tray 232, when the lead screw 348 is rotated in the reverse direction it will move the cam 364 in the opposite direction through the available angle of movement, allowing the card pusher bar 358 to move downward as the card presentation tray 232 is retracted beneath the frame 218.

Figure 24:
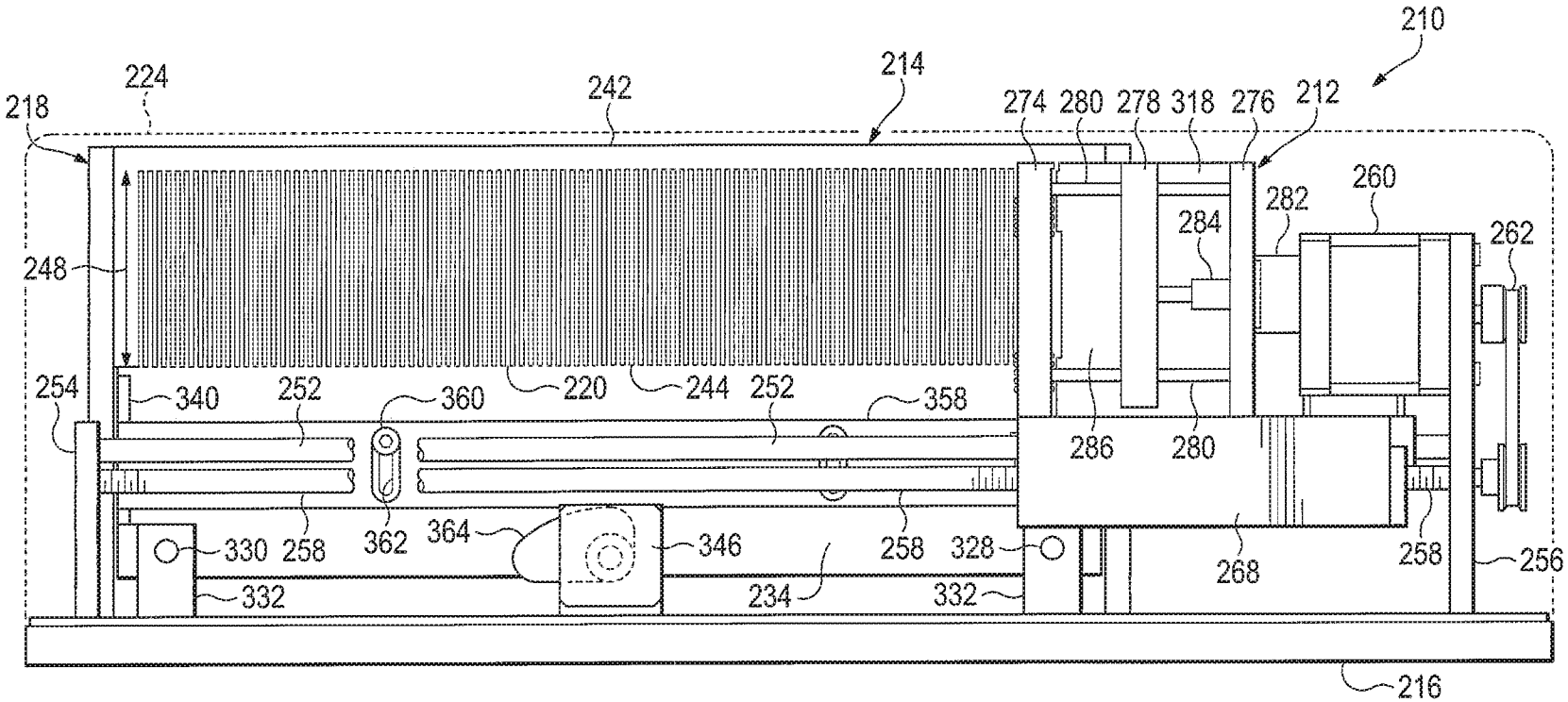
FIG. 24 is a rear elevational view of the shuffler shown in FIGS. 19-21 with the covers removed.
Figure 25:
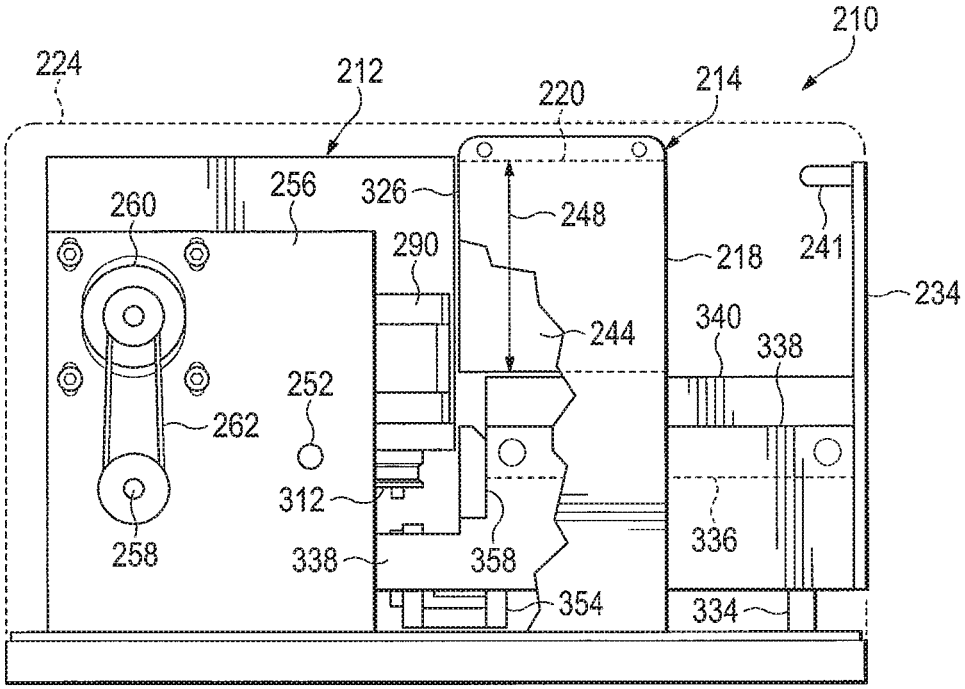
FIG. 25 is a partially cutaway left end elevational view of the shuffler shown in FIGS. 19-21, with the covers removed.
Figure 25A:
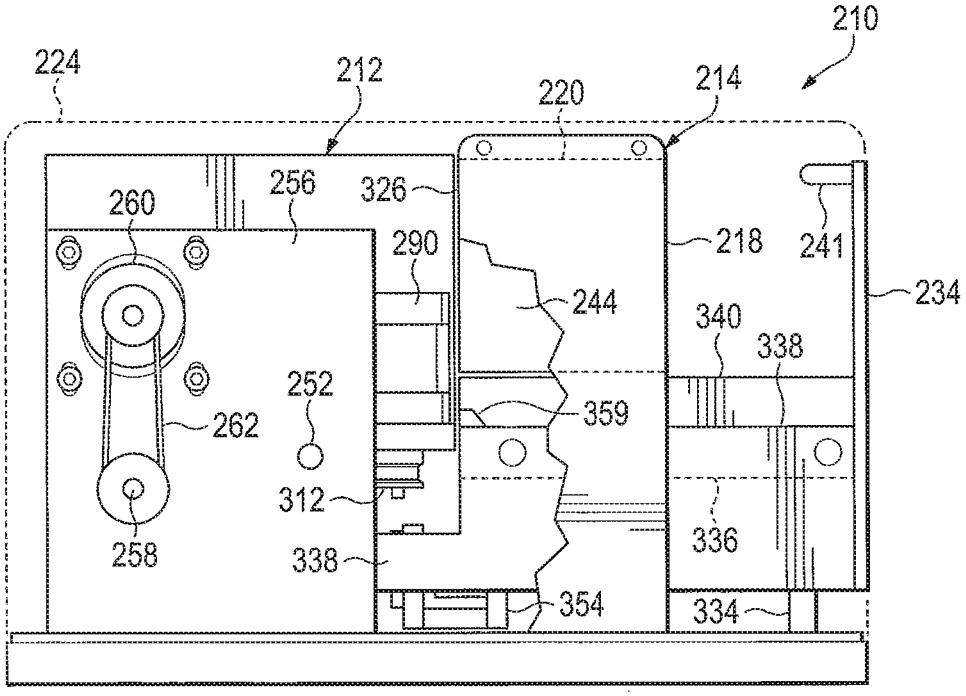
FIG. 25A is a view similar to FIG. 25, showing an alternative embodiment of a portion of the card presentation tray.
Figure 26:
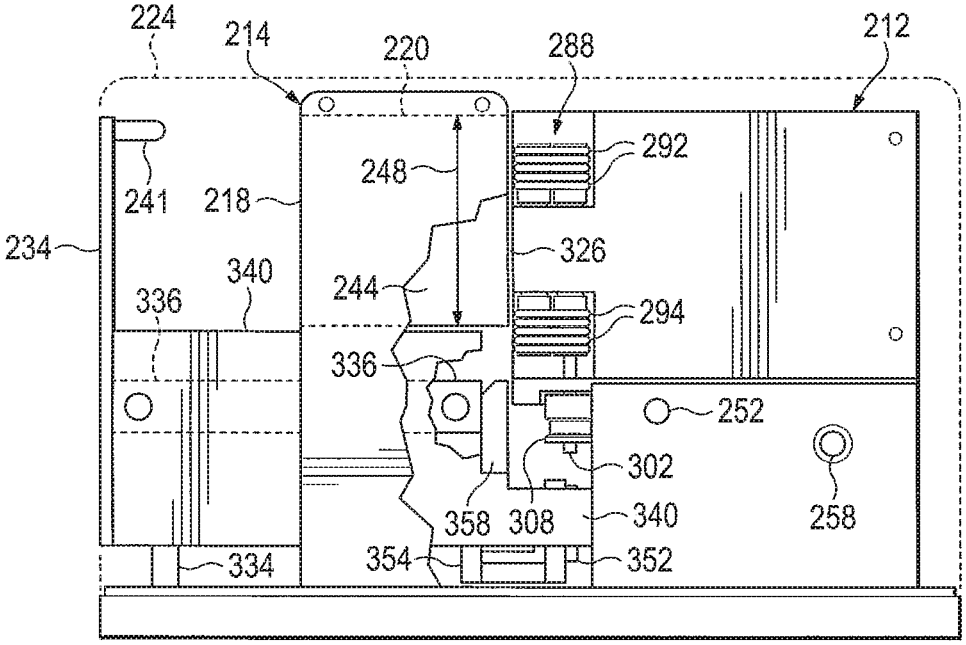
FIG. 26 is a partially cutaway right end elevational view of the shuffler shown in FIGS. 19-21, with the covers removed.
Figure 27:
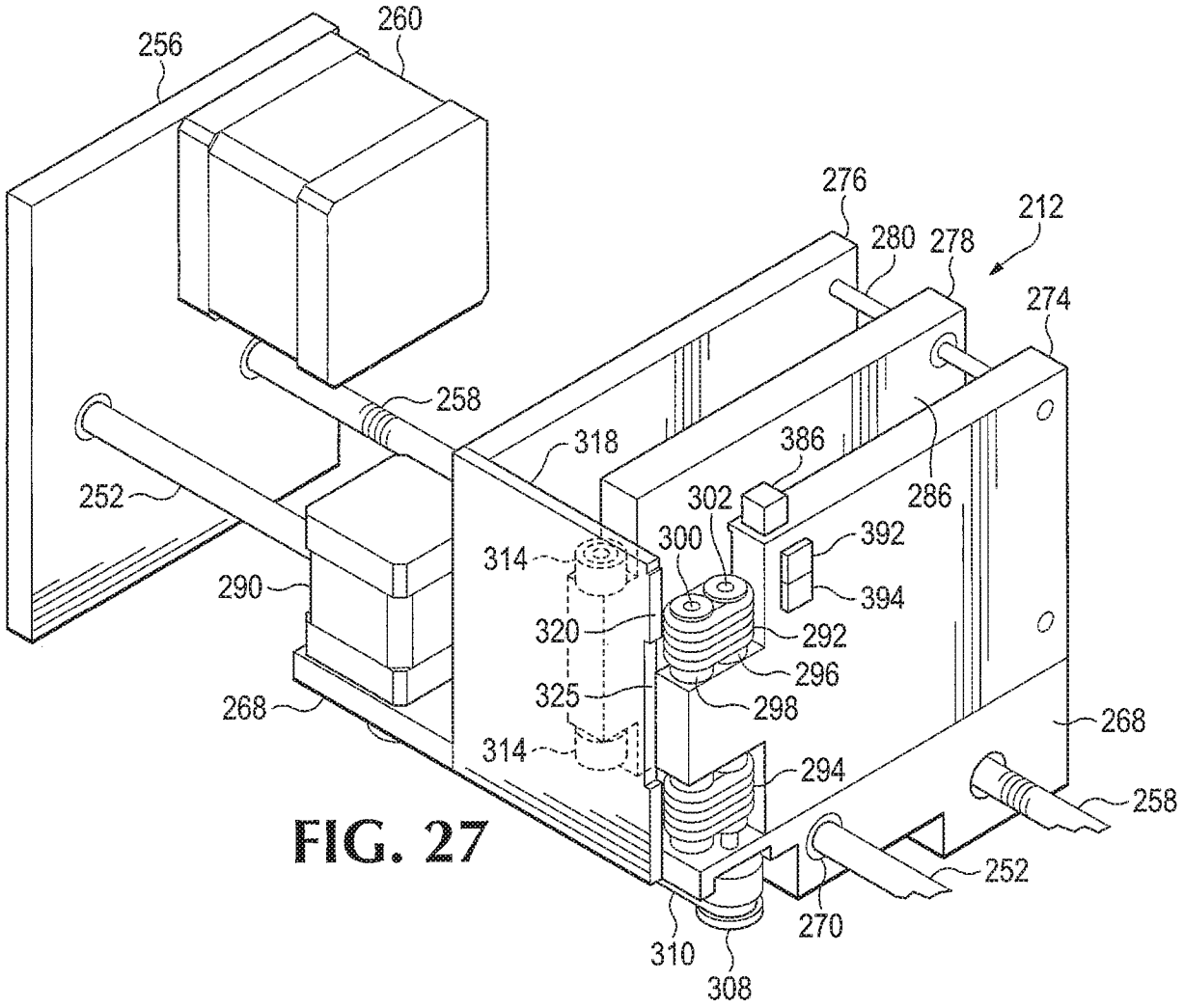
FIG. 27 is an isometric view from the upper right of the deck-crib and associated motors of the shuffler shown in FIGS. 19-26, with the covers and several portions of the mechanisms omitted for the sake of clarity.
Figure 28:
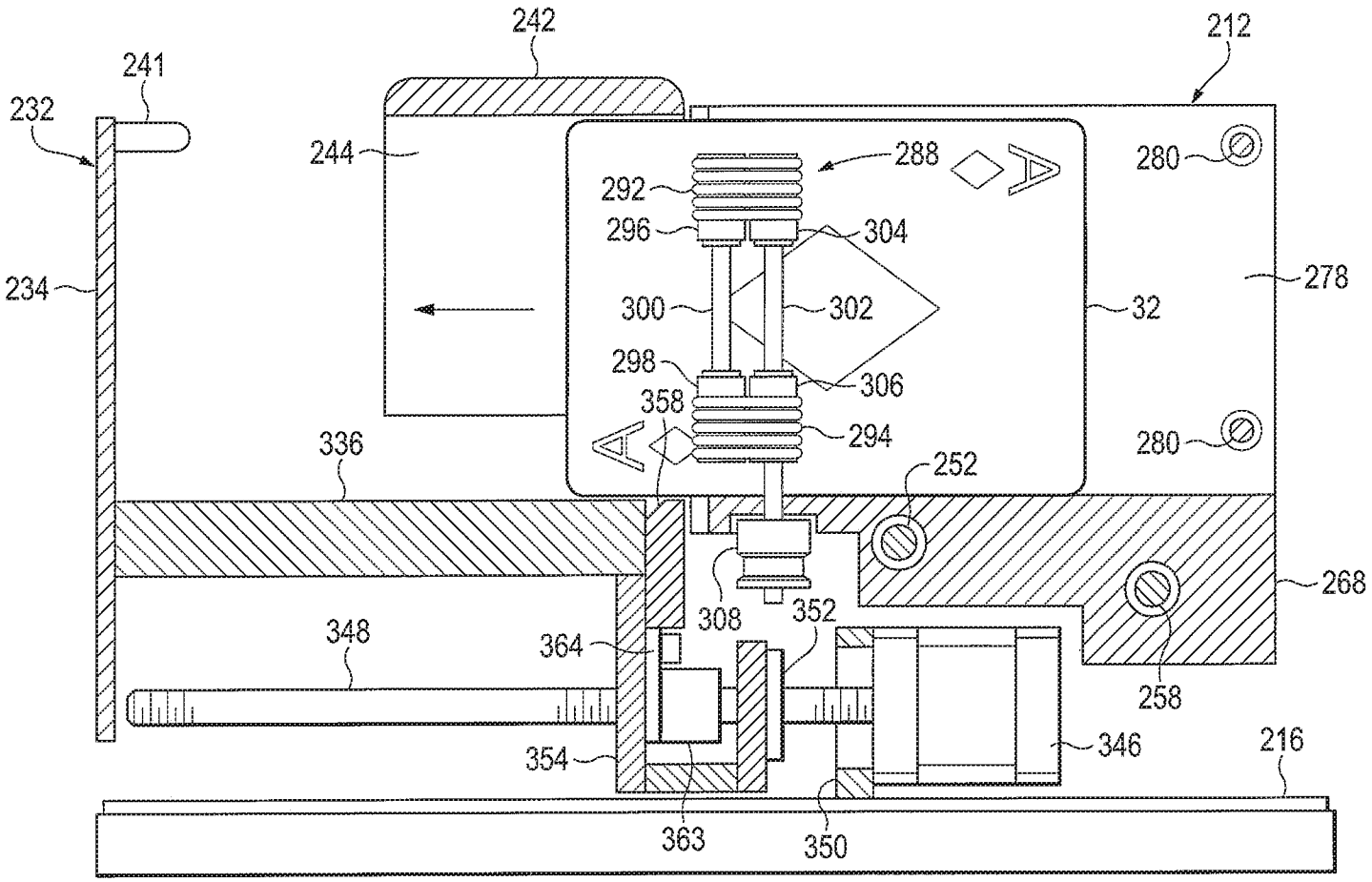
FIG. 28 is a side, partial sectional view, with several portions of the mechanisms removed, of the deck-crib and card mover mechanism of FIG. 22, showing a card being moved from the deck-crib into the dealing rack.
Figure 29:
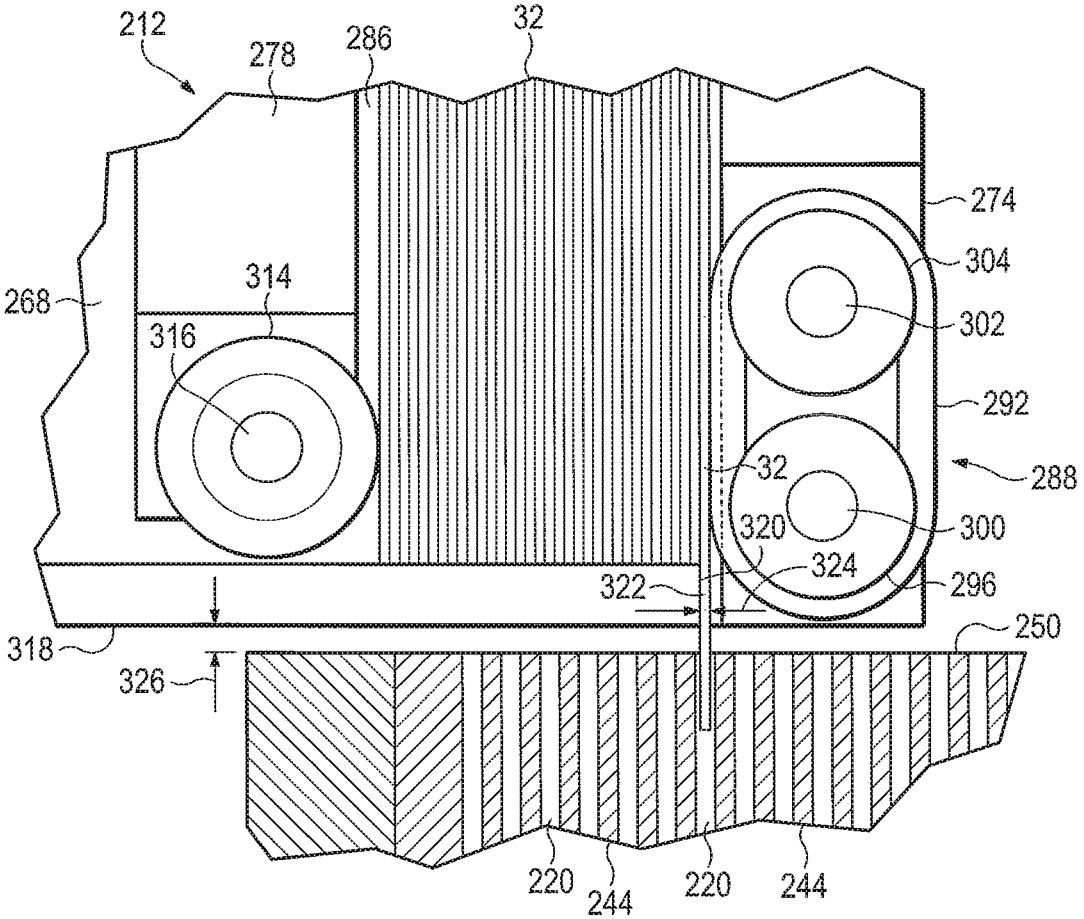
FIG. 29 is a top plan view of a detail of the deck-crib shown in FIG. 22, showing a card beginning to be moved into a single-card receptacle.
Figure 30:
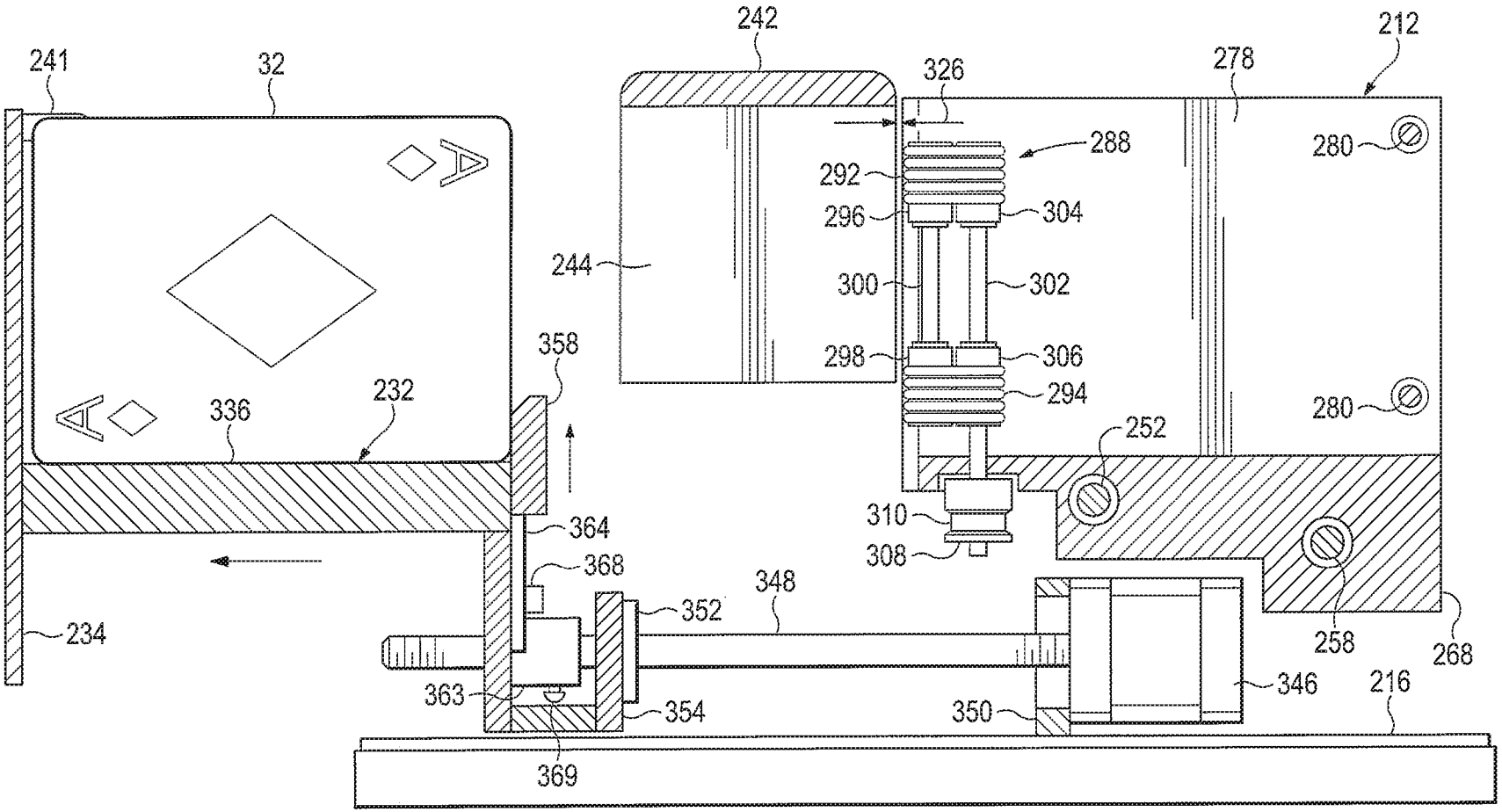
FIG. 30 is a sectional view taken along line 30-30 in FIG. 20, with the covers of the card shuffler omitted for clarity.
Figure 31:
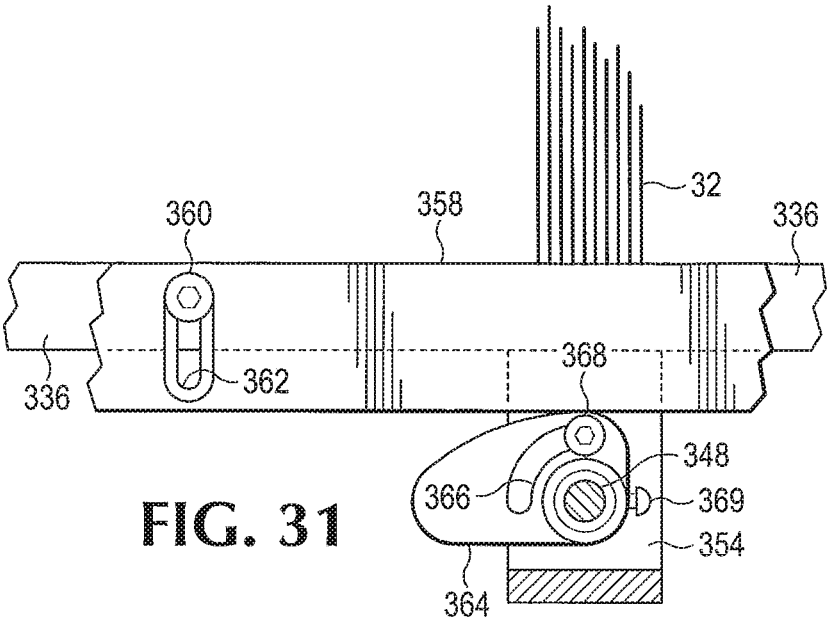
FIG. 31 is a detail view taken in the direction of line 31-31 in FIG. 22.
Figure 32:
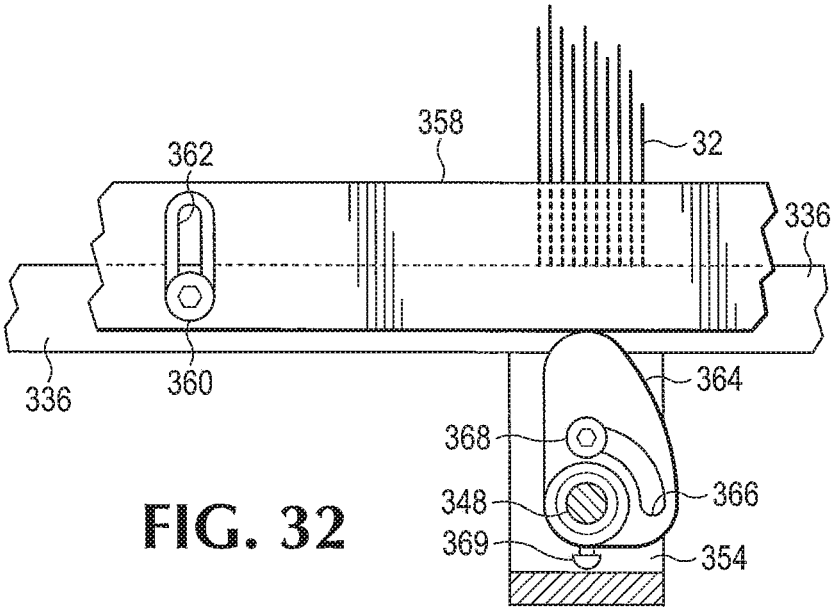
FIG. 32 is a detail view similar to FIG. 31, but showing a card pusher bar in a raised position, ready to push a group of shuffled cards out of the receiving rack with the card presentation tray.
Figure 33:
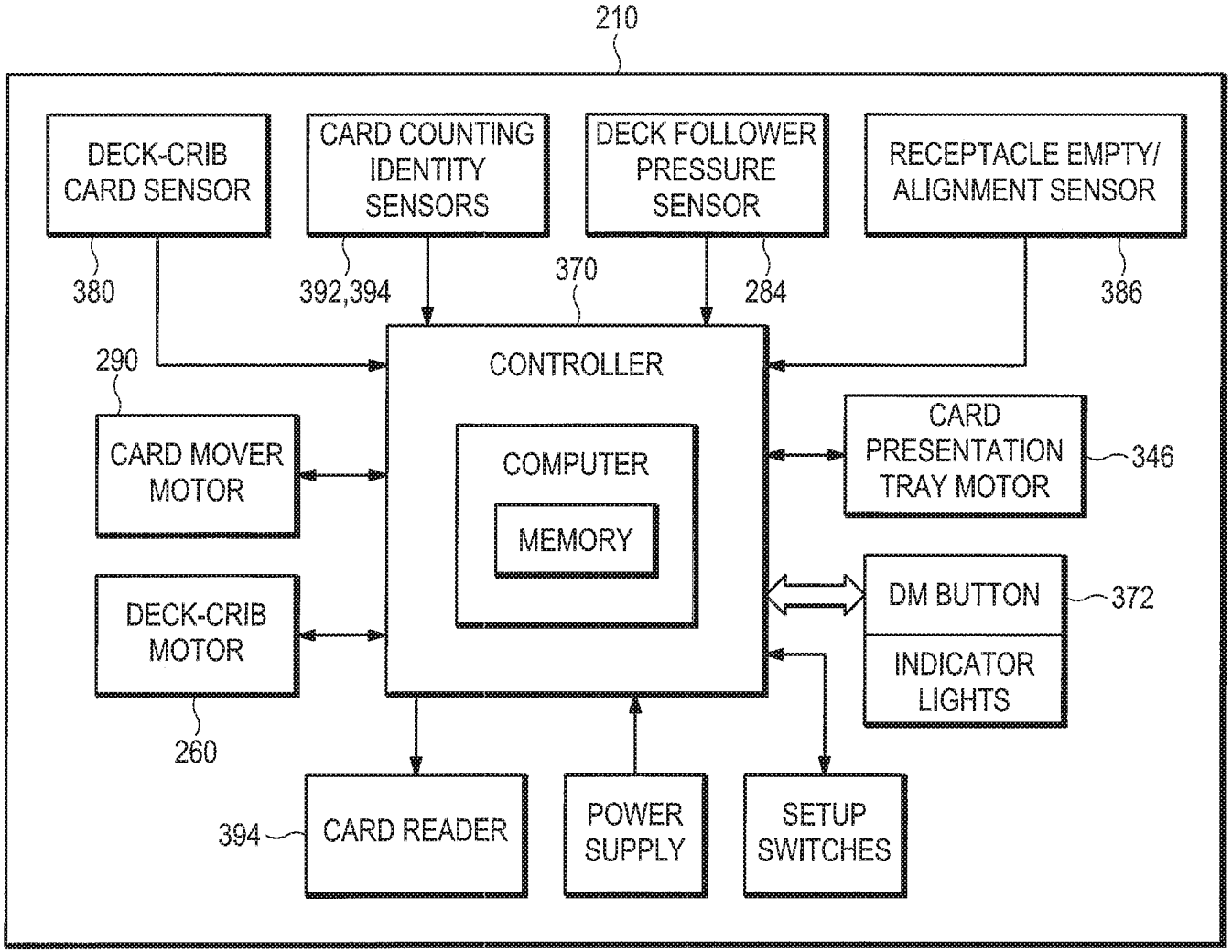
FIG. 33 is a simplified diagram of arrangement of electrical components of the shuffler shown in FIG. 19.
Figure 34:
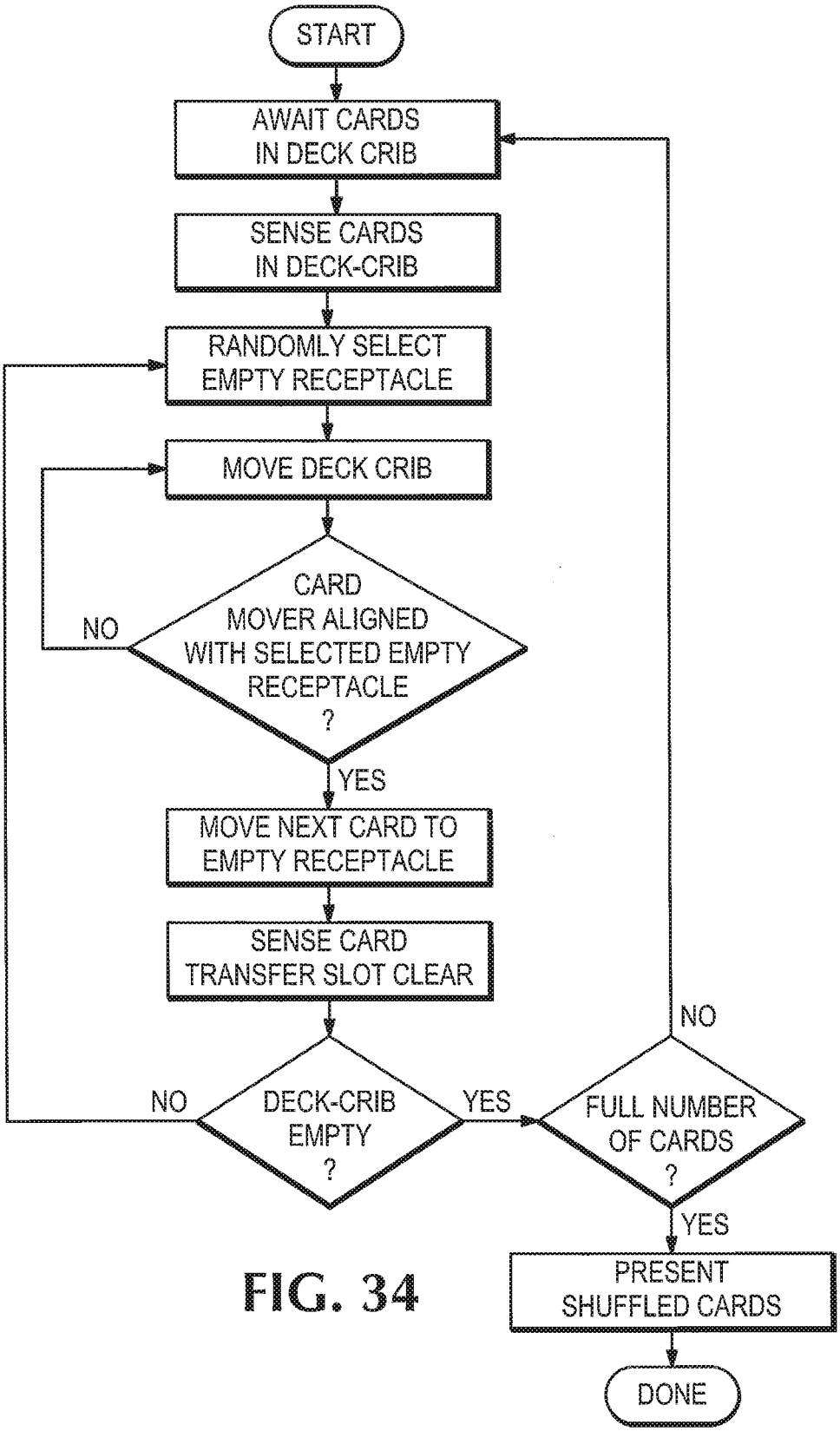
FIG. 34 is a flowchart for operating the shuffler shown in FIG. 21 to shuffle a multi-deck group of playing cards.
Figure 35:
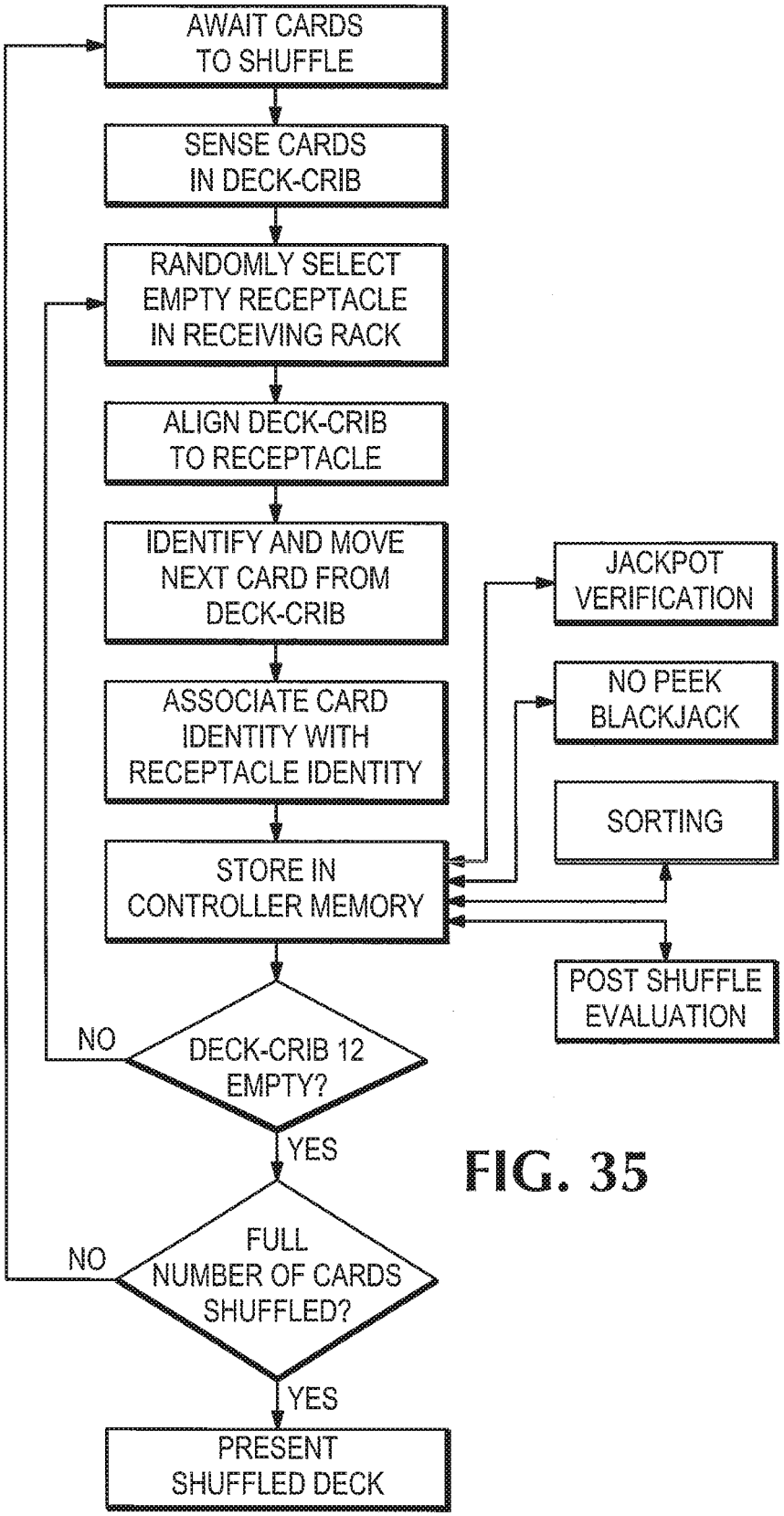
FIG. 35 is a simplified flowchart showing use of a card reader in conjunction with the shuffler.

As shown in FIGS. 24, 25, and 26 the card pusher bar 358 in its lowered position is flush with the top surface of the bottom member 336 of the card presentation tray 232. As a variation, as shown in FIG. 25A, instead of the card pusher bar 358 and its associated cam arrangement, a raised ridge 359 may be provided at the rear end of the bottom member 336. The ridge 359 may have a height of about 0.25 inch, for example, above the top face of the bottom member 336, with the upper face of the ridge aligned with or slightly lower than the height of the top of the base 268 of the deck-crib 212, so that a card 32 fed into one of the single-card receptacles 220 with sufficient speed will proceed past the ridge 359 and come to rest with its bottom edge resting on the top surface of the bottom member 336, to be carried forward with the card presentation tray 232. This configuration requires the top face of the bottom member 336 to be lower, by at least the height of the ridge 359, than it needs to be in the configuration shown in FIGS. 25 and 26.

A controller 370 may be located on the base 216, along with required power supplies. The controller 370 is connected electrically to the several motors 260, 282, 290 and 346, and is also connected electrically to a dealer manager (DM) button 372 located in the main cover 224 above the controller 370.

Operation of the shuffler 210 is similar in many ways to operation of the shuffler 10 described above.

An empty tray sensor 376 may be utilized to provide an electrical signal to the controller 370 indicating that a shuffled six-deck group of cards has been removed from the card presentation tray 232, and the controller 370 may be programmed either to retract the card presentation tray 232 after a predetermined delay time, or to accept a command from the dealer manager button 372 to cause the card presentation tray 232 to be retracted after such a predetermined delay time. The card presentation tray 232 is retracted by operation of the stepper motor 346, driving the lead screw 348.

Once the card presentation tray 232 has been retracted and cards are present in the deck-crib 212, the controller 370 will commence the process of shuffling the cards that are in the deck-crib 212. An optical sensor 390, for example, an IR laser/detector pair located on the receiving rack 214, determines whether the gap 326 is obstructed, and seeing that the gap 326 is unobstructed, sends an electrical signal to the controller 370, which confirms that the deck-crib 212 is free to move to a different position along the receiving rack 214.

A status indication may be provided by a separate status indication light, such as an LED lamp 374 located on the main cover 224, or by a similar indication provided by signal lamps included in the dealer manager button 372, similar to the dealer manager (DM) button 144 in the shuffler 10 described above. Such an indicator might show red while the shuffling process is proceeding with respect to one group of cards that have been placed into the deck-crib 212, and green when the deck-crib 212 is ready to allow a group of cards 32 to be inserted.

An optical sensor 380 is located in the deck-crib 212. When a group of cards is inserted into the deck-crib 212 to be shuffled the deck-crib sensor 380 detects the presence of at least one card and provides an electrical signal to the controller 370, which, after a preset delay time of, for example, three seconds, energizes the controllable motor 282 to move the deck follower 278 toward the end wall 274. The pressure sensor 284 sends a pressure signal to the controller 370, and when the controller 370 determines that the cards are urged toward the end wall 274 with enough pressure to ensure that the frictional drive members 292 and 294 will engage the face of the adjacent, bottom, card 32, the controller stops the controllable motor 282. Once a card 32 has been moved from the deck-crib 212 the controller 370 will determine whether the pressure, as sensed by the pressure sensor 284, is still appropriate and, based on the signals from the pressure sensor 284, will cause the controllable motor 282 to move the deck follower 278 as required from time to time.

With the card receiving rack 214 empty there are, for example, 314 empty single-card receptacles 220 available. As with the shuffler 10 described above, a random number generator in the controller 370 randomly selects one of the empty single-card receptacles 220 and sends an appropriate signal to the stepper motor 260, causing the stepper motor 260 to rotate the lead screw 258 appropriately to move the deck-crib 212 so that the card transfer slot 322 is aligned with the selected single-card receptacle 220 of the receiving rack 214.

A card receptacle alignment sensor 386 associated with the deck-crib 212 determines whether the outfeed, or card transfer slot 322 is properly aligned with the selected single-card receptacle 220. If alignment is not correct, the controller 370 will send additional order signals to the stepper motor 260 to move the deck-crib 212 until the card receptacle alignment sensor 386 indicates that alignment is satisfactory.

Once the card outfeed or transfer slot 322 is properly aligned, the controller 370 will cause the card mover motor 290 to move the drive shaft 302, and with it the frictional drive members 292 and 294, far enough to move the bottom card 32 out of the deck-crib 212 through the card transfer slot 322 with enough speed to continue across the gap 326 between the deck-crib 212 and the receiving rack 214 and into the selected single-card receptacle 220 far enough to pass effectively over and beyond the card pusher bar 358, where the outer wall 234 of the card presentation tray 232 will prevent the card 32 from going too far. The controller 370 is programmed to limit the amount of rotation of the drive shaft 302 to prevent the subsequent bottom card 32 in the deck-crib from moving into the gap between the deck-crib 212 and the receiving rack 214.

Once a card 32 has been placed into one of the single-card receptacles 220, the controller 370 then causes the random number generator to select another single-card receptacle 220 from among the remaining empty ones. The open gap sensor 390 again verifies that the deck-crib 212 can again be moved, and the next bottom card 32 is then placed in the next selected single-card receptacle 220 by the same steps just described. This sequence of steps is repeated, with random selection of one of the remaining open single-card receptacles 220 after each card 32 is moved, until all of the cards that had been placed into the deck-crib 212 have been moved into respective randomly selected single-card receptacles 220 and the deck-crib sensor 380 detects and sends a signal to the controller 370 indicating that there are no more cards left in the deck-crib 212. The controller then directs the stepper motor 260 to move the deck-crib 212 to the card receiving position at the left end of the shuffler 210 and sends a signal directing the controllable motor 282 to again retract the deck follower 278 to make the space 286 available for the next group of cards 32 to be placed into the deck-crib 212 to be shuffled. Most of the cards of a large group are thus shuffled as smaller groups while game pay continues, and shuffling the final group will result in quicker readiness to continue play than the time required to load and unload two sets of six decks in a batch rotation system.

The controller 370 may be programmed so that when the card presentation tray 232 is first retracted in an empty condition, a pair of cut cards 222, plastic cards similar to playing cards but without faces, inserted at the bottom of the first group of cards 32 inserted into the deck-crib 212, will be placed into the two extreme end single-card receptacles 220 in the receiving rack 214 before any actual playing cards are placed into randomly selected single-card receptacles 220.

In addition to the controls to cause the shuffler 210 to operate as described above, an additional sensor 392 may be provided on the deck-crib 212 to count the number of cards transferred from the deck-crib 212 to the receiving rack 214 in order to determine that the correct number of cards have been shuffled and that the multi-deck group of cards is thus complete. An optical scanner 394 may also be associated with the deck-crib 212 to determine the identity, the rank or suit or both, of each card as it is transferred from the deck-crib 212 to the receiving rack 214, and to communicate each card identity to the controller 370. The identity of each card can be associated with the selected single-card receptacle 220 to which that card has been delivered and the association can be stored within memory of the controller 370.

For Blackjack, the shuffler 210, equipped to identify and store in computer memory the locations of cards, can be used advantageously together with a dealing shoe (not shown) equipped with a counter to provide to the controller 370 the number of cards that have been dealt at any given time. The dealer could query the order of the cards in the shuffled multi-deck group being dealt from the shoe, as by pushing the dealer manager button 372 in a predetermined fashion, and the shuffler 210 could then flash the dealer manager button 372 according to whether the last card dealt, always the dealer's hole card in Blackjack, was a card with a value of ten or not. The dealer manager button 372 could blink red to indicate that the hand is over and that the dealer can show the hole card and reveal a Blackjack. If the last card dealt is not a ten-value card, the dealer manager button could blink green, indicating that the hand can continue because there is no Blackjack in the dealer's hand. If the dealer shows a ten, the dealer manager button 372 could be pushed with a different sequence to query whether the last card dealt was an Ace. Such a system, the shuffler 210 coupled with a card-counting shoe, enables a "no-peek" Blackjack capability, so long as the shuffled six-deck group of cards is not cut before being dealt from the shoe.

Figure 19A:
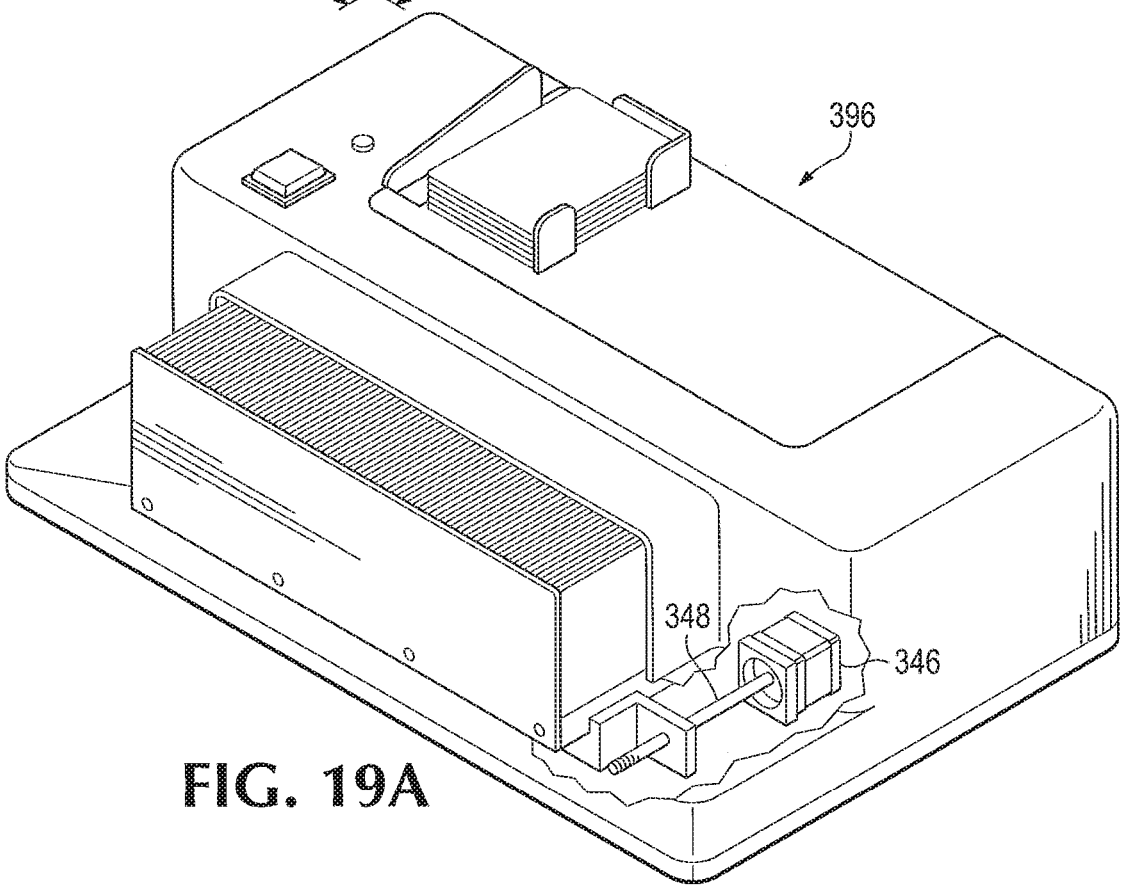
FIG. 19A is a partially cut-away isometric view from an upper right front of a card shuffler of a slightly different arrangement.

In a multi-deck card shuffler 396 shown in FIG. 19A, which is another embodiment of the shuffler 210, the stepper motor 346 and lead screw 348 may be located near an end of a base portion, generally similar to one side of the card presentation tray 232, so that the guide rod and lead screw for the card presentation tray 232 may be located lower and closer to the base in order to reduce the overall height of the shuffler 210. The width of the shuffler 396 in such a configuration is greater than that of the shuffler 210, to provide room at the end for the stepper motor driving the card presentation tray 232. Other card presentation tray movement arrangements may also be provided using, for example, scissors-like or pantograph linkage mechanisms of minimum height, or linkages attached to the card presentation tray 232 at an end, so that the deck-crib 212 and dealing rack may be mounted lower and closer to the base 216 of such a shuffler, although such variations are not shown nor described in detail herein.

As another alternative (not shown) to the card shuffler 210 as described above, the divider leaves 244 could be replaced by dividers with a smaller depth, as well as additional dividers extending upward from the card presentation tray 232, leaving an opening between the upper and lower dividers through which a mechanism could be moved to push shuffled cards 32 forward onto a presentation tray. The dividers defining the individual single-card receptacles 220 could also be mounted on the bottom alone, leaving room above the dividers for a card ejection mechanism.

Although opening a new multi-deck card game in a casino can be very time-consuming using the conventional methods, the multi-deck shuffler 210 can greatly reduce the time required, since each deck of cards, after being inspected, "washed," and squared, can be placed directly into the shuffler 210, and each card will be placed in a randomly selected single-card receptacle 220 among 312 randomly available positions. There is thus no interrelation between the original position of an individual card and a new deck and the eventual position after shuffling using the multi-deck shuffler 210, but the shuffling process can take place incrementally, without waiting until all six decks have been prepared.

The terms and expressions that have been employed in the foregoing specification are used therein as terms of description and not of limitation, and there is no intention in the use of such terms and expressions of excluding equivalents of the features shown and described or portions thereof, it being recognized that the scope of the invention is defined and limited only by the appended claims.

What is claimed is:

1. A method of dealing playing cards comprising:

placing playing cards into respective single-card receptacles in a dealing rack including a plurality of single-card receptacles located adjacent one another in a fixed array and arranged so that the playing cards in the plurality of single-card receptacles are parallel with each other;

recording in a memory portion of a controller an identity of each one of the playing cards and an associated identity of a respective one of the plurality of single-card receptacles into which each respective one of the plurality of playing cards is placed;

placing the dealing rack into a first position alongside a blocking wall adjacent a card removal side of the dealing rack;

responsive to a predetermined condition automatically moving one of the dealing rack and the blocking wall relative to the other through a distance determined by the controller to expose a first selected number of single-card receptacles beyond a margin of the blocking wall to create an open path along the margin of the blocking wall for removal of a number of the playing cards, equal to the first selected number of single-card receptacles, from the dealing rack;

repetitively, until a selected number of groups of the playing cards have been removed from the dealing rack:

removing the number of the playing cards from the exposed single-card receptacles as a group of the playing cards and retaining in the memory portion of the controller the identities of the ones of the number of the playing cards in the group of the playing cards;

sensing and automatically communicating electrically to the controller that it is appropriate to move the dealing rack to expose additional ones of the plurality of single-card receptacles beyond the margin of the blocking wall;

responsive to the communication, moving the one of the dealing rack and the blocking wall a further distance relative to the other to expose a selected number of additional ones of the plurality of single-card receptacles beyond the margin of the blocking wall; and thereafter, upon demand, retrieving and providing from the memory portion of the controller information concerning the identity of each of the playing cards in a selected one of the groups of playing cards.

2. The method of claim 1, wherein the information concerning the identity of each of the playing cards in the selected one of the groups of the playing cards is sufficient to identify whether a group of the playing cards made available for removal from the dealing rack for a dealer's hand amounts to a winning hand for the dealer.

3. The method of claim 1, wherein the information concerning the identity of each of the playing cards in the selected one of the groups of the playing cards is sufficient to identify whether a group of the playing cards made available for removal from the dealing rack for a player's hand amounts to a winning hand for the player.

4. The method of claim 1, used in playing blackjack, wherein each of the groups of the playing cards consists of two cards and wherein the information concerning the identity of each of the playing cards in a selected one of the groups of playing cards is sufficient to inform a dealer whether the dealer's hand is a blackjack.

5. The method of claim 1, wherein sensing includes sensing that at least one of the plurality of single-card receptacles exposed beyond the margin of the blocking wall has been emptied.

6. The method of claim 1, further including sensing that a predetermined time has passed since a group of playing cards has been removed, and in response to the sensed predetermined time causing the dealing rack to move farther to expose all remaining ones of the plurality of single-card receptacles beyond the margin of the blocking wall, and thereafter removing all remaining ones of the playing cards from the dealing rack.

7. The method of claim 1, further including determining that a predetermined number of playing cards have been removed and in response to the determination, moving the dealing rack a further distance relative to the blocking wall to expose all remaining ones of the plurality of single-card receptacles beyond the margin.

8. The method of claim 1, further including keeping the dealing rack in such a position alongside the blocking wall that the blocking wall retains the playing cards in the respective single-card receptacles not exposed beyond the margin of the blocking wall.

9. The method of claim 1, wherein the first selected number of single-card receptacles to be exposed is randomly selected by the controller.

10. The method of claim 1, further including moving the dealing rack in response to the controller through a distance relative to the blocking wall, in an opposite direction to the moving the dealing rack and exposing the first selected number of single-card receptacles, after exposing the first selected number of single-card receptacles and prior to removal of the selected number of playing cards therefrom, to reduce the number of the playing cards that can be removed from the dealing rack without further movement of the dealing rack relative to the blocking wall.

11. The method of claim 1, wherein the first selected number of single-card receptacles is randomly selected by the controller from a predetermined range of numbers, and wherein the selected number of additional ones of the plurality of single-card receptacles is equal to the arithmetical difference between the first selected number and a total number of playing cards for a player's hand according to rules of a game for which the dealing is performed and wherein the first selected number of the playing cards determines a starting position for a deal in the game.

12. The method of claim 1, further including, while dealing a plurality of the groups of playing cards, providing signals to place the controller into a burn card mode and indicating a number of playing cards to be burned; and wherein in response to the signals the controller causes the dealing rack to move a further distance relative to the blocking wall to expose a number of the plurality of single-card receptacles, equal to the number of playing cards to be burned, beyond the margin of the blocking wall, and retaining in the memory portion of the controller the identity of each one of the playing cards.

13. A method of manipulating playing cards, comprising:

placing playing cards into respective, mutually parallel, single-card receptacles in a dealing rack;

recording in memory associated with a controller an identity of each playing card and an identity of an associated single-card receptacle receiving each playing card;

placing the dealing rack into a position alongside a blocking wall adjacent a card removal side of the dealing rack;

responsive to occurrence of a predetermined condition, the controller initiating movement of one of the dealing rack and the blocking wall relative to the other through a distance to expose a selected number of single-card receptacles beyond a margin of the blocking wall for removal of a group of the playing cards, equal in number to the selected number of single-card receptacles, from the dealing rack;

repetitively, until a selected number of groups of the playing cards have been removed from the dealing rack:

removing the number of the playing cards from the exposed single-card receptacles as a group of the playing cards and retaining in the memory the identities of the ones of the number of the playing cards in the group of the playing cards;

sensing and automatically communicating to the controller to initiate movement of the dealing rack to expose additional ones of the single-card receptacles;

responsive to the communication, the controller initiating movement of the one of the dealing rack and the blocking wall a further distance relative to the other to expose a selected number of additional ones of the single-card receptacles; and thereafter, upon demand, retrieving and providing from the memory information identifying each of the playing cards in a selected one of the groups of playing cards.

14. The method of claim 13, wherein the information identifying each of the playing cards in the selected one of the groups of the playing cards is sufficient to identify whether a group of the playing cards made available for removal from the dealing rack for a dealer's hand amounts to a winning hand for the dealer.

15. The method of claim 13, wherein the information identifying each of the playing cards in the selected one of the groups of the playing cards is sufficient to identify whether a group of the playing cards made available for removal from the dealing rack for a player's hand amounts to a winning hand for the player.

16. The method of claim 13, used in playing blackjack, wherein each of the groups of the playing cards consists of two cards and wherein the information identifying each of the playing cards in a selected one of the groups of playing cards is sufficient to inform a dealer whether the dealer's hand is a blackjack.

17. The method of claim 13, wherein sensing includes sensing that at least one of the exposed single-card receptacles has been emptied.

18. The method of claim 13, further including sensing that a predetermined time has passed since a group of playing cards has been removed, and in response to the sensed predetermined time, the controller causing the dealing rack to move farther to expose all remaining single-card receptacles, and thereafter removing all remaining ones of the playing cards from the dealing rack.

19. The method of claim 13, further including determining that a predetermined number of playing cards have been removed and in response to the determination, the controller initiating movement of the dealing rack a further distance relative to the blocking wall to expose all remaining single-card receptacles beyond the margin.

20. The method of claim 13, further including keeping the dealing rack in position so that the blocking wall retains the playing cards in the single-card receptacles not exposed beyond the margin of the blocking wall.

21. The method of claim 13, wherein the controller randomly selects the selected number of single-card receptacles to be exposed.

22. The method of claim 13, further including the controller initiating movement of the dealing rack in an opposite direction to the moving the dealing rack and exposing the selected number of single-card receptacles, after exposing the selected number of single-card receptacles and prior to removal of the number of playing cards therefrom, to reduce the number of the playing cards that can be removed from the dealing rack without further movement of the dealing rack relative to the blocking wall.

23. The method of claim 13, wherein the controller randomly selects the selected number of single-card receptacles from a predetermined range of numbers, and wherein the selected number of additional ones of the single-card receptacles is equal to the arithmetical difference between the selected number and a total number of playing cards for a player's hand according to rules of a game for which dealing is performed and wherein the selected number of single-card receptacles determines a starting position for a deal in the game.

24. The method of claim 13, further including, while dealing a plurality of the groups of playing cards, providing signals to place the controller into a burn card mode and indicating a number of playing cards to be burned; and wherein in response to the signals the controller causes the dealing rack to move a further distance relative to the blocking wall to expose a number of the single-card receptacles equal to the number of playing cards to be burned and retaining in the memory the identities of the playing cards to be burned.

* * * * *